US010590648B2

(12) United States Patent
Tebb et al.

(10) Patent No.: US 10,590,648 B2
(45) Date of Patent: Mar. 17, 2020

(54) OUTDOOR WOOD DECKING BOARD

(71) Applicants: Terry Allen Tebb, Gig Harbor, WA (US); Travis Mark Tebb, Gig Harbor, WA (US)

(72) Inventors: Terry Allen Tebb, Gig Harbor, WA (US); Travis Mark Tebb, Gig Harbor, WA (US)

( * ) Notice: Subject to any disclaimer, the term of this patent is extended or adjusted under 35 U.S.C. 154(b) by 0 days.

(21) Appl. No.: 15/633,019

(22) Filed: Jun. 26, 2017

(65) Prior Publication Data

US 2018/0223529 A1 Aug. 9, 2018

Related U.S. Application Data

(63) Continuation-in-part of application No. 15/426,036, filed on Feb. 6, 2017.

(51) Int. Cl.
*E04B 5/12* (2006.01)
*E04F 15/04* (2006.01)
(Continued)

(52) U.S. Cl.
CPC ..... *E04B 5/12* (2013.01); *E04B 5/026* (2013.01); *E04B 5/04* (2013.01);
(Continued)

(58) Field of Classification Search
CPC ..... E04F 15/04; E04F 15/041; E04F 15/042; E04F 15/043; E04F 15/045; B32B 21/14;
(Continued)

(56) References Cited

U.S. PATENT DOCUMENTS 2,261,264 A 11/1941 Luty
2,419,614 A 4/1947 Welch
(Continued)

FOREIGN PATENT DOCUMENTS

CA 2140022 A1 1/1994
EP 2475517 B1 4/2015
WO 2016123023 A1 8/2016

OTHER PUBLICATIONS

Franklin Adhesives, Advantage EP-925, Product Description,e-catalog, Jun. 23, 2017, pp. 2-7, Franklin International, Cloumbus, Ohio, U.S.

(Continued)

*Primary Examiner* — Joshua J Michener
*Assistant Examiner* — Matthew J Gitlin
(74) *Attorney, Agent, or Firm* — Elizabeth Reilly; Patentpending, PLLC

(57) ABSTRACT

An outdoor wood decking board for use in construction of an outdoor deck floor, the outdoor decking board including a wood core formed from a first wood species of common grade wood species as a three-dimensional solid rigid body. A facing wood veneer formed from a second wood species of superior grade wood species as a three-dimensional solid rigid wood finishing layer permanently directly seamlessly attached via an adhesive to a first wood face of the wood core thereby the wood core having an appearance of the second wood species. In another embodiment, the facing wood veneer is formed from a third wood species, exotic hardwood species. A two-part emulsion polymer isocyanate adhesive is used to bond the wood core against the facing wood veneer; to bond two wood cores together. In another embodiment, the adhesive is a two-part polyurethane emulsion polymer.

14 Claims, 17 Drawing Sheets

(51) Int. Cl.

| | |
|---|---|
| ***E04B 5/04*** | (2006.01) |
| ***E04B 5/02*** | (2006.01) |
| ***E04F 15/02*** | (2006.01) |
| ***E04B 1/00*** | (2006.01) |
| ***E04C 3/12*** | (2006.01) |

(52) U.S. Cl.
CPC ..... *E04F 15/02183* (2013.01); *E04F 15/04* (2013.01); *E04F 15/042* (2013.01); *E04F 15/043* (2013.01); *E04B 1/00* (2013.01); *E04C 3/122* (2013.01); *E04F 2015/02083* (2013.01); *E04F 2201/0107* (2013.01); *E04F 2201/05* (2013.01)

(58) Field of Classification Search
CPC ..... B32B 37/14; B32B 2309/105; B32B 2419/00; C09J 7/20; C09J 2400/30; C09J 2400/303; C09J 2400/306
See application file for complete search history.

(56) References Cited

U.S. PATENT DOCUMENTS 3,234,074 A * 2/1966 Bryant ..... E04C 2/12 428/106
3,705,076 A * 12/1972 Usala ..... B32B 15/08 428/421
4,012,548 A 3/1977 Roberti
4,131,705 A * 12/1978 Kubinsky ..... B27N 3/06 428/106
4,142,007 A 2/1979 Lampe
4,844,763 A * 7/1989 Robbins ..... B27D 1/04 156/269
4,942,084 A * 7/1990 Prince ..... B27D 1/00 428/464
5,034,259 A * 7/1991 Barker ..... B27B 1/00 144/332
5,040,582 A * 8/1991 Hsu ..... B27D 1/04 144/348
5,059,472 A 10/1991 Le Bell
5,286,545 A * 2/1994 Simmons, Jr. ..... B32B 21/13 428/192
5,543,487 A * 8/1996 Vick ..... C09J 161/06 427/408
5,968,625 A 10/1999 Hudson
6,497,937 B1 12/2002 Lam
7,578,251 B1 8/2009 Gribble
7,651,582 B2 * 1/2010 Weimer ..... C09J 5/00 156/335
7,721,496 B2 * 5/2010 Carlson ..... B29C 44/06 264/271.1
8,357,457 B2 1/2013 Green
8,431,236 B2 * 4/2013 Horton ..... B27D 1/04 427/408
8,871,891 B2 10/2014 Barker
9,234,350 B1 1/2016 Gilbert et al.
2002/0110664 A1 8/2002 Seidner
2003/0026932 A1 2/2003 Johnson
2004/0250907 A1 * 12/2004 Nasli-Bakir ..... B32B 7/14 144/332
2005/0123728 A1 * 6/2005 Reichwein ..... B32B 3/02 428/192
2006/0035056 A1 * 2/2006 Fuzzell ..... B27D 1/04 428/105
2008/0003395 A1 1/2008 Cul et al.
2009/0042003 A1 2/2009 Govang
2009/0077919 A1 * 3/2009 Fam ..... E04F 15/04 52/592.1
2009/0193741 A1 * 8/2009 Cappelle ..... E04F 15/02 52/309.1
2011/0005435 A1 1/2011 Renck
2011/0287211 A1 * 11/2011 Bailey ..... B27N 3/04 428/99
2012/0015176 A1 * 1/2012 Riebel ..... B32B 27/06 428/323
2013/0065012 A1 3/2013 Parker
2015/0197943 A1 * 7/2015 Ziegler ..... B32B 37/10 428/161
2016/0039113 A1 * 2/2016 Bukowski ..... B27M 1/02 52/588.1
2016/0046094 A1 * 2/2016 Beakler ..... B32B 3/06 428/220
2017/0008258 A1 * 1/2017 Bogner ..... B32B 21/042
2017/0217134 A1 * 8/2017 Beuchel ..... B32B 21/08
2017/0305119 A1 * 10/2017 Bergelin ..... B32B 21/14

OTHER PUBLICATIONS

Pacific Adhesives Company, Inc., Technical Data Sheet EWG2227, Crosslinking Vinyl Acetate, Safety Data Sheet, Apr. 3, 2015, pp. 1-3, Vancouver, WA, U.S.
Franklin Adhesives, Advantage EP-950A, Product Description, e-catalog, Jun. 23, 2017, pp. 2-7, Franklin International, Columbus, Ohio, U.S.
Franklin Adhesives, Advantage EP-925, Product Description,e-catalog, Jun. 23, 2017, pp. 2-7, Franklin International, Columbus, Ohio, U.S.
Franklin Adhesives, Advantage EJP 930, Product Description, e-catalog, Jun. 23, 2017, pp. 2-5, Franklin International, Columbus, Ohio, U.S.
ICC Evaluation Service Inc, ICC-ES Report ESR-1140, ICC Evaluation Report, Jun. 23, 2017, pp. 1-3, ICC Evaluation Services, Inc. U.S.
ICC Evaluation Service, Inc.,ICC Evaluation Legacy Report ER 5440, ES Legacy Report, p. 1, ICC Evaluation Service, Inc., U.S.
ICC Evaluation Service, ICC-ES Legacy Report NER-165, ICC Evaluation Report, Jun. 23, 2017, pp. 1-2, ICC Evaluation Services, U.S.
Pacific Adhesives Company, Inc., Technical Data Sheet, R517BWG Crosslinking Vinyl Acetate, Safety Data Sheet, Apr. 3, 2015, pp. 1-3, Vancouver, WA, U.S.
Pacific Adhesives Company, Inc., Technical Data Sheet, EWG2227, Crosslinking Vinyl Acetate, Safety Data Sheet, Apr. 3, 2015, Vancouver, WA, U.S.
Akzonobel, Material Data Sheet, Product No. C1263, melamine-formaldehyde resin methyl alcohol and formaldehyde, Jan. 17, 2013, pp. 1-2, High Point, NC, U.S.
Alfred W. Christiansen and Charles B. Vick, Hydroxymethylated resorcinol coupling agent for wood surfaces to produce exterior durable bonds, Sinlanes and other Coupling Agents, vol. 2, pp. 193-208, Ed. K. L. Mittal, 200. U.S.

* cited by examiner

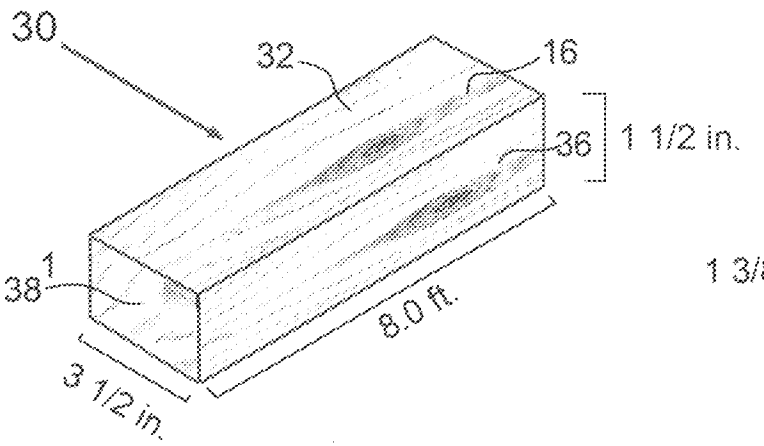
FIG. 4A
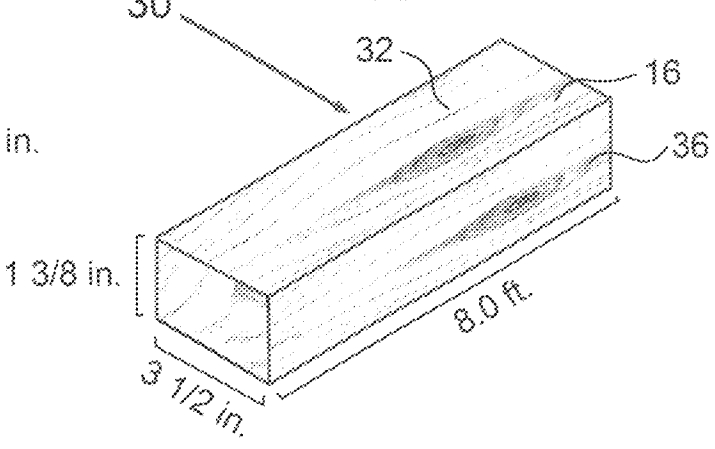
FIG. 4B
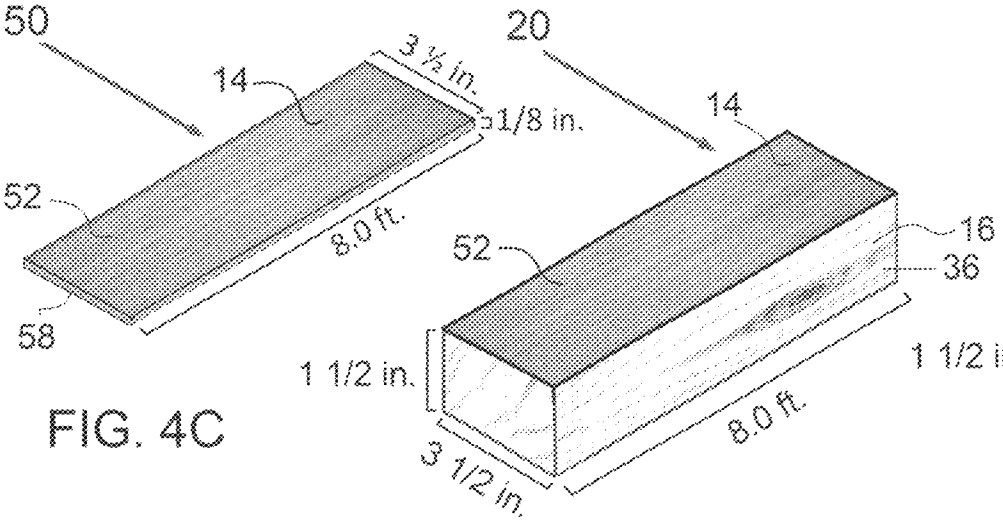
FIG. 4C
FIG. 4D
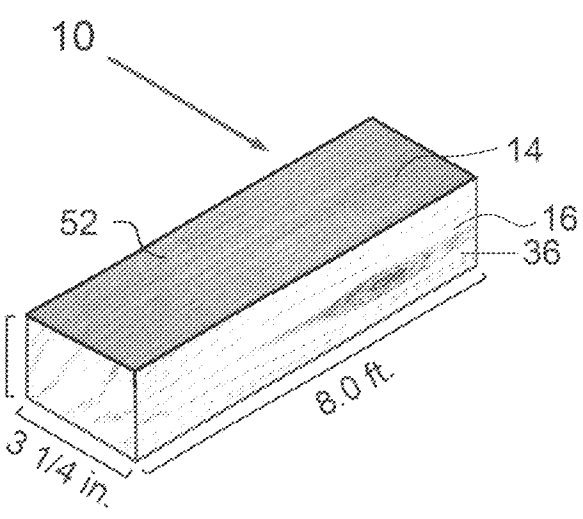
FIG. 4E

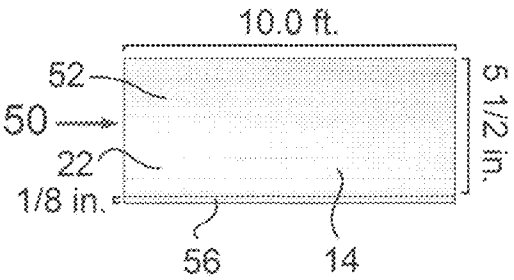
FIG. 6C
FIG. 6B
FIG. 6A
FIG. 6F
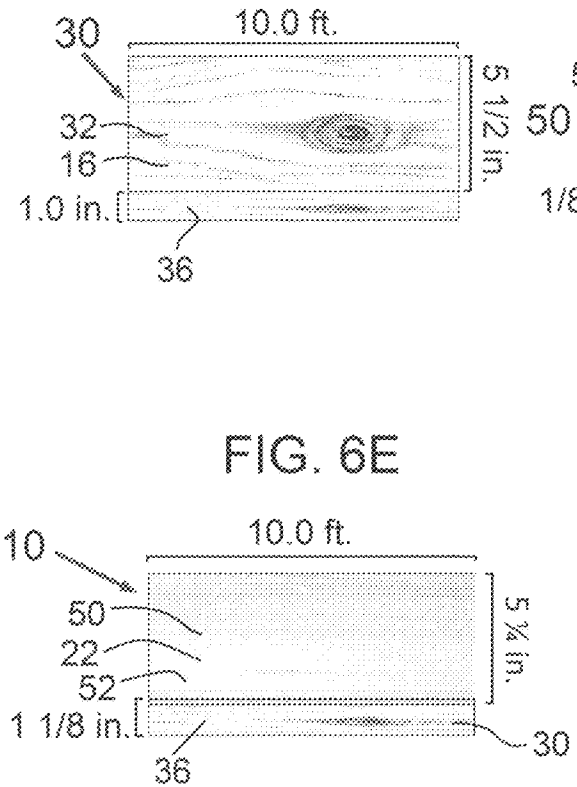
FIG. 6E
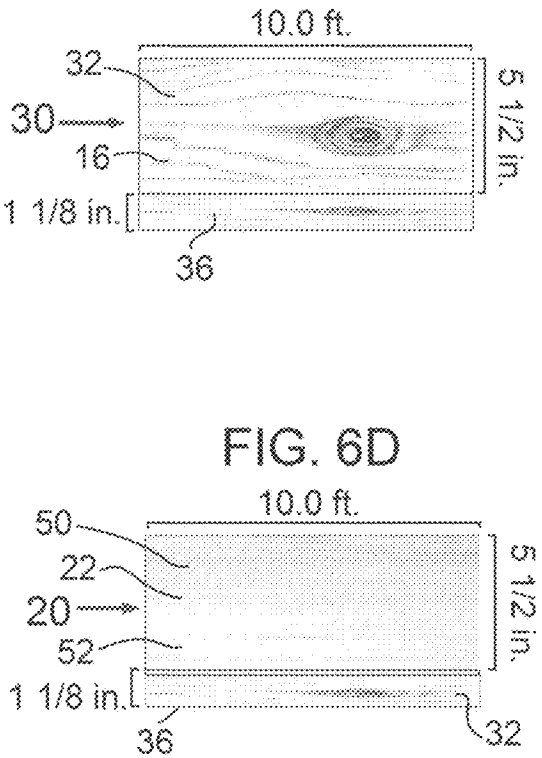
FIG. 6D 30
8.0 ft.
5 1/2 in.
39
3/4 in.
16
32
36
38

30²
8.0 ft.
5 1/2 in.
39²
3/4 in.
16²
34²
36²
38²

40
8.0 ft.
5 1/2 in.
1 1/2 in.
32
36
36²

40
8.0 ft.
5 1/2 in.
32
1 3/8 in.
36²
36
50
8.0 ft.
5 1/2 in.
59
1 1/8 in.
14
56
52
58
56

10
14
56
58
40
8.0 ft.
5 1/4 in.
59
52
1 1/2 in.

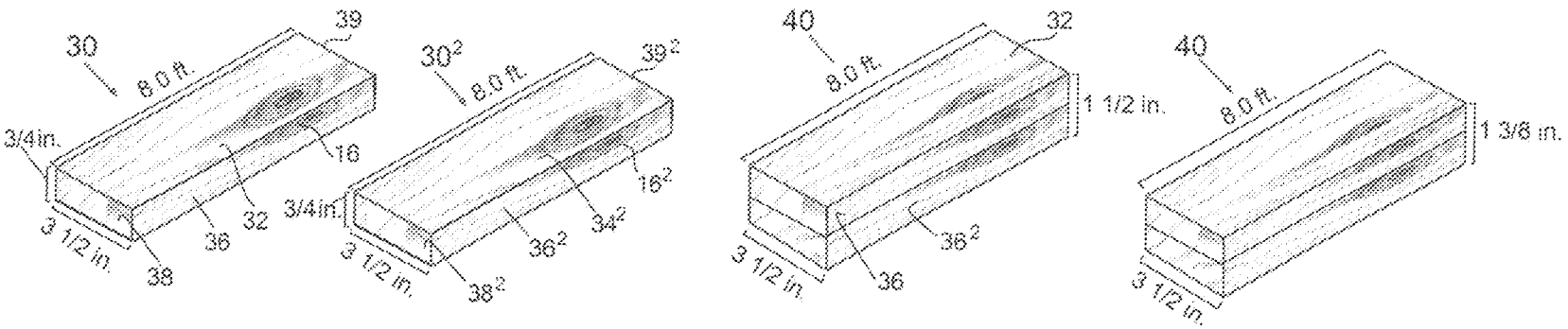
FIG. 11A
FIG. 11B
FIG. 11C
FIG. 11D
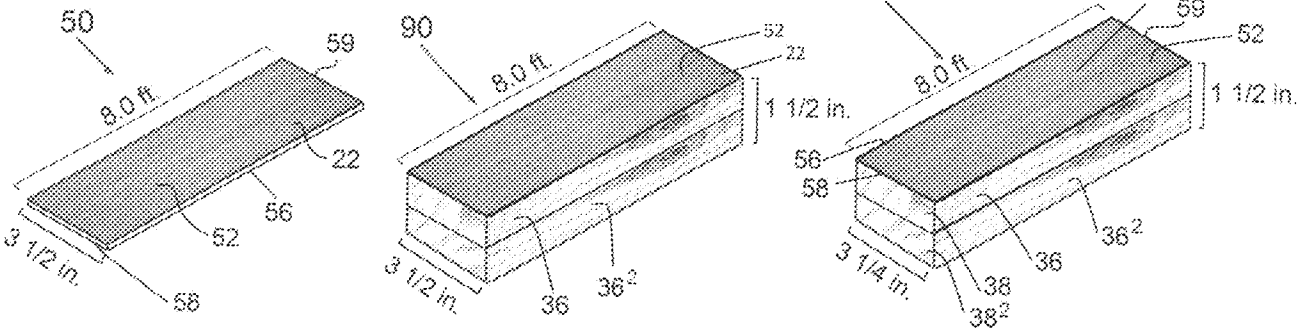
FIG. 11E
FIG. 11F
FIG. 11G 5 1/2 in.
1/8 in.
8'-20 ft.
1 1/2 in.
1 1/4 in.
5 1/4 in.
10
30
32
36
38
39
42
50
52
56
58
59
80
96

50
30
10
42
52
50²
54
54²
32
36
80
82
56
58
59
34
39
38
96
1 1/2in.
1 1/4 in.
5 1/2 in.
5 1/4 in.
1/8 in.
9 - 20 ft.

80
30
38
1 1/2 in.
36
32
5 1/2 in.
39
8 - 20 ft.

59
8 - 20 ft.
54
56
5 1/2 in.
52
84
50
58
1/8 in.
52
30
38
1 3/8 in.
34
39
8 - 20 ft.

52
84
50
86
1 1/2 in.
30
5 1/2 in.
80
8 - 20 ft.

52
84
50
10
1 1/2 in.
30
5 1/4 in.
80
8 - 20 ft.

1 1/2 in.
5 3/4 in.
8 - 20 ft.
5 3/4 in.
1 1/2 in.
5 1/2 in.
1/8 in.
5 1/4 in.
3/4 in.
62
64
78
65
16
71
72
74
66
60
76
70
50
52
18
58
59
10

OUTDOOR WOOD DECKING BOARD

CROSS-REFERENCE TO RELATED APPLICATION

In accordance with 37 C.F.R. 1.76, a claim of priority is included in an Application Data Sheet filed concurrently herewith. Accordingly, under 35 U.S.C. § 119 (e), 120, 121, and/or 365(c) the present disclosure claims priority, as a continuation-in-part of U.S. patent application Ser. No. 15/426,036, title: OUTDOOR WOOD DECKING BOARD, filed: Feb. 6, 2017. The contents of which the above referenced application are incorporated herein by reference in its entirety.

FIELD OF THE DISCLOSURE

The present disclosure relates to an outdoor wood decking board for use in the outdoor deck floor construction industry. More specifically, the present disclosure relates to an outdoor wood decking board for use in construction of an outdoor deck floor, the outdoor wood decking board constructed in a layered arrangement with a wood core including a facing wood veneer manufactured with a high-grade wood species or referred to as a superior grade wood species, layered upon the wood core, the facing wood veneer visible to a user. The outdoor wood decking board can include a dual veneered wood core. More specifically, the disclosure relates to the facing wood veneer permanently directly seamlessly attached to a wood core or an engineered wood core by using a two-part emulsion polymer isocyanate ("two-part EPI") adhesive such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive to form the outdoor wood decking board. More specifically, the disclosure relates to the facing wood veneer permanently directly seamlessly attached to a wood core or an engineered wood core by using a two-part polyurethane emulsion polymer ("two-part PEP") adhesive.

BACKGROUND

Embodiments described herein relate generally to outdoor wood decking boards for use in the construction of an outdoor deck floor, the outdoor wood decking board constructed in a layered arrangement with a wood core having a facing wood veneer layered upon a first wood face of the wood core, the facing wood veneer manufactured with a superior grade wood species or select grade wood species visible to a user so that the wood core having an appearance of the facing wood veneer, thereby, the outdoor wood decking board is aesthetically pleasing to the viewer, user, homeowner, consumer. In another embodiment, an outdoor wood decking boards includes a second facing wood veneer of high grade wood species is layered upon a second face of the wood core, the second high-grade wood veneer visible to the viewer, user, homeowner, consumer from underneath the outdoor deck floor so that the wood core having an appearance of the second facing wood veneer forms a ceiling to an area beneath the outdoor wood decking boards of the newly formed outdoor deck floor.

In another embodiment, the facing wood veneer characterized as being free of cracks, holes, cavities or knots is formed from an exotic hardwood species.

In another embodiment, the wood core is formed from an engineered wood product, namely, wood plastic composite. In yet another embodiment, a core is formed from a concrete board.

In the construction of outdoor deck floors, it is often desirable to utilize a plurality of outdoor wood decking boards made from a superior grade wood species of a single solid board of wood, such as a clear grade vertical grain western red cedar. The outdoor deck floor made from single solid board of wood of a plurality of outdoor wood decking boards made from the superior grade wood species can exhaust the natural resources of the wood species in a particular geographical area and can be very expensive. It is not uncommon for construction wood materials to increase exponentially in cost for every increase in use of high grade woods, increase in length or width of the construction wood materials for use in the construction of the outdoor deck floor.

Another disadvantage of using a single solid board of is that if the consumer wants a natural or stained finish differences in the surface appearance or quality of the outdoor wood decking boards often occur. Because large quantities of outdoor wood decking boards are required to construct the outdoor deck floor, outdoor wood decking boards produced from many trees are often used. This results in variations in the grain and surface appearance of the boards. Purchasers, homeowners, consumers, likely, insist on uniformity in surface appearance, and producers are forced to spend significant amounts of time and energy selecting wood to produce the large volume of similarly grained and knotted wood boards. These factors combine to raise the prices for purchasers still further and complicate the task of manufacturers and producers.

An alternative approach has been developed in the disclosed embodiments where the outdoor wood decking board includes a wood core manufactured with a common grade wood species, or referred to a common grade or all general purpose grade wood species; the wood core is layered and bonded onto a first wood face of the wood core with a facing wood veneer formed from a superior grade wood species or a select grade wood species. In another embodiment, a second facing wood veneer formed from a high-grade wood species is layered upon an opposing second wood face of the wood core, the second facing wood veneer visible to a user from underneath the outdoor deck floor thereby forming a ceiling to the area beneath the outdoor deck floor.

The use of the veneer layers manufactured with superior grade wood species is a novel embodiment of outdoor wood decking boards with the purpose of preserving superior grade wood species and preventing excessive consumption of high grade woods in the manufacture of outdoor wood decking boards. In addition, the use of facing wood veneer layers with high grade or superior grade or select grade wood species provides an aesthetic look to the outdoor deck floor adding value to the outdoor deck floor and to the home attached thereof, whereas the outdoor wood decking boards are cost efficient because the core is manufactured from a less expensive wood species.

Superior grade outdoor deck floors typically require manufacturing each outdoor wood decking board for use in the construction of outdoor decks using an enormity of natural wood resources of high grade wood species so that each outdoor wood decking board is completely manufactured with a piece of superior grade wood species. A known problem to this approach is that the natural resources including a variety of high grade wood species are exposed to exhaustion of the wood species particular to a certain geographical region. In addition, this method is not cost prohibitive.

An additional problem of the conventional manufactured outdoor wood decking boards for use in the construction of outdoor deck floors is that the formed outdoor wood decking boards when manufactured with low grade outdoor wood decking boards are susceptible to the wood splintering or splitting or knots falling out causing the wood to widen over time and wear. Therefore, the implementation of the facing wood veneer seamlessly attached via the pressure sensitive liquid adhesive, or a two-part emulsion-polymer-isocyanate adhesive, or a two-part polyurethane emulsion polymer adhesive, prevents the problem of splintering and knots falling out and significant additional degradation of the outdoor wood decking boards. Therefore, the common grade outdoor wood decking boards must be treated with agents to prevent the splinters. The use of superior grade woods for the manufacture of the facing wood veneers eliminates the need to treat the low grade or common grade or all purpose grade wood cores with anti-splintering agents.

An advantage of the present invention is that the use of the facing wood veneer can increase the likelihood that a plurality of outdoor wood decking boards can be manufactured with a uniform grain and aesthetic appearance with a non-cactile surface characterized as being free of cracks, holes, cavities or knots, because a single tree of a first wood species, or a second wood species, or an exotic wood species, can be used to produce numerous amounts of uniform facing wood veneers than solid wood decking boards.

Thus, there is a need for an effective way to manufacture superior grade outdoor wood decking boards for use in the construction of outdoor deck floors without substantially threatening the natural resources of high grade wood species in a particular geographic area. In addition, there is a need for a way to effectively deal with high costs of manufacturing the high-grade wood cores necessary in the construction of the outdoor wood decking boards for use in construction of outdoor deck floors by minimizing the amount of high grade wood species expended in the process. Also, there is a need for an effective way to reduce splintering of low grade wood cores by increasing outdoor deck floor smoothness and aesthetics, while still maintaining low costs and durability of the outdoor wood decking boards for outdoor use in the construction of the outdoor deck floors.

Further still, there is a need for an improved method for adhering and laminating outdoor wood decking boards. More specifically, the invention relates to forming outdoor wood decking boards using a two-part emulsion-polymer-isocyanate adhesive; and a method thereof. In addition, the invention relates to forming outdoor wood decking boards using a two-part polyurethane emulsion polymer adhesive; and method thereof.

SUMMARY

Therefore, Applicant has developed an outdoor wood decking board for use in construction of an outdoor deck floor, embodiments of the outdoor wood decking board of which are disclosed herein. The outdoor wood decking board is adapted for use as an outdoor wood decking board including a wood core having a facing wood veneer permanently directly attached thereon a first wood face of the wood core forming a three-dimensional solid rigid body such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive including a thickness (T), a width (W), and a length (L). The wood core is manufactured from a first wood species, the first wood species preselected from any one of a common grade or general purpose grade of North American Softwood species; and the facing wood veneer is manufactured from a second wood species, the second wood species preselected from any one of a superior grade which is non-cactile, thereby smooth surface, characterized as being free of cracks, holes, cavities or knots of North American Softwood species including a clear vertical grain western red cedar species, and clear grain of the North American Softwood species. In another embodiment, the facing wood veneer characterized as being free of cracks, holes, cavities or knots is formed from an exotic hardwood species.

A pressure sensitive liquid adhesive seamlessly permanently directly attaches the facing wood veneer against the wood core thereby a plurality of outdoor wood decking boards adapted to be arranged along interior longitudinal side edges of each other form an assemble simulated non-cactile superior grade outdoor deck floor, including a clear vertical grain western red cedar outdoor deck floor characterized as being free of cracks, holes, cavities or knots of preconfigured dimensions.

In an embodiment of the subject matter, an improved method for adhering outdoor wood decking boards is disclosed. More specifically, the invention relates to adhering and laminating in the formation of the wood decking boards by means of a two-part emulsion-polymer-isocyanate adhesive ("EPI"). It is known to use EPI adhesives for several applications. EPI adhesives have been used for decades for gluing wood, especially, in Japan. In addition, to having short hardening time, EPI adhesives are free of formaldehyde. The implementation of the EPI adhesive provides a successful process for laminating the wood cores, cores, wood composites, cement boards, against the facing wood veneer.

Some of the two-part EPI adhesives, generally, are two-part adhesives based on reaction of a mixture of water based emulsions of carboxylated styrene-butadiene copolymer latex ("SBR"), ethylene vinyl acetate copolymer ("EVA") and polyvinyl acetate (PVAc) typed with an isocyanate hardener (crosslinker) forming water resistant bonds. EPI adhesives can be formulated in many ways to give the optimal performance with respect to water resistance, curing speed, type of substrate, strength and viscosity in each laminating or bonding adhesive operation.

Regarding the adhesion of a reinforcement to wood, the International Code Council (ICC) has issued performance requirements in the nature of glue bonding specifications. The ICC is a nonprofit organization dedicated to developing a single set of comprehensive and coordinated national model construction codes used to construct residential and commercial buildings, including residences and schools. Most U.S. cities, counties, and states that adopt codes choose the International Codes developed by the ICC. The ICC has issued AC280, which provides a computer program model to predict beam values for laminated timber. AC280, also, specifies performance requirements including adhesive bonding specifications for bonding or laminating of substrates to wood.

With regard to adhesive qualification, AC280, also, identifies additional standards which have been set by such agencies as American Society for Testing and Materials International (ASTM) and American National Standards Institute (ANSI). Specifically, an adhesive used to bond a laminate to a wood surface must conform to ASTM D 2559 (Standard Specification for Adhesives for Structural Laminated Wood Products for Use Under Exterior (Wet Use) Exposure Conditions) and ANSI A190 (for wood products—Structural Glued Laminated Timber).

Adhesives have been developed and used successfully for the bonding of wood together to Meet ICC AC280, ASTM D-2559, and ANSI A190.1 requirements. EPI adhesives have been developed and used for the bonding of wood to wood and have been recommended to use in bonding laminates to wood, fiber reinforced polymer composites, painted polymer composites, and painted metal. The use of EPI adhesive for use in wood to wood applications has, also, been documented in NER-165 ICC Evaluation Services Inc. Legacy Report of Feb. 1, 2002. The ICC NER-165 from Ashland Specialty Chemical Company provides for their EPI adhesives have been tested for compliance with ASTM D 2559-84 and are intended to be used as structural adhesives for laminated softwood products and fabrication of plywood components, such as stress skin panels, sandwich panels, curved panels, glulam beams, post, I-joists, and LVL.

In addition, ISOSET EPI adhesive systems have been tested on substrates for use in bonding sandwich panel components. The adhesive formulations are suitable for bonding gypsum wallboard, hardboard, particle board, waferboard, OSB, and plywood to core materials of styrene and urethane foam, paper and aluminum honeycomb. The adhesive formulations are, also, suitable for bonding facings of painted metal and fiberglass reinforced plastic to waferboard, OSB, or plywood.

The adhesives are intended for structural use where high resistance to moisture is required in roof, wall and floor components subjected to sustained loadings such as live or snow loads.

The water based adhesive uses the two-part EPI technology forming bonds with excellent creep, shear and tensile properties. Substrates bonded with two-part EPI adhesives are extremely durable and offer outstanding resistance to moisture and humidity. The two part EPI adhesives have been used for engineered wood (I-joist), glulam, structural laminated wood, LVL, vertical studs, etc.) millwork, hardwood flooring, structural foam core panels, load bearing constructions, finger joints, and structurally insulated panels. The curing characteristics of EPI adhesives are complex and include film formation of the emulsion adhesive as well as chemical reaction of the highly reactive isocyanate towards water, hydroxyl-, amines- and carboxy-groups. The advantages obtained by the use of EPI adhesives are fast setting speed, cold curing, light colored glue lines, low creep of the glue line, and high moisture resistance.

ISOSET™ two-part EPI from Ashland, Inc., Columbus, Ohio, is a commercially available two-part EPI adhesive that is implemented in the disclosure of the subject matter.

The two-part EPI adhesives, in general, can include a water based polymer cured with an isocyanate. This combination gives glue line performance with the benefits for both thermoplastic and thermosetting adhesive systems such as high flexibility of the glue line, cold setting and excellent cold and boiling water resistance. The two-part emulsion polymer-isocyanage adhesive systems are fast setting and cold curing and they give light colored glue lines. The curing process is a combination of a physical process, film formation, and the chemical reactions of isocyanate.

In addition, Franklin International, Columbus, Ohio, USA provides a two-part emulsion polymer isocyanate system (EPI), namely, ADVANTAGE EP-930 http://www.franklinadhesivesandpolymers.com/Woof-Adhesives-US/Wood-Adhesives/Product-Family/Advantage-family/Advantage_EP_940.aspx The ADVANTAGE EP-930 is a two-part emulsion polymer isocyanate system (EPI) developed for improved radio frequency performance. It is mixed with HARDENER 400, a polymeric isocyanate at 10-15 parts Hardener 400 to 100 parts emulsion ADVANTAGE EP-930 DEV. It is from the chemical family description polyvinyl acetate emulsion adhesive, has a specific gravity of 1.36, and pH of 7.0-8.5. The suggested minimum use temperature is 46° F./7° C. The adhesive is characterized by good spreader stability and low foam production, and good adhesion to laminated veneer lumber and other treated wood when compared with traditional EPI adhesives. ADVANTAGE EP-930 DEV with Hardener 400 surpasses the ASTM D-5751-99 wet use for laminate joints in non-structural lumber products and the DIN D4 standard.

The ADVANTAGE EP-930 is from the chemical family polyvinyl acetate emulsion adhesive The ADVANTAGE-930 is an emulsion polymer isocyanate system EPI developed for improved radio frequency performance. It is mixed with HARDENER 400, a polymeric isocyanate at 10-15 parts HARDENER 400-100 parts emulsion ADVANTAGE EP-930 DEV. The adhesive is characterized by good spreader stability and low foam production when compared with traditional EPI adhesives. ADVANTAGE EP-930 DEV with HARDENER 400 surpasses the ASTM D-575-99 wet use for laminate joints in non-structural lumber products and the DIN D4 standard. ADVANTAGE EP-930 resin is mixed with HARDENER 400 at a ratio of 100 parts resin to 15 parts Hardener by weight.

The pot life of the two-part emulsion polymer-isocyanate adhesive (ADVANTAGE EP-930) is in excess of one hour at 77° F./25° C. However the viscosity of the mix will increase as it ages. Wood glued with older material will have less water resistance, a characteristic common to most EPI adhesives. Therefore, it is recommended that fresh adhesive be mixed only when it is to be immediately used. The two-part emulsion-isocyanate (Advantage EP-930) resin is mixed with Hardener 400 at a ratio of 100 parts resin to 15 parts Hardener by weight or 6.45 parts resin to one part Hardener by volume. Avoid mixing for long periods of time or with excessive agitation as pot life is affected by mixing time and speed. While this product can be easily mixed by hand, it is usually more convenient to mix the components in a meter mix unit. Appropriate mixing ratios will depend upon the wood core and the facing wood veneer used to form the outdoor wood decking board.

The moisture content of the two-part emulsion polymer-isocyanate (ADVANTAGE EP-930) is six to ten percent is the recommended moisture content for the gluing stock. Higher moisture content will increase the clamp time needed. Additionally, moisture content should mirror (as closely as possible) that which will be experienced in the end use market for the wood product being manufactured. The preparation of the wood cores, cores, facing wood veneers to be glued is extremely important. Variation in thickness should not exceed ±0.005 inches/0.12 mm. Sizing of the wood core, core, facing wood veneered wood core, facing wood veneered core, or outdoor wood decking board to thickness should be performed using higher than 50 grit abrasives.

The spread rate and recommended adhesive coating layer is the same as for most poly vinyl acetate products or approximately 0.007 inches/0.178 mm in thickness. The two-part emulsion polymer-isocyanate adhesives have superior gap filling properties due to their higher percent solids content. Generally, 200 g/m$^2$/41#/MSGL of glue line is adequate. Conveyorized spreaders are commonly used. One side application is adequate in most situations.

Heat and pressure are dependent upon the wood species or wood core, facing wood veneer, or core to be glued. Direct contact of the gluing surfaces must be made to obtain maximum strength. A minimum press time of 30 minutes is recommended under ideal conditions when using soft wood species at moisture content less than eight to ten percent and factory temperatures of 68 degrees Fahrenheit/20 degrees Celsius. Longer press times will be required for higher density species, higher moisture contents and colder factory temperatures. It is recommended that optimum press times be determined in actual plant conditions recognizing that seasonal changes may lead to variable requirements. Hot Press time is dependent on the adhesive used, gluing stock type, moisture content of the stock and environmental conditions.

The Franklin Adhesives, ADVANTAGE EP-950A is a two-part acrylic emulsion polymer-isocyanate system having an acrylic-base emulsion polymer isocyanate system (EPI) developed with exceptional water and heat resistance. The specific gravity is 1.28 and the suggested minimum use temperature is 46° F./7° C., and has a pH of 6.5-8.2. The two part emulsion polymer-isocyanate is used for water, heat and solvent resistance adhesives with wood products. It works well in hot and cold press applications.

It exceeds the requirements of ASTM D25559-12a, ASTM D7247-07ae1, ANSI 405-2013 and CSA 0112.10, which are required adhesive tests for many structural applications. This adhesive can be utilized in cold and hot press equipment. The emulsion must be mixed with HARDENER 200, A POLYMERIC ISOCYANANTE, AT 13-15 PARTS HARDENER 200 to 100 parts emulsion.

ADVANTAGE EP-950A resin is mixed with HARDENER 200 at a ratio of 100 parts resin to 15 parts Hardener by weight or 6.45 parts resin to one part HARDENER by volume. Avoid mixing for long periods of time or with excessive agitation as pot life is affected by mixing time and speed.

ADVANTAGE EP-950A exceeds ASTM D2559-12a Standard Specification for Adhesives for Bonded Structural Wood Products for Use Under Exterior Exposure Conditions. This standard covers adhesives suitable for the bonding of wood into structural laminated wood products for general construction and other uses where a high-strength, durable adhesive bond is required. The strength and durability requirements are based on the performance of the adhesive in laminated wood as measured by the following test methods: resistance to shear by compression loading; resistance to delamination during accelerated exposure to wetting and drying; and resistance to deformation under static load.

ADVANTAGE EP-950A Exceeds ASTM D7247-07ae1 Standard Test Method for Evaluating the Shear Strength of Adhesive Bonds in Laminated Wood Products at Elevated Temperatures: This standard is used for evaluation of the shear strength of an adhesive at ambient and elevated temperature relative to the performance of solid wood at the same conditions.

The two-part EPI adhesives are best used according to the manufacturer's directions and recommendations as provided by Franklin Adhesives and Polymers at http://www.franklinadhesivesandpolymers.com/Wood-Adhesives-US/Wood-Adhesive/Product-Family/Advantage-family/advantage-ep-950a.aspx, and described in brief, as follows.

ADVANTAGE EP-950A Exceeds ANSI 405-2013 Standard for Adhesives for Use in Structural Glued Laminated Timber: This standard provides the minimum requirements for evaluation of adhesives to be used in structural glued laminated timber products. Adhesives must meet the requirements of ASTM D2559, ASTM D7247, as well creep resistance, accelerated aging of bonded specimens compared to solid wood controls, and durability testing using boil-dry-freeze conditioning.

Six to ten percent is the recommended moisture content for the gluing stock. Higher moisture content will increase the clamp time needed. Additionally, moisture content should mirror (as closely as possible) that which will be experienced in the end use market for the wood product being manufactured.

The preparation of the stock to be glued is extremely important. Joints cut from rip saws should be free of saw marks. They should also be straight and square. Moulded or jointed stock should be free of knife marks. Glazed or burnished joints will prevent adhesive penetration and should be avoided. When possible, glue joints should be prepared and glued the same day. Gluing stock should be uniform in thickness. Variation in thickness should not exceed ±0.005 inches/0.12 mm. Sanding to thickness should be performed using higher than 50 grit abrasives.

With regard to spread rate the recommended adhesive coating layer is the same as for most PVA products or approximately 0.007 inches/0.178 mm in thickness. EPI adhesives have superior gap filling properties due to their higher percent solids content. Generally, 200 g/m$^2$/41#/MSGL of glue line is adequate.

Conveyorized spreaders are commonly used in edge-gluing applications. Adjust the applicator to ensure complete coverage on the staves. One side application is adequate in most situations. Verify that adequate coverage exists by monitoring squeeze-out along the glue lines when the panels are under pressure. The assembly time of ADVANTAGE EP-950A varies with moisture content and spread rate. Higher spread rate can increase the assembly time of the product. When substrates are brought under pressure, a small bead of squeeze-out should be seen on the first samples assembled. Structural testing was completed with the following parameters:

With regards to clamping times, pressure is dependent upon the species or material to be glued and joint preparation. Direct contact of the gluing surfaces must be made to obtain maximum strength. Suggested clamp locations for various wood densities are eight to fifteen inches (20-38 cm) apart and two inches (5 cm) from the end of the panel to evenly distribute pressure along the entire length of the glue line. A minimum press time of 30 minutes is recommended under ideal conditions when using soft wood species at moisture content less than eight to ten percent and factory temperatures of 68 degrees Fahrenheit/20 degrees Celsius. Longer press times will be required for higher density species, higher moisture contents and colder factory temperatures. It is recommended that optimum press times be determined in actual plant conditions recognizing that seasonal changes may lead to variable requirements.

It is an object of the present disclosure to provide an outdoor wood decking board that is formed using the two-part EPI adhesive. It is another object of the present disclosure to provide a method for forming an outdoor wood decking board using the two-part EPI adhesive.

Another two-part EPI is the Franklin ADHESIVE EP-925. http://www.franklinadhesivesandpoymers.com/Wood-Adhesives-US/Wood-Adhesives/Product-Family/Advantage-family/Advantage-EP-925.aspx ADVANTAGE EP-925 is a two-component, in the chemical family polyvinyl acetate emulsion adhesive. The specific gravity is 1.28; suggested minimum use temperature is 46° F./8° C.; the pH of 6.5-8.0. The ADVANTAGE EP-925 is a low foaming emulsion polymer isocyanate (EPI) adhesive recommended for applications requiring exceptional water, heat and solvent resistance. The product can be utilized with conventional cold press or hot press equipment and has been enhanced to provide superior performance with radio frequency press equipment. ADVANTAGE EP-925 allows for reduction in conditioning time before surfacing which improves productivity. It is also characterized by good spreader stability when compared with traditional EPI adhesives.

ADVANTAGE EP-925 resin is mixed with HARDENER 200 at a ratio of 100 parts resin to 15 parts Hardener by weight or 6.45 parts resin to 1 part Hardener by volume. The Hardener is from the chemical family description Polymeric Methylene diphenyl diisocyanate (MDI) having a specific gravity of 1.23. Avoid mixing for long periods of time or with excessive agitation as pot life is affected by mixing time and speed. While this product can be easily mixed by hand, but is more convenient to mx in a meter mix unit.

The performance properties of the two-part emulsion polymer-isocyanate adhesive is formulated to provide higher mediate bond strengths than conventional wood bonding adhesives. The recommended two-part emulsion polymer-isocyanate adhesive coating layer is approximately 0.007 inches/0.178 mm in thickness.

In another embodiment of the subject matter, an improved method for adhering outdoor wood decking boards is disclosed. More specifically, the invention relates to adhering of outdoor wood decking boards by means of a two-part polyurethane emulsion polymer adhesive. In general, the two-part polyurethane adhesive comprises a prepolymer, the A side, and a curative, the B side. ISOSET™ two-part polyurethane emulsion polymer ("PEP") is commercially available through Ashland, Inc., Columbus, Ohio.

ISOSET™ UX-100/WD3-A322 adhesive, as documented in the in ER-5440 ICC Evaluation Services Inc. Legacy Report of May 1, 2002, is a two-part adhesive based on a 100-percent-solids polyurethane that is combined with an emulsion polymer. The adhesive application is limited to bonding structural wood components of softwood species. The adhesive is suitable for use in roof, wall and floor components with high resistance to moisture and subject to sustained loading. The ISOSET™ PEP adhesive system is a two-part adhesive based on 100 percent reactive PEP adhesive blended with conventional isoset emulsion. The PEP adhesive provides strength and faster cure times, while providing excellent bonding strength. Two-part PEP adhesives have been used on structural finger joints and wood I-joist, as well as web-to-web applications.

Descriptive literature and reports of test demonstrate compliance with the ASTM D 2559 and the Western Wood Products Association (WWPA) 101.97 Glued Products-Procedures for Mill Certification and Quality Control.

Two-part polyurea-urethane adhesives are disclosed in the U.S. Pat. No. 8,871,891 ("the '891' Patent"), assignee, Ashland Licensing and Intellectual Property, LLC, Dublin, Ohio.

In the '891' Patent a two-part polyurea adhesive is disclosed comprising a two-part polyurea-urethane adhesive composition comprising a Part A prepolymer component having an isocyanate content and having an oligomer content, and a polyol; a Part A curative component comprising a polyol; at least one sterically hindered aromatic diamine; and at least one catalyst.

The subject matter of the disclosure embodies the two-part emulsion polymer-isocyanate adhesive system including the water based two-part emulsion polymer-isocyanate adhesives and acrylic based two-part emulsion polymer-isocyanate adhesive systems. The adhesives for purposes of the disclosure herein will be collectively referred to as the two-part emulsion polymer-isocyanate adhesive, or interchanged with two-part EPI adhesive.

In one exemplary embodiment, the outdoor wood decking boards are embodied with a first facing wood veneer seamlessly permanently attached upon a first wood face of the wood core by means of the two-part EPI adhesive. In another exemplary embodiment, the outdoor wood decking boards are embodied with a first facing wood veneer seamlessly permanently attached upon a first wood face of the wood core by means of the two-part PEP adhesive.

In another exemplary embodiment, the outdoor wood decking boards are embodied with a first facing wood veneer and a second facing wood veneer seamlessly permanently directly attached to the wood core forming an upper facing wood veneered wood core and a lower facing wood veneered wood core by means of the two-part EPI adhesive, or in the alternative, the two-part PEP adhesive. In this embodiment, a first facing wood veneer is seamlessly permanently directly attached on a first wood face of the wood core to form the upper facing wood veneered wood core; and the second facing wood veneer is seamlessly permanently attached to a second face of the wood core to form the lower facing wood veneered wood core.

In another exemplary embodiment, the outdoor wood decking boards are embodied including two wood cores aligned longitudinally to each other and seamlessly permanently directly attached to each other by means of the two-part EPI adhesive, or in the alternative, the two-part PEP adhesive, to form a face-to-face wood core. A facing wood veneer formed from a high quality wood species of superior grade which is non-cactile characterized as being free of cracks, holes, cavities or knots is seamlessly permanently directly attached to the wood core such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive.

In another exemplary embodiment, the outdoor wood decking boards are embodied including a composite wood core assembly, the composite wood core assembly including a series of wood cores joined together along a longitudinal axis thereof to form a simulated single unit solid rigid wood core, wherein the simulated single unit solid rigid wood core is embodied with a high quality facing wood veneer seamlessly permanently directly attached by means of the two-part EPI adhesive, or in the alternative, the two-part PEP adhesive, to the simulated single unit solid rigid wood core such that the first finishing face of the facing wood veneer of the facing wood veneered composite wood core is visible to a user wherein the first finishing face of the facing wood veneer is visibly free of adhesive such that the first finishing face of the facing wood veneer of the facing wood veneered composite wood core is visibly unchanged or visibly unaltered by the adhesive.

Although the bonding of soft wood products to laminates has been done successfully, the bonding of softwoods to facing wood veneers, and exotic hardwoods to facing wood veneers for the manufacture of outdoor wood decking boards, and the bonding of exotic hardwoods to facing wood veneers, has not been shown. Accordingly, there is a need for an adhesive and method for use in adhesive in manufacturing outdoor wood decking boards comprising one or more facing wood veneer(s) to form a strong bond between the facing wood veneer and the outdoor wood decking board for use in the construction of an outdoor deck floor.

It is an object of the present disclosure to provide an outdoor wood decking board manufactured using a two-part emulsion polymer-isocyanate adhesive which forms a permanent seamless attachment between a facing wood veneer and a wood core.

It is an object of the present disclosure to provide an outdoor wood decking board manufactured using an adhesive which forms a permanent seamless attachment between two wood cores, and between a first wood core and a facing wood veneer.

It is an object of the present disclosure to provide an outdoor wood decking board manufactured using a two-part emulsion-isocyanate adhesive which forms a permanent seamless attachment between a first wood core and a second wood core; and forms a permanent seamless attachment between a first wood core and a first facing wood veneer; and forms a permanent seamless attachment between a second wood core and a second facing wood veneer.

It is still another objective of the present disclosure to provide a two-part emulsion-polymer-isocyanate adhesive to form an outdoor wood decking board having a wood core and a facing wood veneer.

It is another objective of the present disclosure to provide a two-part emulsion-polymer-isocyanate adhesive to provide a moisture resistant bond a first wood core and a second wood core; and between a first facing wood core and a first facing veneer; and between a second facing wood core and a second facing wood veneer.

A further object of the present disclosure is to provide a two-part polyurethane emulsion polymer ("two-part PEP") which forms a moisture resistant bond having improved strength between wood cores and between wood cores and facing wood veneers.

Other objects will become apparent from the description to follow and from the appended claims.

BRIEF DESCRIPTION

FIG. 4A is a top perspective view of a wood core of an outdoor wood decking board, according to an embodiment of the disclosure.

FIG. 4B is a top perspective view of the wood core of FIG. 4A illustrating sizing of the wood core of FIG. 4A, according to an embodiment of the disclosure.

FIG. 4C is a top perspective view of a facing wood veneer of the outdoor wood decking board, according to an embodiment of the disclosure.

FIG. 4D is a top perspective view of a facing wood veneered wood core, according to an embodiment of the disclosure, FIG. 4E is a top perspective view of the outdoor wood decking board, according to an embodiment of the disclosure.

FIG. 6A is a top perspective view of a wood core of an outdoor wood decking board, according to an embodiment of the disclosure.

FIG. 6B is a top perspective view of the wood core of FIG. 6A illustrating sizing of the wood core of FIG. 6A, according to an embodiment of the disclosure.

FIG. 6C is a top perspective view of a facing wood veneer of the wood decking board, according to an embodiment of the disclosure.

FIG. 6D is a top perspective view of a facing wood veneered wood core, according to an embodiment of the disclosure, FIG. 6E is a top perspective view of the outdoor wood decking board, according to an embodiment of the disclosure.

FIG. 6F is a side planar view of the outdoor wood decking board of FIG. 6E, according to an embodiment of the disclosure.

FIG. 11A is a top perspective view of a first wood core of an outdoor wood decking board, according to an embodiment of the disclosure.

FIG. 11B is a top perspective view of a second wood core of an outdoor wood decking board, according to an embodiment of the disclosure, FIG. 11C is a top perspective view of a face-to-face wood core of the outdoor wood decking board, according to an embodiment of the disclosure.

FIG. 11D is a top perspective view of the face-to-face wood core of FIG. 11C as sized, according to an embodiment of the disclosure.

FIG. 11E is a top perspective view of a facing wood veneer of the outdoor wood decking board, according to an embodiment of the disclosure.

FIG. 11F is a top perspective view of a facing wood veneered face-to-face wood core, according to an embodiment of the disclosure.

FIG. 11G is a top perspective view of the outdoor wood decking board, according to an embodiment of the disclosure.

DETAILED DESCRIPTION

Figure 1:
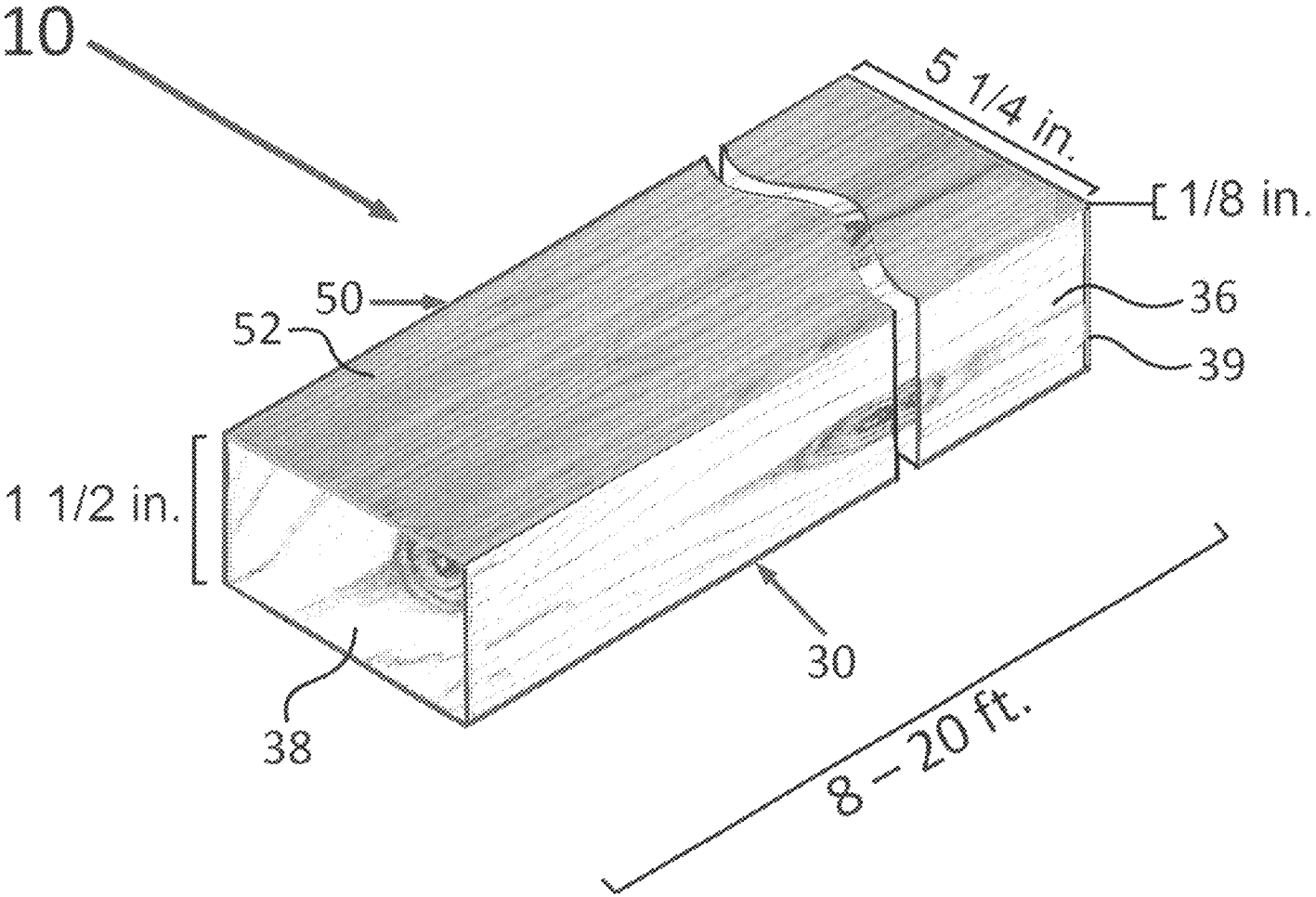
FIG. 1 is a perspective view of an outdoor wood decking board, according to an embodiment of the present disclosure.

An outdoor wood decking board for use in construction of an outdoor deck floor are disclosed herein, with reference to FIGS. 1-17. The outdoor wood decking board 10 can be used to provide an aesthetically pleasing outdoor deck floor 100 to simulate an outdoor deck floor 100 constructed from wood decking boards 10 of superior quality grade wood species at a low cost and, more particularly, at an increased conservation of the superior grade wood species. The outdoor wood decking boards 10 are formed using a variety of wood species. In particular, the outdoor wood decking boards 10 can be formed from a variety of wood species, including common grade or general purpose grade North American Softwood species of North American Softwood wood species. The outdoor wood decking board 10 includes a facing wood veneer 50 formed from a superior grade North American Softwood species, and in another embodiment, the facing wood veneer 50 is formed from some of the finest exotic hardwoods found globally. The North American Softwood species are selected because there is variety of wood species therein that are readily available, easy to work with, affordable, and aestetically pleasing for use as a facing wood veneer 50 in forming the outdoor wood decking board 10.

Embodiments, of the outdoor wood decking board 10 disclosed herein provides an important embodiment to improve the conservation of wood species in the global environment and development stage. In addition, the superior grade wood species of the North American Softwood species including the exotic hardwoods provide an outdoor wood decking board 10 that is a strong, aesthetically pleasing outdoor wood decking board 10 used for the construction of, consequentially, a strong and aesthetically pleasing outdoor deck floor 100.

The International Union for Conservation of Nature Red List of Threatened Species ("IUCN") was implemented to guide the selected wood species utilized in the embodiments of the outdoor wood decking boards 10. The IUCN Red List of Threatened Species (also known as the IUCN Red List or Red Data List), founded in 1964, is the world's most comprehensive inventory of the global conservation status of biological species. The International Union for Conservation of Nature (IUCN) is the world's main authority on the conservation status of species. A series of Regional Red Lists are produced by countries or organizations, which assess the risk of extinction to species within a political management unit and can be retrieved at http://www.iucnredlist.org/.

The IUCN Red List is set upon precise criteria to evaluate the extinction risk of thousands of species and subspecies. These criteria are relevant to all species and all regions of the world. The aim is to convey the urgency of conservation issues to the public and policy makers, as well as help the international community to try to reduce species extinction. According to IUCN (1996), the formally stated goals of the Red List are to provide scientifically based information on the status of species and subspecies at a global level, to draw attention to the magnitude and importance of threatened biodiversity, to influence national and international policy and decision-making, and to provide information to guide actions to conserve biological diversity.

The Red Data Book categories provide an easily and widely understood method for highlighting those species under higher extinction risk, so as to focus attention on conservation measures designed to protect them.

Outdoor wood decking boards 10 formed using facing wood veneers 50 formed from a superior grade of wood species, or facing wood veneers 50 formed from exotic hardwoods are environmental compliant and economical replacements for use of integral or one piece outdoor wood decking boards of superior grade wood species in the conventional construction of outdoor deck floors. The ability of an outdoor wood decking board 10 to be formed of a fractional amount of a superior grade wood species embodied in a facing wood veneer 50 seamlessly permanently directly attached to a wood core 10 of a lower grade wood species is environmentally prudent aligned with the objectives of the IUCN, and economically pragmatic. The outdoor wood decking board 10 allows for the formation of an outdoor deck floor 100 of similar dimensions and strength of an outdoor deck floor 100 made from an integral or one piece outdoor wood decking boards 10 of superior grade wood species, and exotic hardwood species, that are aesthetically pleasing to the viewer or consumer at a fraction of the cost and at a fraction of the negative impact on the natural resources of superior grade or high-grade wood species.

Various superior grade wood species that include smooth or non-cactile surfaces characterized as being free of cracks, holes, cavities or knots are provided in the embodiments of the disclosure for the formation of the facing wood veneers 50 attached to a first wood face 32 of the wood core 30; and in another embodiment to a second wood face 34 of the wood core 30 to form a dual veneered wood core 30. Use of common grade or general purpose wood species for the manufacture of outdoor wood decking boards 10 promote splintering of the outdoor wood core 30 along the wood grain, while wood cores 30 formed of common grade wood species including a facing wood veneer 50 formed of a superior grade wood species have inherently smooth surfaces or sanded smooth surfaces to form non-cactile surfaces characterized as being free of cracks, holes, cavities or knots can form a plurality of outdoor wood decking boards 10 arranged to form an assembled simulated non-cactile outdoor deck floor 100 characterized as being free of cracks, holes, cavities or knots formed of superior grade wood species.

FIG. 1 depicts an embodiment of an outdoor wood decking board 10. The outdoor wood decking board 10 embodied for use in construction of an assembled simulated superior grade wood species non-cactile outdoor deck floor 100 characterized as being free of cracks, holes, cavities or knots comprises a wood core 30; a facing wood veneer 50, an adhesive 106. The adhesive can be a pressure sensitive liquid adhesive 120, a water based two-part emulsion polymer-isocyanate adhesive; a two-part polyurethane emulsion polymer adhesive. The facing wood veneer 50 is seamlessly permanently directly attached to a first wood face 32 of the wood core 30 by means of the pressure sensitive liquid adhesive 120 such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive. In reference to superior grade, the facing wood veneer is formed such that the facing wood veneer 50 is non-cactile and thereby the facing wood veneer 50 includes a smooth exterior surface and therefore, not prickly or having splinters, characterized as being free of cracks, holes, cavities or knots.

Figure 2A:
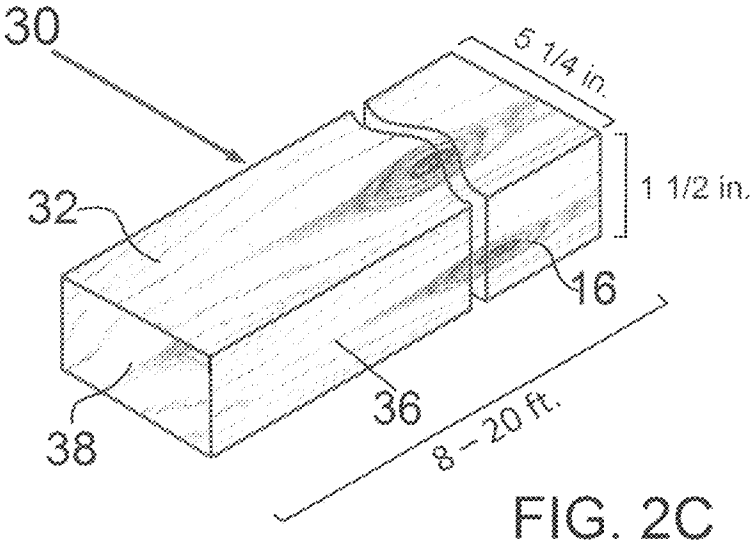
FIG. 2A is a top perspective view of a wood core of the outdoor wood decking board of FIG. 1, according to an embodiment of the disclosure.
Figure 2B:
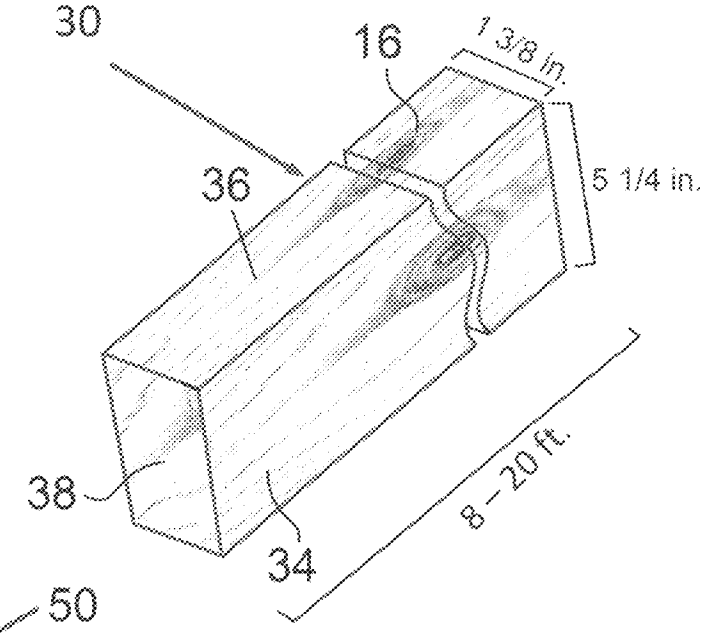
FIG. 2B is a side perspective view of the wood core of FIG. 2A, according to an embodiment of the disclosure.
Figure 2C:
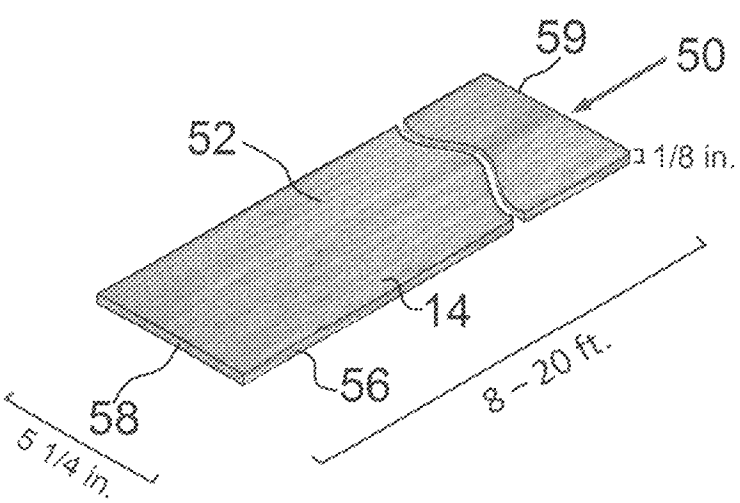
FIG. 2C is a top perspective view of a facing wood veneer of the outdoor wood decking board of FIG. 1, according to an embodiment of the disclosure.

Referring to FIGS. 1-2C, the wood core 30 is formed from a first wood species WP1, as a three-dimensional solid rigid wood body including a thickness ($T^1$), a width ($W^1$), and a length ($L^1$). The wood core 30 includes a first wood face 32, a second wood face 34 opposed to the first wood face 32, and dual opposite longitudinal wood side edges 36, the dual opposite longitudinal wood side edges 36 including interior longitudinal side edges $\mathbf{36}^1$ and exterior longitudinal side edges $\mathbf{36}^2$, The wood core 30 includes a first end 38 and a second end 39. The wood core 30 includes a longitudinal axis (LA). The wood core 30 is sized via a planar or a moulder to a configuration including a thickness of ($T^5$) which is equal to (($T^1$)−($T^2$)) inch(es), as shown in FIG. 2B.

The wood core 30 is sized to the thickness of ($T^5$) to account for the thickness of the facing wood veneer 50 upon the permanent attachment of the facing wood veneer 50 to the wood core 30, wherein the facing wood veneer 50 includes a thickness ($T^2$) of about ⅛ inch. Implementing this feature, provides for consistency in providing a facing wood veneered wood core 20, as shown in FIG. 3D is configured with a consistent thickness ($T^1$) of about 1 inches, and the outdoor wood decking board 10 post being sized is configured consistently having a thickness ($T^1$) of about 1½ inches, a width ($W^2$) of about 5¼ inches, and a length ($L^1$) of about 8.00-20.00 feet inclusive.

In another embodiment of the disclosure, the facing wood veneer 50 is configured with the thickness ($T^2$) of about 1/10 inch. In yet another embodiment, the facing wood veneer is configured with the thickness ($T^2$) of about 1/16 inch. Accordingly, the wood core 30 is sized configured at ($T^5$)=($T^1$)−(1/10 inch). And accordingly, the wood core 30 is sized configured at ($T^5$)=(($T^1$)−(1/16 inch)).

In an embodiment of the disclosure, the wood core 30 is formed from the first wood species WP1 wherein the first wood species WP1 is preselected from any one of a North American Softwood species including, generally, a common grade or general purpose grade of wood species. In an embodiment of the disclosure, the wood core 30 is formed from a knotty grade of western red cedar species, more particularly, a tight knot western red cedar species 16, as shown in FIGS. 1-3E.

The North American Softwood species that are implemented in the embodiment of the disclosure includes the first wood species WP1 of the wood core 30 which is formed from any one of a superior grade of North American Softwood species selected from the group consisting of tight knot Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In another embodiment of the disclosure, the wood core 30 is formed from any one of the North American Softwood species that are of common grade or general purpose grade that do not include a distinct tight knot. In another embodiment of the disclosure, the wood core 30 is formed from any one of the first wood species WP1 of North American Softwood species that are common grade or general purpose grade of reclaimed wood selected from the North American Softwood species.

Referring again to FIGS. 1-3E, the facing wood veneer 50, is formed from a second wood species WP2, as a three-dimensional solid rigid finishing layer including a thickness ($T^2$), the thickness ($T^2$) being less than the core thickness ($T^1$), the width ($W^1$), and the length ($L^1$). FIG. 1 shows the effectiveness of a facing wood veneer 50 manufactured from a superior grade wood species including a clear vertical grain western red cedar 14 species, or, also, referred to a clear grain western red cedar species.

The second wood species WP2 includes, generally, a superior grade in quality and appearance of the North American Softwood species. The second wood species WP2 of the facing wood veneer 50, can be selected from clear vertical grains, or clear grains of the group consisting of western red-cedar, (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In another embodiment of the disclosure, the facing wood veneer 50 is formed from any one of a superior grade of the second wood species WP2, wherein the wood of the second wood species WP2 is reclaimed wood of the North American Softwood species.

Referring to FIG. 2C, the facing wood veneer 50, as shown in FIG. 2C includes a first wood finishing face 52, a second wood finishing face 54 opposed to the first wood finishing face 52, and dual opposing longitudinal facing wood veneer side edges 56, the dual opposing longitudinal facing wood veneer side edges 56 including interior longitudinal facing wood veneer side edges $\mathbf{56}^1$ and exterior longitudinal facing wood veneer side edges $\mathbf{56}^2$. The facing wood veneer 50 includes a facing wood veneer first end 58 and a facing wood veneer second end 59. The facing wood veneer 50 includes a longitudinal axis ($LA^2$).

The facing wood veneer 50 is manufactured from a wood species selected from the second wood species WP2. As shown in FIG. 2C the facing wood veneer 50 is formed from a clear vertical grain western red cedar species 14.

In another embodiment, as discussed below, the facing wood veneer characterized as being free of cracks, holes, cavities or knots 50 is manufactured from a third wood species WP3, wherein the third wood species WP3 includes exotic hardwoods. The exotic hardwood species is selected from the group consisting of *Angelim pedra; Angelim vermelho*; (Balau) *Shorea* spp.; (Mukulungu) *Autranella con-*

*golensis*; (Tigerwood) *Astronium graveolens*; African Padauk (*Pterocarpus soyauxii*), African Walnut (*Lovoa trichilioides*); African Mahogany, *Khaya anthotheca; Khaya grandifoliola; Khaya ivorensis; Khaya senegalensis*; Hondoran Mahogany—*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); *Bosse, Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Militia excelsa, M. regia* (syn. *Chiorophora excelsa, C. regia*)); Jatoba (*Hymenaea courbaril*); *Koa* (*Acacia Koa*); Santos Mahogany (*Myroxylon balsamurn*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black, *Myzomela* (*Myzomela pammelaena*).

In another embodiment, the facing wood veneer 50 is formed from any one of the third wood species WP3, as listed above, where the exotic hardwoods are reclaimed exotic hardwoods selected from the third wood species WP3.

In another embodiment of the disclosure, the wood core 30 is formed from a first wood species WP1 of common grade or general purpose grade of reclaimed wood selected from the first wood species WP1. Within the context of the exemplary embodiment, the facing wood veneer 50 is formed from a superior grade reclaimed wood selected from the second wood species WP2. In another embodiment, the facing wood veneer characterized as being free of cracks, holes, cavities or knots is formed from reclaimed exotic hardwood species of a third wood species WP3.

The wood core 30 formed of the first wood species WP1 including the common grade or the general purpose grade of the first wood species WP1 is bonded with the facing wood veneer 50 where the facing wood veneer 50 is seamlessly permanently directly attached to the wood core 30. The facing wood veneer 50 is formed from the second wood species WP2, generally, of superior grade wood species than the first wood species WP1 of the wood core 30. The second wood species WP2 of the facing wood veneer 50 is preferably preselected from any one of a clear vertical grain western red cedar species, superior grade of North American Softwood species, as listed above, free from growth characteristics characterized as being free of cracks, holes, cavities or knots that affect appearance or performance. In some wood manufacturing houses the clear vertical grain is referred to as clear grain.

The common grade is defined to mean an all purpose grade of the North America Softwood species that have less amount or less percentage amount of clear, defect-free wood. The common grade wood includes characteristics that occur in U.S. North American Softwood species including tight knots, a burl, streaks, a glass worm, and the like. The common grade North American Softwood species, according to the embodiment of the disclosure, includes characteristics that occur in these woods which can be inherent within the North American Softwood species, and otherwise generic to all of the North American Softwood species. Some of the characteristics can occur naturally in the wood, or lumber, or as a result of the drying process.

In another exemplary embodiment, the facing wood veneer characterized as being free of cracks, holes, cavities or knots 50 is formed from any one of a third wood species WP3. The exotic hardwood species, as listed above, is selected from the group consisting of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany, *Khaya anthotheca; Khaya grandifoliola; Khaya ivorensis; Khaya senegalensis*; Hondoran Mahogany—*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn, *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia elanoxylon*); and Bismarck Black, *Myzomela* (*Myzomela pammelaena*).

No species of exotic wood or exotic hardwoods are utilized where the exotic hardwoods are placed on the CITES Appendices, or listed on the IUCN Red List as endangered, critically endangered, or extinct to prevent population reduction in generations caused by decline in its natural range and exploitation. Unless the exotic wood species is being utilized as recycled or reclaimed exotic wood.

However, exotic hardwoods in the vulnerable range are listed, as way of example, for manufacturers to embrace the embodiment of the disclosure in implementing facing wood veneers 50 including a thickness of the range of about 1/16-3/16 inch for the objective of preventing the wood species falling into the extinction range. In another embodiment of the disclosure, the facing wood veneer 50 is configured including a thickness ($T^2$) of about 1/8 inch. In another embodiment of the disclosure, the facing wood veneer 50 is configured including a thickness ($T^2$) of about 1/10 inch. Yet in another embodiment of the disclosure, the facing wood veneer 50 is configured including a thickness ($T^2$) of about 1/16 inch.

Exotic hardwoods in the third wood species WP3 that are utilized in the embodiment of the disclosure include those wood species listed above. Information on a variety of the exotic hardwoods can be found in the WOOD DATA BASE http://www.wood-database.com/. Included in the third wood species WP3 is *Angelim pedra* (*Hymenolobium petraeum*) which is an exotic tropical hardwood. Other names of the species is *Angelim* da Terra, *Angelim* da Mate. Caramate, Mirarema, Sapupira Amarela. The *Angelim pedra* originates from Brazil. The appearance of the heartwood is a light yellowish brown, while the sapwood is a pale brown. The grain of this wood is crisscross, and the texture is coarse and uneven so it is sanded before use. *Angelim pedra* is a medium-density wood, with a low moisture content. Since the timber is heavy and very hard, the shrinkage is slight. The wood has no distinctive odor. The heartwood of *Angelim pedra* is very durable and resistant to both fungi and termites. It dries very rapidly in a kiln, with a slight tendency for medium twisting and springing.

Another exotic hardwood included in the third wood species WP3 is *Shorea* spp. Common name Balau having a distribution from Southeast Asia. Color can be highly variable depending upon the species ranging from a pale straw color to a darker reddish brown. The Balau has a coarse texture with medium to large pores. Grain is sometimes interlocked. When providing a facing wood veneer 50 using Balau a first wood finishing face 52 will be sanded to a non-cactile finish so that the first wood finishing face is smooth and no splintering is apparent characterized as being free of cracks, holes, cavities or knots.

Balau is not listed in the CITES Appendices, but many species in the *Shorea* genus are on the IUCN Red List. The majority of *Shorea* are listed as being critically endangered due to a population reduction of over 80% in the past three generations, caused by decline in its natural range, and exploitation. Therefore, only recycled *Shorea* species is utilized according to the embodiments of the disclosure.

Another, exotic hardwood utilized in the embodiments of the disclosure included in the third wood species WP3 is the *Astronium graveolens*, common name Tigerwood, Jobillo, Goncalo aloes, because of its inherent beauty and aesthetic appearance it provides to the outdoor wood decking boards 10 and its excellent weathering properties and durability regarding decay resistance. The Tigerwood has its distribution from Mexico southward to Brazil. The heartwood is typically a medium reddish brown with irregularly spaced streaks of dark brown to black. Color tends to darken with age. The grain can be straight, but is usually wavy or interlocked. It has fine, uniform texture with good natural luster. Tigerwood is not listed in the CITES Appendices or on the IUCN Red List of Threatened Species, Yet another exotic hardwood is Mukulungu, *Autranella congolensis* A. Chev. having its distribution from the dense equatorial forests of Africa. The grain is straight or slightly interlocked, sometimes with an influence on further processing operations. Texture is usually fine to medium. It is very durable to decay without preservative treatment and is resistant to termite attack.

Also, included in the third wood species WP3 is African Padauk, *Pterocarpus soyauxii* ("Padauk"). Padauk is listed as one of the third wood species WP3 utilized for the formation of the facing wood veneer 50 of the wood decking board 30 Padauk distributed in Central and tropical west Africa. The average dried weight is 47 lbs/ft$^3$ (745 kg/m$^3$) having a specific gravity (Basic, 12% MC) of 0.61, 0.75 and a Janka Hardness of 1,970 lb$_f$ (8,760 N). The color appearance of African Padauk can vary ranging from a pale pinkish orange to a deep brownish red. Most pieces tend to start reddish orange when freshly cut, darkening substantially over time to a reddish/purplish brown (some lighter pieces age to a grayish brown). Grain is usually straight, but can sometimes be interlocked. With a coarse, open texture that can be sanded to a smooth veneer, a non cactile finish and good natural luster and a non-cactile finish characterized as being free of cracks, holes, cavities or knots. African Padauk has excellent decay resistance, and is rated as durable to very durable, African Padauk is also reported to be resistant to termites and other insects. African Padauk is moderately heavy, strong, and stiff, with exceptional stability.

The African Padauk wood species is not listed in the CITES Appendices or on the IUCN Red List of Threatened Species. Therefore, the outdoor wood decking board 10 embodied in the disclosure herein utilizing a facing wood veneer 50 having a thickness of about 1/16-3/16 inch, a fraction of the amount of that used in whole wood decking boards manufactured with the exotic hardwoods would be important and imperative to conserve the exotic hardwood species in their natural embodiment and prevent the exotic wood species from being placed into a risk of being threatened.

Another exotic hardwood species listed among the third wood species WP3 is Bamboo of which many timber-producing bamboos are from the *Phyllostachys* and *Bambusa* genera. Most timber producing bamboos are from South Asia. Being a monocot in the grass family, bamboo does not have any sapwood/heartwood or growth rings. Generally, it has a uniform and pale yellow to almost white. Bamboo is not listed in the CITES Appendices or on the IUCN Red List of Threatened Species. Bamboo provides a special aesthetics for its unique, down-to-earth appeal. Bamboo, also, has mechanical properties because bamboo possess some of the best stiffness/strength characteristics, and strength-to-weight ratios of any woody material on the planet.

Another exotic wood species listed among the variety of exotic hardwoods in the third wood species WP3 is Bosse, (*Guarea* spp., *G. cedrata* and *G. thompsonii*) distributed from West and Central Africa. The heartwood is initially a pale pinkish brown, darkening with age to a more golden to medium brown. Pale yellowish sapwood is well defined. Bosse can be highly figured, with grain patterns such as pommele being sought after in veneer form. The grain can be straight, interlocked, wavy, or anything in between. This wood is vaguely reminiscent of Sapele (both are in the Meliaceae family). Texture is medium to fine, with a good natural luster. Bosse also has fair resistance against insect attacks and has good weathering characteristics. This wood species is not listed in the CITES Appendices, but is on the IUCN Red List. It is listed as vulnerable due to a population reduction of over 20% in the past three generations, caused by a decline in its natural range. Again, implementation of the outdoor wood decking board 10 according to the present disclosure can prevent against extinction of the Bosse and other exotic hardwood species. Again, the disclosure does not encourage use of the vulnerable species but encourages the implementation of the outdoor wood decking board 10 disclosed to prevent the further exploitation of the exotic hardwood.

Another exotic hardwood of the variety of exotic hardwoods listed in the third wood species WP3 is Bulletwood, Massaranduba (*Manilkara bidentate*) distributed from Caribbean, and Central America. The average dried weight is 67 lbs/ft$^3$ (1,080 kg/m$^3$) having a specific gravity of 0.85, 1.08 and Janka Hardness of 67 lbs/ft$^3$ (1,080 kg/m. The heartwood is a medium to dark reddish brown. Bulletwood is an incredibly strong, dense wood which has good durability in exterior applications. Color tends to darken with age. Pale yellow sapwood is clearly differentiated from the heartwood, though not always sharply demarcated. Massaranduba has a grain straight to interlocked or wavy, and fine uniform texture with low natural luster. Bulletwood, Massaranduba is rated as very durable, with good resistance to most insect attack. This wood species is not listed in the CITES Appendices or on the IUCN Red List of Threatened Species.

In an embodiment of the disclosure, adhesives are utilized in the formation of the outdoor wood decking board 10. The adhesives include, the pressure sensitive liquid adhesives 120; two-part emulsion polymer-isocyanante, water based two-part emulsion polymer-isocyanate adhesive, acrylic based two-part emulsion polymer-isocyanates, (collectively referred to herein, as two-part emulsion polymer-isocyanate or two-part EPI adhesive); or the two-part polyurethane emulsion polymer (also, referred to as two-part PEP adhesive), provides a means to seamlessly permanently directly attach a second wood finishing face 52 of the facing wood veneer 50 against the first wood face 32 of the wood core 30, to form the outdoor wood decking board 10, methods of which are disclosed in more detail below, so that the non-cactile first wood finishing face 52 of the facing wood veneer 50 characterized as being free of cracks, holes, cavities or knots formed from a clear vertical grain, or clear grain, or superior grade of the second wood species WP2 visible to a user, homeowner, consumer, or guest, such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive providing an aesthetically pleasing appearance to the outdoor wood decking board 30, as shown in FIG. 1.

In an embodiment of the present disclosure, the adhesive is a two-part emulsion polymer-isocyanate adhesive ("EPI"). The two-part EPI adhesive provides a means to seamlessly permanently directly attach the second wood finishing face 52 of the facing wood veneer 50 against the first wood face 32 of the wood core 30, such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive to form the outdoor wood decking board 10, methods of which are disclosed in more detail below, so that the first wood finishing face 52 of the facing wood veneer 50 formed from a non-cactile clear vertical grain, or clear grain, or superior grade of the second wood species WP2 characterized as being free of cracks, holes, cavities or knots, visible to a user, homeowner, consumer, or guest, providing an aesthetically pleasing appearance to the outdoor wood decking board 30, as shown in FIG. 1.

In another embodiment of the present disclosure, the adhesive is a two-part polyurethane emulsion polymer ("PEP") The two-part PEP adhesive provides a means to seamlessly permanently directly attach the second wood finishing face 52 of the facing wood veneer 50 against the first wood face 32 of the wood core 30, such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive to form the outdoor wood decking board 10, methods of which are disclosed in more detail below, so that the first wood finishing face 52 of the facing wood veneer 50 formed from a clear vertical grain, or clear grain, or superior grade of the second wood species WP2 characterized as being free of cracks, holes, cavities or knots, visible to a user, homeowner, consumer, or guest, providing an aesthetically pleasing appearance to the outdoor wood decking board 30, as shown in FIG. 1.

Figure 17:
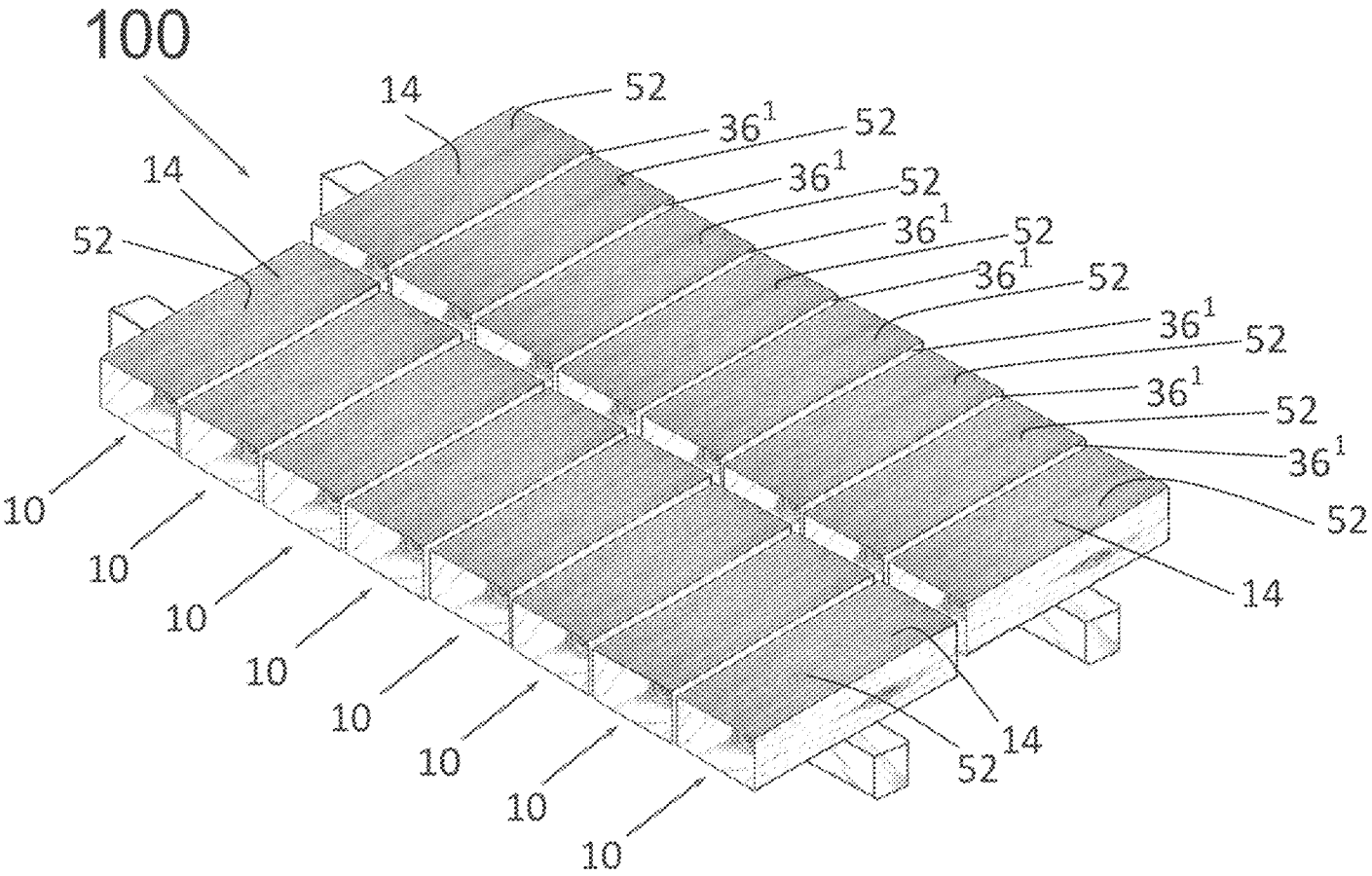
FIG. 17 is a top perspective view of an outdoor wood deck floor including a plurality of outdoor wood decking boards, according to an embodiment of the disclosure.

Implementing this feature of the embodiment, of facing wood veneers 50 formed from superior grades of North American Softwood species, exemplified in the clear vertical grain western red cedar, and preselected from any one of a clear vertical grain red cedar wood species, or clear grain red cedar wood species, or any one of the superior grades of North American Softwood species, listed above, of the second wood species WP2, or preselected from any one of the third wood species WP3 of exotic hardwoods, wherein the facing wood veneers thus formed are non-cactile characterized as being free of cracks, holes, cavities or knots, a plurality of outdoor wood decking boards 30 are adapted to be arranged along interior longitudinal side edges $\mathbf{36}^1$ of each other to form the assembled simulated superior grade wood species non-cactile outdoor wood deck floor 100 of preconfigured dimensions, characterized as being free of cracks, holes, cavities or knots, as shown in FIG. 17.

More particularly, a plurality of outdoor wood decking boards 10 are adapted to be arranged along interior longitudinal side edges $\mathbf{36}^1$ of each other to form an assembled simulated superior quality grade wood species non-cactile outdoor deck floor 100 characterized as being free of cracks, holes, cavities or knots of preconfigured dimensions displaying any one of the second wood species WP2 of the group consisting of clear vertical grain or clear grain, Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species) to the user, homeowner, consumer, guest observing the outdoor wood decking boards 10 of an assembled simulated superior quality grade wood species non-cactile outdoor deck floor 100 characterized as being free of cracks, holes, cavities or knots. FIG. 17 shows an outdoor deck floor 100 including a plurality of outdoor wood decking boards 10 comprising a tight knot western red cedar 16 wood core 30 having a clear vertical grain western red cedar 14 facing wood veneer seamlessly permanently directly attached thereon.

Figures 12A, 12B, 12C, 12D:
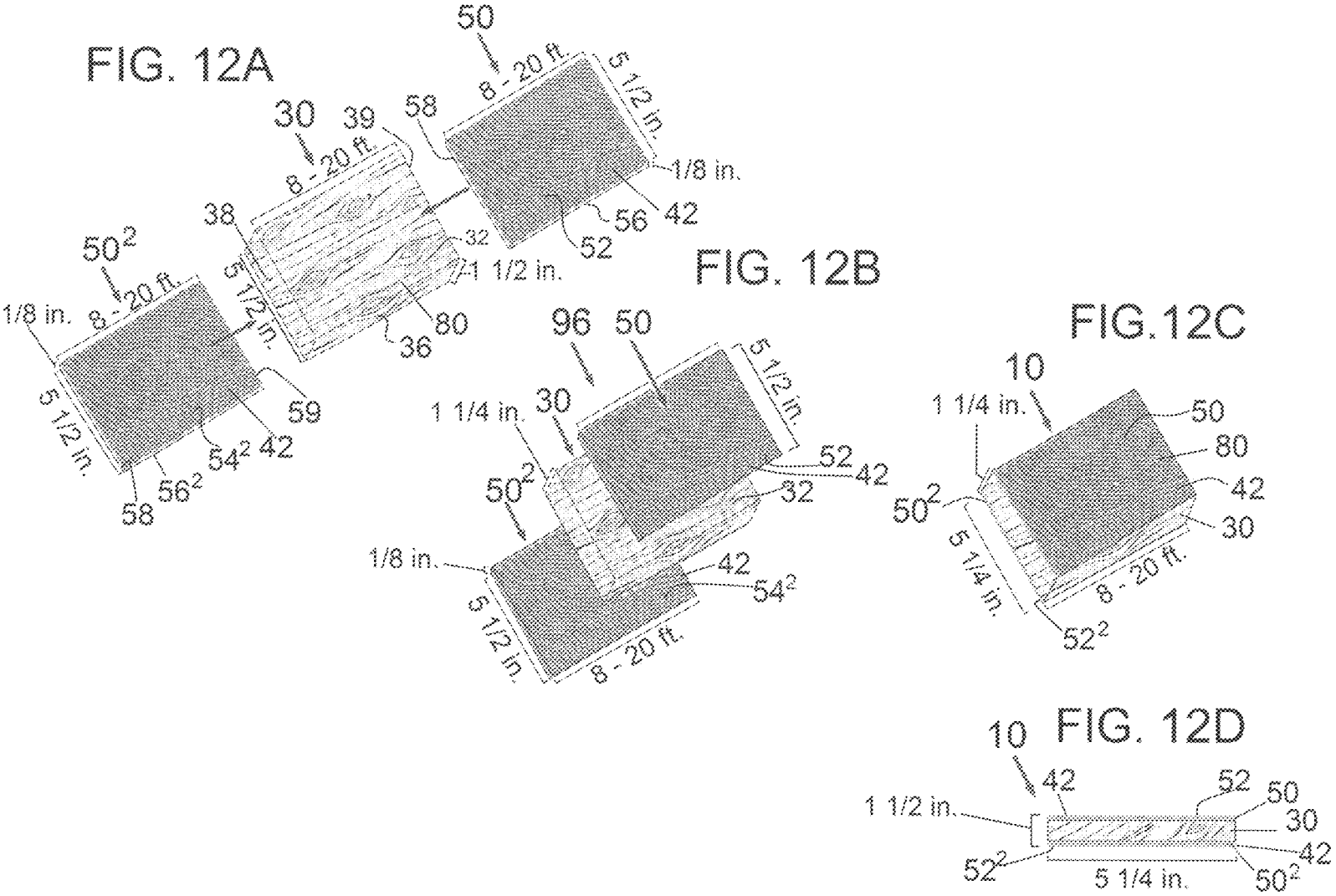
FIG. 12A is a schematic illustrating a first facing wood veneer, a wood core, and a second facing wood core of an outdoor wood decking board, according to an embodiment of the disclosure.
FIG. 12B is a schematic illustrating the first facing wood veneer, the wood core, and the second facing wood veneer of FIG. 12A showing the first facing wood veneer being attached to a first wood face of the wood core, and the second facing wood veneer being attached to a second face of the wood core.
FIG. 12C is a top perspective view of the outdoor wood decking board, according to an embodiment of the disclosure.
FIG. 12D is a side planar view of the outdoor wood decking board of FIG. 12C, according to an embodiment of the disclosure.
Figures 13A, 13B, 13C, 13D:
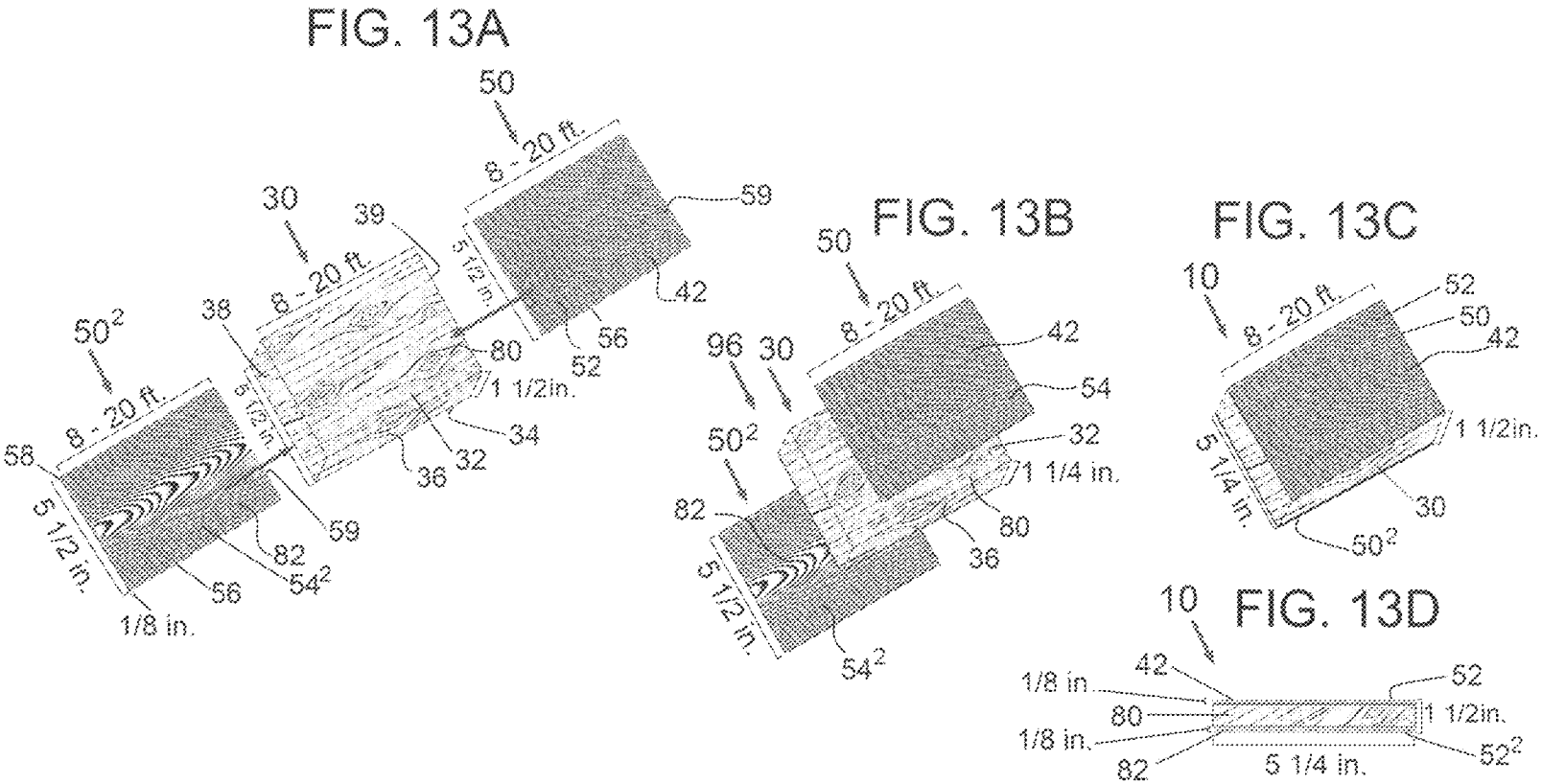
FIG. 13A is a schematic illustrating a first facing wood veneer, a wood core, and a second facing wood core of an outdoor wood decking board, according to an embodiment of the disclosure.
FIG. 13B is a schematic illustrating the first facing wood veneer, the wood core, and the second facing wood veneer of FIG. 13A showing the first facing wood veneer being attached to a first wood face of the wood core, and the second facing wood veneer being attached to a second face of the wood core.
FIG. 13C is a top perspective view of the outdoor wood decking board, according to an embodiment of the disclosure.
FIG. 13D is a side planar view of the outdoor wood decking board of FIG. 13C, according to an embodiment of the disclosure.

In another embodiment of the disclosure, as shown in FIGS. 12A 12D and FIGS. 13A-13D, and discussed in more detail below, a second facing wood veneer $\mathbf{50}^2$ is seamlessly permanently directly attached by means of an adhesive, wherein the adhesive is selected from the group comprising the pressure sensitive liquid adhesive, the two-part EPI adhesive, and the two-part PEP adhesive, to the second wood face 54 of the wood core 30 to form an outdoor wood decking board 10 as shown in FIGS. 12C-12D and FIGS. 13C-13D including a dual facing wood veneered wood core 96. As shown in FIGS. 12A and 13A, the second facing wood veneer $\mathbf{50}^2$ is formed as a three-dimensional solid rigid finishing layer$^2$ including the thickness ($T^2$), the width ($W^1$), and the length ($L^1$). The second facing wood veneer $\mathbf{50}^2$ includes a first finishing face$^2$ $\mathbf{52}^2$, a second finishing face$^2$ $\mathbf{54}^2$ opposed to the first finishing face$^2$ $\mathbf{52}^2$, and dual opposing longitudinal facing wood veneer side edges$^2$ $\mathbf{56}^2$.

The second facing wood veneer $\mathbf{50}^2$ can be formed from any one of the second wood species WP2 of the North American Softwood species including the clear vertical grain red cedar wood 14 species. The second wood species WP2 includes any one of a superior grade of the second wood species WP2 of the group consisting of superior grade of North American Softwood species selected from the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In another embodiment, the second facing wood veneer characterized as being free of cracks, holes, cavities or knots 50$^2$ can be formed from any one of the third wood species WP3. As discussed above, the third wood species WP3 includes the exotic hardwood species selected from the group consisting of exotic hardwood species selected from the group consisting of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany, *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*: Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.): River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

Referring to FIGS. 12A-12D and FIGS. 13A-13D, and described in more detail below, the second facing wood veneer 50$^2$ is permanently directly attached to the second wood face 34 of the wood core 30 by means of the pressure sensitive liquid adhesive 120, or the two-part EPI adhesive, or the two-part PEP adhesive, so that a first finishing face$^1$ 52$^2$ of a second facing wood veneer 50$^2$ to form an outdoor wood decking board 10 where the second facing wood veneer 50$^2$ is visible to a viewer, user, homeowner, consumer, or guest, from beneath a newly formed outdoor wood deck floor 100. In this manner, that the outdoor wood decking boards 10 provides an outdoor ceiling of either including the second wood species WP2 of superior grade North American Softwood species, or third wood species WP3 of selected exotic hardwood species, to an outdoor room beneath the outdoor wood decking boards 10 of the newly formed outdoor deck floor 100.

The wood core 30 of the outdoor wood decking board 10 includes the second facing wood veneer 50$^2$ seamlessly permanently directly attached by means of pressure sensitive liquid adhesive 120, or the two-part EPI adhesive, or the two-part PEP adhesive, to the second face 34 of the wood core 30 such that the first finishing face$^2$ 52$^2$ of the second facing wood veneer 50$^2$ formed from the second wood species WP2 including any one of the superior grade second wood species WP2 of the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix Lyallii*), Alaskan Yellow-Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species) is displayed to the viewer from below the assembled outdoor wood decking boards 10 thereby, a plurality of outdoor wood decking boards 10 adapted to be arranged along interior longitudinal wood side edges of each other can form an assembled simulated non-cactile clear vertical grain western red cedar outdoor deck floor 100 characterized as being free of cracks, holes, cavities or knots of pre-configured dimensions.

In another embodiment, the plurality of outdoor wood decking boards 10 adapted to be arranged along interior longitudinal wood side edges of each other can form an assembled simulated non-cactile clear grain western red cedar outdoor deck floor 100 of pre-configured dimensions, characterized as being free of cracks, holes, cavities or knots, as shown in FIG. 17. The outdoor wood decking board 10 can be embodied in any one of the wood cores 30 formed from the common grade or general purpose grade wood species selected from the first wood species WP1 in combination of any one of the facing wood veneers 50 embodied in any one of the superior grade wood species selected from the second wood species WP2 or the third wood species WP3 thereby forming a variety of outdoor wood decking boards 10 including a plurality of a variety of facing wood veneers 50 including a variety of wood species to form a plurality of outdoor deck floors 100 representing a variety of wood species.

In another embodiment of the disclosure the facing wood veneer 50 and the second facing wood veneer 50$^2$ is formed from a clear cedar including a quartersawn vertical grain.

In another embodiment, the second facing wood veneer characterized as being free of cracks, holes, cavities or knots 50$^2$ is formed from the third wood species WP3, the exotic hardwood species, the exotic hardwood species, as listed above, thereby forming the outdoor wood decking board 10 including an exotic hardwood species WP3 so that when a plurality of outdoor wood decking boards 10 are adapted to be arranged along interior longitudinal wood side edges of each other the plurality of outdoor wood decking boards 10 can form an assembled simulated non-cactile exotic wood species outdoor deck floor 100 characterized as being free of cracks, holes, cavities or knots of pre-configured dimensions, as shown in FIG. 17.

The wood species preselected for the second facing wood veneer 50$^2$ to layer the wood core 30 can be formed from the same wood species preselected for the first facing wood veneer 50 of the wood core 30. In the alternative, the second facing wood veneer 50$^2$ is formed from a different wood species from the wood species preselected for the first facing wood veneer 50.

As shown in FIG. 12A-12D, the wood core 30 is formed from a first wood species WP1, namely Douglas fir 80, and the first facing wood veneer 50 is formed from a third wood species WP3, namely, Sapele (*Entandrophragma cylindricum*) 42, and the second facing wood veneer 50$^2$ is formed from the same wood species, Sapele (*Entandrophragma cylindricum*) 42.

In the alternative, the first facing wood veneer 50 is formed from a first wood species and the second facing wood veneer 50$^2$ is formed from a different wood species from the first facing wood veneer 50, as shown in FIGS. 13A-13D. The first facing wood veneer 50 is formed from the third wood species WP3, namely Sapele (*Entandrophragma cylindricum*) 42 and the second facing wood veneer 50$^2$ is formed from a third wood species WP3 of exotic hardwoods, namely, Santos Mahogany 82.

Implementing this feature of the embodiment of the disclosure, the outdoor wood decking boards 10 allows a user to display a first facing wood veneer 50 of the assembled simulated superior quality grade wood species non-cactile outdoor deck floor 100 characterized as being free of cracks, holes, cavities or knots showcasing a first aesthetic appearance complimentary to the surrounding natural environment of the assembled simulated superior quality grade wood species non-cactile outdoor deck floor 100 and consubstantially allows the user to display a second facing wood veneer 50$^2$ of the assembled simulated superior quality grade wood species non-cactile outdoor deck floor 100 to a viewer below the assembled simulated superior quality grade wood species non-cactile outdoor deck floor 100 showcasing a second aesthetic appearance complimentary to the surrounding environment, for example, in an outside room created by the disposition of the assembled simulated superior quality grade wood species non-cactile lower outdoor deck floor 100 characterized as being free of cracks, holes, cavities or knots devised as a ceiling to the outside room.

The use of the facing wood veneers 50 and second facing wood veneers 50$^2$ manufactured with superior quality grade wood species, and the exotic hardwood species, is a novel embodiment of outdoor wood decking boards 10 with the purpose of conservation of high grade wood species in their natural geographic environment and preventing excessive consumption of superior quality grade woods in the manufacture of outdoor wood decking boards 10. In addition, the use of facing wood veneers 50 and second facing wood veneers 50$^2$ with superior grade wood species provides an aesthetic look to the outdoor decking boards 10 of the outdoor deck floor 100 simulating a superior grade wood non-cactile outdoor deck floor 100 characterized as being free of cracks, holes, cavities or knots, as shown in FIG. 17, increasing the value to the home and facility attached thereof, whereas the outdoor wood decking boards 10 are cost efficient because the wood core 30 is manufactured from a less expensive wood species, and the facing wood veneer 50 utilizes a small amount of a superior quality wood species rather than utilizing the superior quality wood species for the manufacture of the entire wood core 30 of the outdoor wood decking board 10.

The facing wood veneer 50 can be manufactured from virgin wood species or recycled wood species.

Typically construction of outdoor deck floors include a plurality of outdoor decking boards made of wood which require manufacturing each outdoor wood decking board from an enormity of natural wood resources of superior grade wood species or exotic hardwood species so that each outdoor wood decking board is completely manufactured with a piece of a superior grade wood species. A known problem to this approach is that the natural resources including a variety of superior grade wood species are exposed to exhaustion, vulnerable, endangered, critically endangered, and extinction of the wood species particular to a certain geographical region. In addition, this method is not cost prohibitive. Therefore, the embodiments disclosed herein provide a solution to the negative impact of outdoor deck floors on the natural resources of superior grade wood species and to the cost of constructing outdoor decking boards used for the construction of outdoor deck floors.

As shown in FIGS. 1-17, the outdoor wood decking board 10 for use in construction of an outdoor deck floor 100, embodied herein includes wood cores 30 configured with specific dimensions having facing wood veneers 50 configured with amalgamating specific dimensions to fill a variety of specifications of outdoor wood decking boards 10 for use in the construction of outdoor deck floors 100. Each wood core 30 includes like features and for the sake of brevity the features will be described using like numbers throughout the embodiments of the disclosure for consistency.

In addition, the embodiments of the disclosure are described with the use of the pressure sensitive liquid adhesive 120 including the two-part emulsion-polymer-isocyanate adhesives, and the two-part polyurethane emulsion polymer adhesives, in the formation of the outdoor wood decking board 10, described in detail, here, for brevity, and not repeated in detail for each embodiment of the disclosure.

In an embodiment of the disclosure, the pressure sensitive liquid adhesive can be a polyvinylacetate. In another embodiment, the pressure sensitive liquid adhesive is a crosslinking vinyl acetate, wherein the crosslinking vinyl acetate has a solid content of about 52% and a pH of about 5.5-6.0. The crosslinking vinyl acetate has an off white color, a viscosity of BKFLD RVF @75° F. approx.2500 cps. The crosslinking vinyl acetate is available through Pacific Adhesives Company, Inc., technical data sheet: EWG-2227.

In yet another embodiment, the crosslinking vinyl acetate has a solid content of about 46% and a pH of about 4.5-5.5, white color, viscosity BKFLD RVF @75° F. approx. 3500 cps. This crosslinking vinyl acetate is available through Pacific Adhesives Company, Inc., technical data sheet: R-517BWG.

In another embodiment, the pressure sensitive adhesive is a melamine resin adhesive including melamine-formaldehyde resin methyl alcohol and formaldehyde. The melamine resin adhesive is commercially available through Akzo Nobel Coatings, Inc., Casco Adhesives, product number Adhesive: C1263.

In another embodiment, the pressure sensitive adhesive is a melamine resin adhesive including a liquid hardener.

In another embodiment, the adhesive is a polymerized polyurethane reactive adhesive. The adhesive is a polyurethane reactive adhesive, or polymerized polyurethane reactive adhesives. The polyurethane reactive adhesives have been known to be used in construction. They have been utilized in outdoors, boasting effective weatherproofing qualities and high impact bonding strength.

In another embodiment of the disclosure, the pressure sensitive liquid adhesive can be a polyurethane resin adhesives can even withstand exposure to salt water. Polyurethane resin adhesives boast excellent resistance to high temperatures, UV and weather conditions to provide a tough, hard wearing bond.

In an embodiment of the subject matter disclosed, an improved method for adhering and bonding in forming the outdoor wood decking boards 10 is disclosed.

More specifically, the invention relates to adhering, bonding, and laminating, in forming the outdoor wood decking boards 10 by means of a two-part emulsion-polymer isocyanate adhesive. It is known to use water based two-part EPI adhesives for several applications and acrylic based two-part EPI adhesives. Two-part EPI adhesives have been used for decades for gluing wood, especially, in Japan. In addition, to having short hardening time, water based two-part EPI adhesives are free of formaldehyde.

Water based two-part EPI adhesives, generally, are two-part adhesives based on reaction of a mixture of water based emulsions of carboxylated styrene-butadiene copolymer latex ("SBR"), ethylene vinyl acetate copolymer ("EVA") and polyvinyl acetate (PVAc) typed with an isocyanate hardener (crosslinker) forming water-resistant bonds. Two-part EPI adhesives can be formulated in many ways to give the optimal performance with respect to water resistance, curing speed, type of substrate, strength and viscosity in each bonding adhesive operation.

Regarding the adhesion of a reinforcement to wood, the International Code Council (ICC) has issued performance requirements in the nature of glue bonding specifications. The ICC is a nonprofit organization dedicated to developing a single set of comprehensive and coordinated national model construction codes used to construct residential and commercial buildings, including residences and schools. Most U.S. cities, counties, and states that adopt codes choose the International Codes developed by the ICC. The ICC has issued AC280, which provides a computer program model to predict beam values for laminated timber. AC280, also, specifies performance requirements including adhesive bonding specifications for bonding to substrates to wood.

With regard to adhesive qualification, AC280, also, identifies additional standards which have been set by such agencies as American Society for Testing and Materials International (ASTM) and American National Standards Institute (ANSI). Specifically, an adhesive used to bond a laminate to a wood surface must conform to ASTM D 2559 (Standard Specification for Adhesives for Structural Laminated Wood Products for Use Under Exterior (Wet Use) Exposure Conditions) and ANSI A190 (for wood products—Structural Glued Laminated Timber).

Two-part EPI adhesives have been developed and used successfully for the bonding of wood together to Meet ICC AC280, ASTM D-2559, and ANSI A190.1 requirements. Two-part EPI adhesives have been developed and used for the bonding of wood to wood and have been recommended to use in bonding laminates to wood, fiber reinforced polymer composites, painted polymer composites, and painted metal. The use of two-part EPI adhesive for use in wood to wood applications has, also, been documented in NER-165 ICC Evaluation Services Inc. Legacy Report of Feb. 1, 2002. The ICC NER-165 from Ashland Specialty Chemical Company provides for their two part EPI adhesives have been tested for compliance with ASTM D 2559-84 and are intended to be used as structural adhesives for laminated softwood products and fabrication of plywood components, such as stress panels, sandwich panels, curved panels, glulam beams, post, I-joists, and LVL.

In an embodiment of the subject matter, an improved method for adhering outdoor wood decking boards 10 is disclosed. More specifically, the invention relates adhering, bonding, and laminating, in the formation of the wood decking boards 10 by means of a two-part emulsion-polymer-isocyanate adhesive ("EPI"). It is known to use EPI adhesives for several applications.

In addition, ISOSET EPI adhesive systems have been tested on substrates for use in bonding sandwich panel components. The adhesive formulations are suitable for bonding gypsum wallboard, hardboard, particle board, waferboard, OSB, and plywood to core materials of styrene and urethane foam, paper and aluminum honeycomb. The adhesive formulations are, also, suitable for bonding facings of painted metal and fiberglass reinforced plastic to waferboard, OSB, or plywood.

The adhesives are intended for structural use where high resistance to moisture is required in roof, wall and floor components subjected to sustained loadings such as live or snow loads.

The water based adhesive uses the two-part EPI technology forming bonds with excellent creep, shear and tensile properties. Substrates bonded with two-part EPI adhesives are extremely durable and offer outstanding resistance to moisture and humidity. The two-part EPI adhesives have been used for engineered wood (I-joist), glulam, structural laminated wood, LVL, vertical studs, etc.) millwork, hardwood flooring, structural foam core panels, load bearing constructions, finger joints, and structurally insulated panels. The curing characteristics of two-part EPI adhesives are complex and include film formation of the emulsion adhesive as well as chemical reaction of the highly reactive isocyanate towards water, hydroxyl-, amines- and carboxy-groups. The advantages obtained by the use of two-part EPI adhesives are fast setting speed, cold curing, light colored glue lines, low creep of the glue line, and high moisture resistance.

ISOSET™ two-part EPI from Ashland, Inc., Columbus, Ohio, is a commercially available two-part EPI adhesive that is implemented in the disclosure of the subject matter.

The water based two-part EPI adhesives, in general, include a water based polymer cured with an isocyanate. This combination gives glue line performance with the benefits for both thermoplastic and thermosetting adhesive systems such as high flexibility of the glue line, cold setting and excellent cold and boiling water resistance. The systems are fast setting and cold curing and they give light colored glue lines. The curing process is a combination of a physical process, film formation, and the chemical reactions of isocyanate.

In addition, Franklin International, Columbus, Ohio, USA provides an emulsion polymer isocyanate system (EPI), namely, ADVANTAGE EP-930 htttp://www.franklinadhesivesandpolymers.com/Wood-Adhesives-US/Wood-Adhesives/Product-Family/Advantage-family/Advantage_EP_940.aspx The ADVANTAGE EP-930 is a two-part emulsion polymer isocyanate system (EPI) developed for improved radio frequency performance. It is mixed with HARDENER 400, a polymeric isocyanate at 10-15 parts Hardener 400 to 100 parts emulsion ADVANTAGE EP-930 DEV. It is from the chemical family description polyvinyl acetate emulsion adhesive, has a specific gravity of 1.36, and pH of 7.0-8.5. The suggested minimum use temperature is 46° F./7° C. The adhesive is characterized by good spreader stability and low foam production, and good adhesion to laminated veneer lumber and other treated wood when compared with traditional EPI adhesives. ADVANTAGE EP-930 DEV with Hardener 400 surpasses the ASTM D-5751-99 wet use for laminate joints in non-structural lumber products and the DIN D4 standard.

The ADVANTAGE EP-930 is from the chemical family polyvinyl acetate emulsion adhesive The ADVANTAGE-930 is an emulsion polymer isocyanate system EPI developed for improved radio frequency performance. It is mixed with HARDENER 400, a polymeric isocyanate at 10-15 parts HARDENER 400-100 parts emulsion ADVANTAGE EP-930 DEV. The adhesive is characterized by good spreader stability and low foam production when compared with traditional EPI adhesives. ADVANTAGE EP-930 DEV with HARDENER 400 surpasses the ASTM D-575-99 wet use for laminate joints in non-structural lumber products and the DIN D4 standard. ADVANTAGE EP-930 resin is mixed with HARDENER 400 at a ratio of 100 parts resin to 15 parts Hardener by weight.

The pot life of the two-part emulsion polymer-isocyanate adhesive (ADVANTAGE EP-930) is in excess of one hour at 77° F./25° C., However the viscosity of the mix will increase as it ages. Wood glued with older material will have less water resistance, a characteristic common to most EPI adhesives. Therefore, it is recommended that fresh adhesive be mixed only when it is to be immediately used. The two-part emulsion-isocyanate (Advantage EP-930) resin is mixed with Hardener 400 at a ratio of 100 parts resin to 15 parts Hardener by weight or 6.45 parts resin to one part Hardener by volume. Avoid mixing for long periods of time or with excessive agitation as pot life is affected by mixing time and speed. While this product can be easily mixed by hand, it is usually more convenient to mix the components in a meter mix unit. Appropriate mixing ratios will depend upon the wood core 30 and the facing wood veneer 50 used to form the outdoor wood decking board 10.

The moisture content of the two-part emulsion polymer-isocyanate (ADVANTAGE EP-930) is six to ten percent is the recommended moisture content for the gluing stock. Higher moisture content will increase the clamp time needed. Additionally, moisture content should mirror (as closely as possible) that which will be experienced in the end use market for the wood product being manufactured. The preparation of the wood cores 30, cores 30, facing wood veneers 50 to be glued is extremely important. Variation in thickness should not exceed ±0.005 inches/0.12 mm. Sizing of the wood core 30, core 30, facing wood veneered wood core 20, facing wood veneered core 20, or outdoor wood decking board 10 to thickness should be performed using higher than 50 grit abrasives.

The spread rate and recommended adhesive coating layer is the same as for most poly vinyl acetate products or approximately 0.007 inches/0.178 mm in thickness. The two-part emulsion polymer-isocyanate adhesives have superior gap filling properties due to their higher percent solids content. Generally, 200 g/m$^2$/41#/MSGL of glue line is adequate. Conveyorized spreaders are commonly used. One side application is adequate in most situations but two sided applications are embodied in the disclosure.

Heat and pressure are dependent upon the wood species or wood core 30, facing wood veneer 50, or core 30 to be glued. Direct contact of the gluing surfaces must be made to obtain maximum strength. A minimum press time of 80 minutes is recommended under ideal conditions when using North American soft wood species of the second wood species WP2 at moisture content less than eight to ten percent and factory temperatures of 68 degrees Fahrenheit/20 degrees Celsius. Longer press times will be required for higher density species, higher moisture contents and colder factory temperatures. It is recommended that optimum press times be determined in actual plant conditions recognizing that seasonal changes may lead to variable requirements. Hot Press time is dependent on the adhesive used, gluing stock type, moisture content of the stock and environmental conditions.

The Franklin Adhesives, ADVANTAGE EP-950A is a two-part acrylic emulsion polymer-isocyanate system having an acrylic-base emulsion polymer isocyanate system (EPI) developed with exceptional water and heat resistance. The specific gravity is 1.28 and the suggested minimum use temperature is 46° F./7° C., and has a pH of 6.5-8.2. The two part emulsion polymer-isocyanate is used for water, heat and solvent resistance adhesives with wood products. It works well in hot and cold press applications.

It exceeds the requirements of ASTM D25559-12a, ASTM D7247-07ae1, ANSI 405-2013 and CSA 0112.10, which are required adhesive tests for many structural applications. This adhesive can be utilized in cold and hot press equipment. The emulsion must be mixed with HARDENER 200, A POLYMERIC ISOCYANATE, AT 13-15 PARTS HARDENER 200 to 100 parts emulsion.

ADVANTAGE EP-950A resin is mixed with HARDENER 200 at a ratio of 100 parts resin to 15 parts Hardener by weight or 6.45 parts resin to one part HARDENER by volume. Avoid mixing for long periods of time or with excessive agitation as pot life is affected by mixing time and speed.

ADVANTAGE EP-950A exceeds ASTM D2559-12a Standard Specification for Adhesives for Bonded Structural Wood Products for Use Under Exterior Exposure Conditions. This standard covers adhesives suitable for the bonding of wood into structural laminated wood products for general construction and other uses where a high-strength, durable adhesive bond is required. The strength and durability requirements are based on the performance of the adhesive in laminated wood as measured by the following test methods: resistance to shear by compression loading; resistance to delamination during accelerated exposure to wetting and drying; and resistance to deformation under static load.

ADVANTAGE EP-950A Exceeds ASTM D7247-07ae1, Standard Test Method for Evaluating the Shear Strength of Adhesive Bonds in Laminated Wood Products at Elevated Temperatures: This standard is used for evaluation of the shear strength of an adhesive at ambient and elevated temperature relative to the performance of solid wood at the same conditions.

The two-part EPI adhesives are best used according to the manufacturer's directions and recommendations as provided by Franklin Adhesives and Polymers at http://www.franklinadhesivesandpoymers.com/Wood-Adhesives-US/Wood-Adhesives/Product-Family/Advantage-family/advantage-ep-950a.aspx.

ADVANTAGE EP-950A Exceeds ANSI 405-2013 Standard for Adhesives for Use in Structural Glued Laminated Timber: This standard provides the minimum requirements for evaluation of adhesives to be used in structural glued laminated timber products. Adhesives must meet the requirements of ASTM D2559, ASTM D7247, as well creep resistance, accelerated aging of bonded specimens compared to solid wood controls, and durability testing using boil-dry-freeze conditioning.

Six to ten percent is the recommended moisture content for the gluing stock. Higher moisture content will increase the clamp time needed. Additionally, moisture content should mirror (as closely as possible) that which will be experienced in the end use market for the wood product being manufactured.

The preparation of the stock to be glued is extremely important. Joints cut from rip saws should be free of saw marks. They should also be straight and square. Moulded or jointed stock should be free of knife marks. Glazed or burnished joints will prevent adhesive penetration and should be avoided. When possible, glue joints should be prepared and glued the same day. Gluing stock should be uniform in thickness. Variation in thickness should not exceed ±0.005 inches/0.12 mm. Sanding to thickness should be performed using higher than 50 grit abrasives.

With regard to spread rate the recommended adhesive coating layer is the same as for most PVA products or approximately 0.007 inches/0.178 mm in thickness. EPI adhesives have superior gap filling properties due to their higher percent solids content. Generally, 200 g/m$^2$/41#/MSGL of glue line is adequate.

Conveyorized spreaders are commonly used in edge-gluing applications. Adjust the applicator to ensure complete coverage on the staves. One side application is adequate in most situations. Verify that adequate coverage exists by monitoring squeeze-out along the glue lines when the panels are under pressure. The assembly time of ADVANTAGE EP-950A varies with moisture content and spread rate. Higher spread rate can increase the assembly time of the product. When substrates are brought under pressure, a small bead of squeeze-out should be seen on the first samples assembled.

A minimum press time of 30 minutes is recommended under ideal conditions when using soft wood species at moisture content less than eight to ten percent and factory temperatures of 68 degrees Fahrenheit/20 degrees Celsius. Longer press times will be required for higher density species, higher moisture contents and colder factory temperatures. It is recommended that optimum press times be determined in actual plant conditions recognizing that seasonal changes may lead to variable requirements.

Another two-part EPI is the Franklin ADHESIVE EP-925. http://www.franklinadhesivesandpolymers.com/Wood-Adhesives-US/Wood-Adhesives/Product-Family/Advantage-family/Advantage-EP-925.aspx ADVANTAGE EP-925 is a two-component, in the chemical family polyvinyl acetate emulsion adhesive. The specific gravity is 1.28; suggested minimum use temperature is 46° F./8° C.; the pH of 6.5-8.0. The ADVANTAGE EP-925 is a low foaming emulsion polymer isocyanate (EPI) adhesive recommended for applications requiring exceptional water, heat and solvent resistance. The product can be utilized with conventional cold press or hot press equipment and has been enhanced to provide superior performance with radio frequency press equipment. ADVANTAGE EP-925 allows for reduction in conditioning time before surfacing which improves productivity. It is also characterized by good spreader stability when compared with traditional EPI adhesives.

ADVANTAGE EP-925 resin is mixed with HARDENER 200 at a ratio of 100 parts resin to 15 parts Hardener by weight or 6.45 parts resin to 1 part hardener by volume. The hardener is from the chemical family description Polymeric Methylene diphenyl diisocyanate (MDI) having a specific gravity of 1.23. Avoid mixing for long periods of time or with excessive agitation as pot life is affected by mixing time and speed. While this product can be easily mixed by hand, but is more convenient to mx in a meter mix unit.

The performance properties of the two-part emulsion polymer-isocyanate adhesive is formulated to provide higher immediate bond strengths than conventional wood bonding adhesives. The recommended two-part emulsion polymer-isocyanate adhesive coating layer is approximately 0.007 inches/0.178 mm in thickness.

In another embodiment of the subject matter, an improved method for forming an outdoor wood decking board 10 is disclosed, More specifically, the invention relates to the formation of an outdoor wood decking board 10 by means of a two-part polyurethane emulsion polymer adhesive.

Commercially available, is an ISOSET™ UX 100/WD3-A322 adhesive, as documented in the in ER-5440 ICC Evaluation Services Inc. Legacy Report of May 1, 2002, is a two-part adhesive based on a 100-percent-solids polyurethane that is combined with an emulsion polymer. The adhesive application is limited to bonding structural wood components of softwood species. The adhesive is suitable for use in roof, wall and floor components with high resistance to moisture and subject to sustained loading. The ISOSET™ PEP adhesive system is a two-part adhesive based on 100 percent reactive PEP adhesive blended with conventional isoset emulsion. The PEP adhesive provides strength and faster cure times, while providing excellent bonding strength. Two-part PEP adhesives have been used on structural finger joints and wood I-joist, as well as web-to-web applications.

In addition, ISOSET EPI adhesive systems have been tested on substrates for use in bonding sandwich panel components. The adhesive formulations are suitable for bonding gypsum wallboard, hardboard, particle board, waferboard, OSB, and plywood to core materials of styrene and urethane foam, paper and aluminum honeycomb. The adhesive formulations are, also, suitable for bonding facings of painted metal and fiberglass reinforced plastic to waferboard, OSB, or plywood.

The water based adhesive use the two-part EPI technology forming bonds with excellent creep, shear and tensile properties. Substrates bonded with two-part EPI adhesives are extremely durable and offer outstanding resistance to moisture and humidity. The two-part EPI adhesives have been used for engineered wood (I-joist), glulam, structural laminated wood, LVL, vertical studs, etc.) millwork, hardwood flooring, structural foam core panels, load bearing constructions, finger joints, and structurally insulated panels. The curing characteristics of EPI adhesives are complex and include film formation of the emulsion adhesive as well as chemical reaction of the highly reactive isocyanate towards water, hydroxyl-, amines- and carboxy-groups. The advantages obtained by the use of EPI adhesives are fast setting speed, cold curing, light colored glue lines, low creep of the glue line, and high moisture resistance.

ISOSET™ EPI from Ashland, Inc., Columbus, Ohio, is a commercially available two-part EPI adhesive that is implemented in the disclosure of the subject matter.

The water based two-part EPI adhesives, in general, include a water based polymer cured with an isocyanate. This combination gives glue line performance with the benefits of both thermoplastic and thermosetting adhesive systems such as high flexibility of the glue line, cold setting and excellent cold and boiling water resistance. The systems are fast setting and cold curing and they give light colored glue lines. The curing process is a combination of a physical process, film formation, and the chemical reactions of isocyanate.

Another adhesive commercially available is the ISOSET™ UX 100/WD3-A322 adhesive, as documented in the in ER-5440 ICC Evaluation Services Inc. Legacy Report of May 1, 2002, is a two-part adhesive based on a 100-percent-solids polyurethane that is combined with an emulsion polymer. The adhesive application is limited to bonding structural wood components of softwood species. The adhesive is suitable for use in roof, wall and floor components with high resistance to moisture and subject to sustained loading. The ISOSET™ polyurethane emulsion polymer (PEP) adhesive system is a two-part adhesive based on 100 percent reactive PEP adhesive blended with conventional isoset emulsion. The two-part PEP adhesive provides strength and faster cure times, while providing excellent bonding strength. The two-part PEP adhesives have been used on structural finger joints and wood I-joist, as well as web-to-web applications.

Descriptive literature and reports of test demonstrate compliance with the ASTM D 2559 and the Western Wood Products Association (WWPA) 101.97 Glued Products-Procedures for Mill Certification and Quality Control.

Figure 3A:
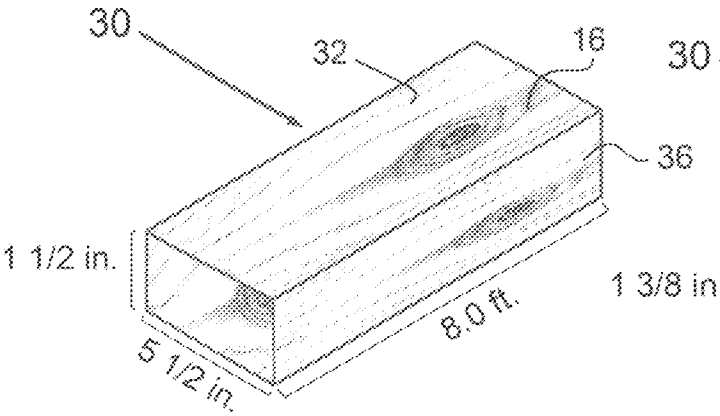
FIG. 3A is a top perspective view of a wood core of an outdoor wood decking board, according to an embodiment of the disclosure.
Figure 3B:
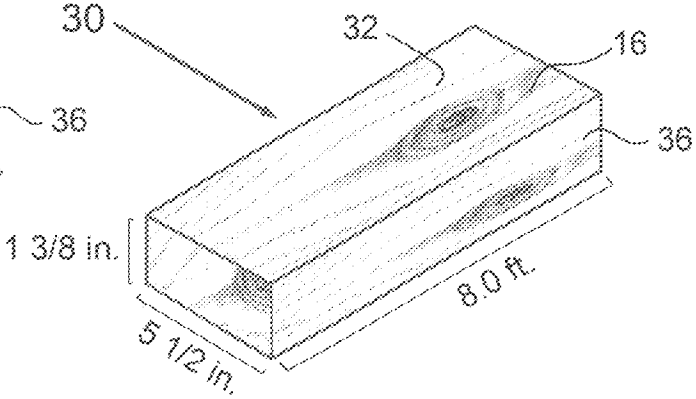
FIG. 3B is a top perspective view of the wood core of FIG. 3A illustrating sizing of the wood core of FIG. 3A, according to an embodiment of the disclosure.

Now, in describing the subject matter of the disclosure in more detail, reference is made to FIGS. 1-17, with particular attention FIGS. 1, 2A-2B, and 3A in an embodiment of the disclosure, the outdoor wood decking board 10 includes the wood core 30 which is configured including the thickness ($T^1$) of about 1½ inches, the width ($W^1$) of about 5½ inches, and the length ($L^1$) of about 8.00 feet-20.00 feet inclusive. Subsequently, the wood core 30, as shown in FIGS. 2B and 3B, is sized via a planar or moulder to a configuration including a thickness ($T^5$) of about 1⅜ inches, the width ($W^1$) of about 5½ inches, and the length ($L^1$) of about 8.00 feet-20.00 feet inclusive thereof. The wood core 30 is sized to accommodate for the thickness ($T^2$) of the facing wood veneer 50. In an embodiment of the outdoor wood decking board 10 the facing wood veneer 50 includes a thickness ($T^2$) of about ⅛ inch. In another embodiment, the facing wood veneer 50 includes a thickness ($T^2$) of about 1/10 inch. Yet in another embodiment, the facing wood veneer 50 includes a thickness ($T^2$) of about 1/16 inch.

Figure 3C:
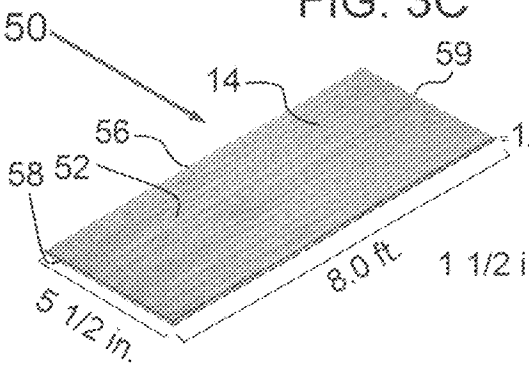
FIG. 3C is a top perspective view of a facing wood veneer of the outdoor wood decking board, according to an embodiment of the disclosure.
Figure 3D:
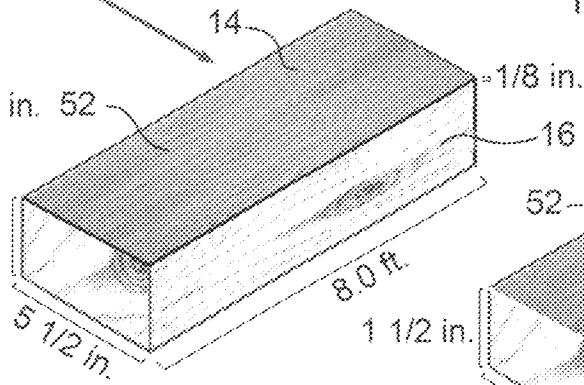
FIG. 3D is a top perspective view of a facing wood veneered wood core, according to an embodiment of the disclosure.

As shown in FIGS. 1, 2C, and 3C, the facing wood veneer 50 is configured including the thickness ($T^2$) of about ⅛ inch, the width ($W^1$) of about 5½ inches, and the length ($L^1$) of about 8.00 feet, and can be configured at the range of 8.00-20.00 feet inclusive thereof. Prior to the seamless permanent attachment of the facing wood veneer 50 to the wood core 30 the wood core 30 is sized via the planer or moulder to the thickness ($T^5$) of about 1¾ inches to accommodate for the thickness of the facing wood veneer 50 having a thickness ($T^2$) of about ⅛ inch, as shown in FIGS. 2B and 3B.

Accordingly, in the embodiment of the outdoor wood decking board 10 including the facing wood veneer 50 having a thickness ($T^2$) of about 1/10 inch, the wood core 30 is sized to the thickness ($T^5$) of about 1⅖ inches. Accordingly, in the embodiment of the outdoor wood decking board 10 including the facing wood veneer 50 having a thickness ($T^2$) of about 1/16 inch, the wood core 30 is sized to the thickness ($T^5$) of about 1 7/16 inch.

In another embodiment, the thickness of the facing wood veneer 50 can be ⅛ inch+/−1/16 inch and thereby the thickness of the wood veneer 50 can include a range of about 1/16-3/16 inch and, compatibly, the wood core 30 shall be sized accordingly to accommodate the thickness of the facing wood veneer 50 so that the final thickness of the outdoor wood decking board 10 is 1½ inches thick.

Figure 3E:
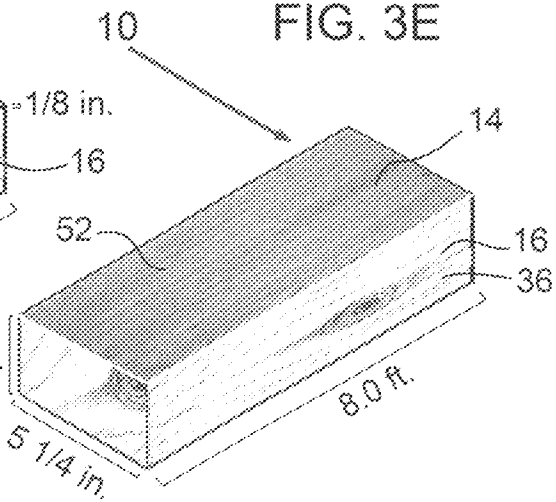
FIG. 3E is a top perspective view of the outdoor wood decking board, according to an embodiment of the disclosure.

Referring to FIGS. 3A-3E, showing the wood core 30 is a tight knot western red cedar 16 wood core 30 and the facing wood veneer 50 is a clear vertical grain western red cedar 14 facing wood veneer 50 embodied in the formation of the outdoor wood decking board 10 in FIG. 3E. As shown in FIG. 3D, the facing wood veneer 50 seamlessly permanently directly attached to the wood core 30 via the pressure sensitive liquid adhesive applied to the first wood face 32 of the wood core 30 through an adhesive spreading machine, and pressed against the second wood finishing face 54 of the facing wood veneer 50 through an automated hydraulic press under heat and pressure such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive to form a facing wood veneered wood core 20, as shown in FIG. 3D. In another embodiment, the adhesive is a two-part EPI adhesive. In another embodiment, the adhesive is a two-part PEP adhesive.

More particularly, FIG. 3D, shows a clear vertical grain western red cedar 14 facing wood veneered tight knot western red cedar 16 wood core 30, shown at 20 configured including the thickness ($T^1$) of about 1½ inches, the width ($W^1$) of about 5½ inches, and the length ($L^1$) of about 8.00 feet, but not limited to. The length of the wood core 30 and the facing wood veneer 50 and consequentially the outdoor wood decking board 10 can be configured including a length ($L^1$) of about 8.00 feet, and can be configured including a range of 8.00-20.00 feet inclusive.

Subsequently, the facing wood veneered wood core 20, more particularly, the clear vertical clear vertical grain western red cedar 14 veneered tight knot western red cedar 16 wood core 20 is sized via the planer or moulder to form the outdoor wood decking board 10, as shown in FIGS. 1 and 3E, including the thickness ($T^1$) of about 1½ inches, a width ($W^2$) of about 5¼ inches, and the length ($L^1$) of about 8.00-20.00 feet inclusive thereof. The length of the outdoor wood decking board 10 can be customized to the desired dimensions of the builder, consumer or user.

In another embodiment of the disclosure, the outdoor wood decking board 30 and the facing wood veneer 50 can be configured with another set of dimensions to form an outdoor wood decking board 10 including a narrower width (W). FIGS. 4A-4E shows the wood core 30 and the facing wood veneer 50 embodied in the formation of the outdoor wood decking board 10 as shown in FIG. 4E, More particularly, FIGS. 4A-4B shows the wood core 30 being the tight knot western red cedar 16 wood core 30 and the clear vertical grain western red cedar 14 facing wood veneer 50 embodied in the formation of the outdoor wood decking board 10 as shown in FIG. 3E for use in construction of an outdoor deck floor 100.

Referring to FIGS. 4A-4E, showing the wood core 30 is a tight knot western red cedar 16 wood core 30 and the facing wood veneer 50 is a clear vertical grain western red cedar 14 embodied in the formation of the outdoor wood decking board 10 in FIG. 4E. In this exemplary embodiment, the wood core 30, as shown in FIG. 4A, is configured including the thickness ($T^1$) of about 1½ inches, a width ($W^3$) of about 3½ inches, and the length (L) of about 8.00 feet but not limited to. The wood core 30 is formed from the first wood species WP1 including the tight knot western red cedar 16.

Subsequently, the wood core 30 or more particularly, the tight knot western red cedar 16, is sized via a planer or moulder to a configuration including the thickness ($T^5$) of about 1⅜ inches, a width ($W^2$) of about 3½ inches, and the length ($L^1$) of about 8.00 feet, but not limited to, as shown in FIG. 4B to accommodate the thickness ($T^2$) of the facing wood veneer 50, more particularly, the clear vertical grain western red cedar 14 facing wood veneer, having a thickness of about ⅛ inch. The wood core 30 is sized to accommodate for the thickness ($T^2$) of the facing wood veneer 50.

As shown in FIG. 4C, the facing wood veneer 50 is formed from the wood species selected from the second wood species WP2, the clear vertical grain western red cedar 14, as shown in FIG. 4C, configured including the thickness ($T^2$) of about ⅛ inch, the width ($W^3$) of about 3½ inches, and the length ($L^1$) of about 8.00 feet, but not limited to.

In another embodiment, the facing wood veneer 50, more particularly, the clear vertical grain western red cedar 14 facing wood veneer can be configured having a thickness ($T^2$) of about 1/10 inch. in the embodiment of the outdoor wood decking board 10 including the facing wood veneer 50 having a thickness ($T^2$) of about 1/10 inch, the wood core 30 is sized to the thickness ($T^5$) of about 1⅖ inches.

In another embodiment, the facing wood veneer 50, more particularly, the clear vertical grain western red cedar 14 facing wood veneer 50 can be configured having a thickness ($T^2$) of about 1/16 inch in the embodiment of the outdoor wood decking board 10 including the facing wood veneer 50 having a thickness ($T^2$) of about 1/16 inch, the wood core 30 is sized to the thickness ($T^5$) of about 1 7/16 inch.

Prior to the seamless permanent attachment of the facing wood veneer 50 to the wood core 30, by means of the two-part emulsion polymer-isocyanate adhesive, more particularly, the tight knot western red cedar 16 wood core 30 is sized via the planer or moulder from the thickness ($T^1$) of about 1½ inches to a thickness ($T^5$) of about 1⅜ inches, as shown in FIG. 4B, to accommodate the thickness ($T^2$) of the facing wood veneer 50, more particularly, the clear vertical grain western red cedar 14 facing wood veneer 50, having a thickness of about ⅛ inch, in the exemplary embodiment.

In another embodiment, the adhesive utilized is the two-part polyurethane emulsion polymer adhesive to seamlessly permanently directly attach the facing wood veneer 50 to the wood core 30.

As shown in FIG. 4C, the facing wood veneer 50, more particularly, the clear vertical grain western red cedar 14 veneered tight knot western red cedar 16 wood core 20 is shown including the thickness ($T^1$) of about 1½ inches, the width ($W^3$) of 3½ inches, and the length ($L^1$) of about 8.00 feet, but not limited to.

FIG. 4D shows the facing wood veneer 50 seamlessly permanently directly attached to the wood core 30 via the two-part emulsion polymer-isocyanate adhesive. As shown in FIG. 4D, the facing wood veneer 50, more particularly, the clear vertical grain western red cedar 14 facing wood veneer 50 is seamlessly permanently directly attached to the tight knot western red cedar 16 wood core 30 via the two-part emulsion polymer-isocyanate adhesive applied to the entire first wood face 32 of the wood core 30 through an adhesive spreading machine, and the second wood finishing face 54 of the clear vertical grain western red cedar 14 facing wood veneer 50 pressed against the first wood face 32 of the wood core 30 through an automated hydraulic press under heat and pressure to form a facing wood veneered wood core 20, such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive, more particularly, a clear vertical grain western red cedar 14 veneered tight knot western red cedar 16 wood core 20 as shown in FIG. 4D. More particularly, FIG. 4D, shows a clear vertical grain western red cedar 14 veneered tight knot western red cedar 16 wood core 20, configured including the thickness ($T^1$) of about 1½ inches, the width ($W^3$) of about 3½ inches, and the length ($L^1$) of about 8.00 feet, but not limited to. The length ($L^1$) of the wood core 30 and the facing wood veneer 50 and consequentially the outdoor wood decking board 10 can be configured including a length ($L^1$) of about 8.00 feet, and can be configured including a range of 8.00-20.00 feet inclusive.

Subsequently, the facing wood veneered wood core 20, more particularly, the clear vertical grain western red cedar 14 veneered tight knot western red cedar 16 wood core 20 is sized via the planer or moulder to form an outdoor wood decking board 10, as shown in FIG. 4E, including a configuration including the thickness ($T^1$) of about 1½ inches, a width ($W^4$) of about 3¼ inches, and the length ($L^1$) of about 8.00 feet but not limited to.

Accordingly, in the embodiment of the outdoor wood decking board 10 including the facing wood veneer 50 having a thickness ($T^2$) of about 1/10 inch, the wood core 30 is sized to the thickness ($T^5$) of about 1⅖ inches.

Accordingly, in the embodiment of the outdoor wood decking board 10 including the facing wood veneer 50 having a thickness ($T^2$) of about 1/16 inch, the wood core 30 is sized to the thickness ($T^5$) of about 1 7/16 inch.

Figure 5A:
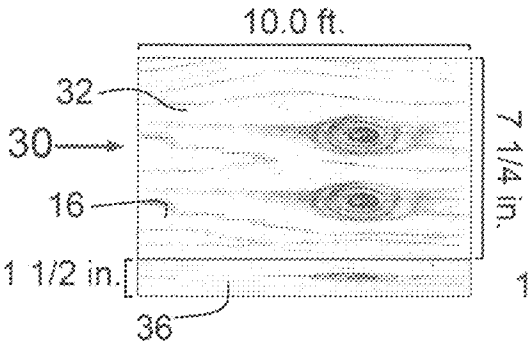
FIG. 5A is a top perspective view of a wood core of an outdoor wood decking board, according to an embodiment of the disclosure.
Figure 5B:
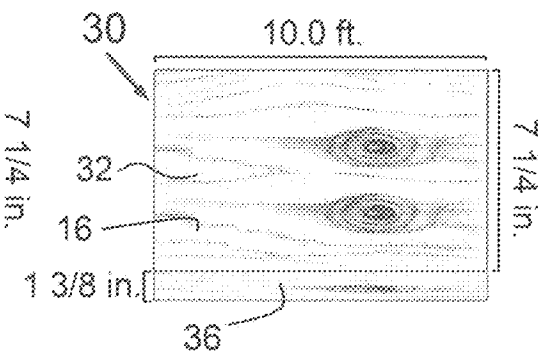
FIG. 5B is a top perspective view of the wood core of FIG. 5A illustrating sizing of the wood core of FIG. 5A, according to an embodiment of the disclosure.
Figure 5C:
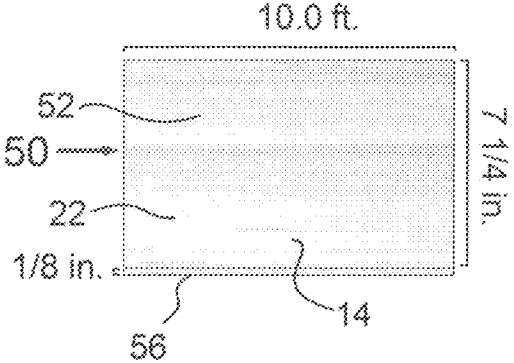
FIG. 5C is a top perspective view of a facing wood veneer of the outdoor wood decking board, according to an embodiment of the disclosure.
Figure 5D:
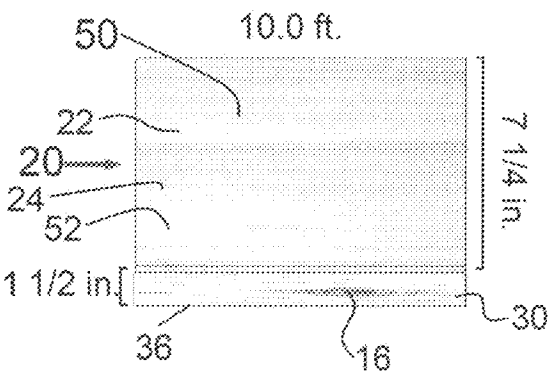
FIG. 5D is a top perspective view of a facing wood veneered wood core of the outdoor wood decking board, according to an embodiment of the disclosure.
Figure 5E:
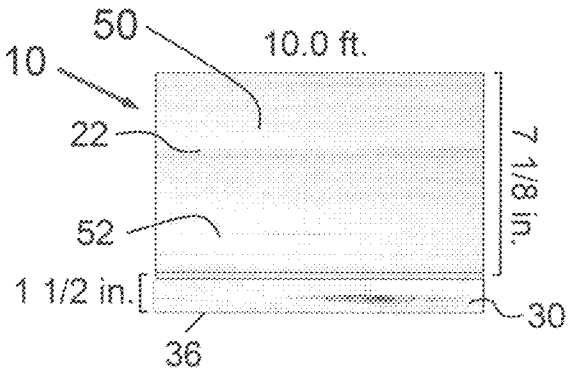
FIG. 5E is a top perspective view of the outdoor wood core, according to an embodiment of the disclosure.

In another embodiment of the disclosure, as shown in FIGS. 5A-5F the outdoor wood decking board 10 for use in construction of an outdoor deck floor 100 includes a wood core 30 and a facing wood veneer 50 of the outdoor wood decking board 10 shown in FIG. 5E, embodied, in yet, another dimension. The wood core 30, as shown in FIG. 5A is formed from the first wood species WP1 including a tight knot western red cedar 16 species. The wood core 30, more particularly, the tight knot western red cedar 16 wood core 30 is configured including the thickness ($T^1$) of about 1½ inches, a width ($W^5$) of about 7¼ inches, and the length ($L^1$) of about 10.00 feet, but not limited to. Subsequently, as shown in FIG. 5B, the wood core 30, more particularly, the tight knot western red cedar 16 wood core 30 is sized via the planer or moulder to a configuration including the thickness ($T^5$) of about 1⅜ inches, the width ($W^5$) of about 7¼ inches, and the length ($L^1$) of about 10.00 feet but not limited to, to accommodate the thickness ($T^2$) of the facing wood veneer 50 having a thickness of about ⅛ inch.

In another embodiment, the facing wood veneer 50 is configured having a thickness ($T^2$) of about 1/10 inch. In another embodiment, the facing wood veneer is configured having a thickness ($T^2$) of about 1/16 inch.

The facing wood veneer 50, as shown in FIG. 5C, is formed from the second wood species WP2, including the Alaskan Yellow Cedar 22. The facing wood veneer 50, more particularly, the Alaskan Yellow Cedar 22 facing wood veneer 50 is configured including the thickness ($T^2$) of about ⅛ inch, the width ($W^5$) of about 7¼ inches, and the length ($L^1$) of about 10.00 feet, but not limited to. The facing wood veneer 50, more particularly, the Alaskan Yellow Cedar 22 facing wood veneer 50 is seamlessly permanently directly attached via the pressure sensitive adhesive through the adhesive spreading machine, and pressed though the automated hydraulic press under heat and pressure to form the facing wood veneered wood core 20, such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive, more particularly, an Alaskan Yellow Cedar 22 veneered tight knot western red cedar 16 wood core 30, as shown in FIG. 5D configured including the thickness ($T^1$) of about 1½ inches, the width ($W^5$) of about 7¼ inches, and the length of about 10.00 feet, but not limited to.

In another embodiment, the facing wood veneer 50, more particularly, the Alaskan Yellow Cedar 22 facing wood veneer 50 is seamlessly permanently attached to the wood core 30 utilizing the two-part EPI adhesive.

In another embodiment, the facing wood veneer 50, more particularly, the Alaskan Yellow Cedar 22 facing wood veneer 50 is seamlessly permanently directly attached to the wood core 30 utilizing the two-part PEP adhesive such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive.

Figure 5F:
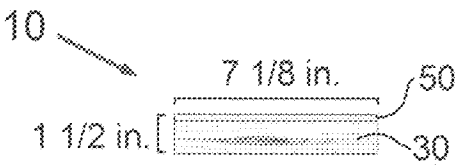
FIG. 5F is a side planar view of the outdoor wood core of FIG. 5E, according to an embodiment of the disclosure.

Subsequently, the facing wood veneered wood core 20, more particularly the Alaskan Yellow Cedar 22 veneered tight knot western red cedar 16 wood core 30 is sized via the planer or moulder to form an outdoor wood decking board 10, as shown in FIGS. 5E and 5F including a configuration including the thickness ($T^1$) of about 1½ inches, a width ($W^6$) of about 7⅛ inches, and the length ($L^1$) of about 10.0 feet but not limited to.

In another embodiment of the disclosure, as shown in FIGS. 6A-6F, the outdoor wood decking board 10, for use in construction of an outdoor deck floor 100 includes a wood core 30 formed from the first wood species WP1 including a tight knot western red cedar 16 species. The wood core 30, more particularly, the tight knot western red cedar 16 wood core 30 is configured including a thickness ($T^4$) of about 1⅛ inches, the width ($W^1$) of about 5½ inches, and the length ($L^1$) of about 10.0 feet but not limited to. The wood core 30, more particularly, the tight knot western red cedar 16 wood core, as shown in FIG. 6B, is sized via the planer or moulder to a configuration including a thickness ($T^6$) of about 1.0 inch, the width ($W^1$) of about 5½ inches, and a length ($L^1$) of about 10.00 feet. The tight knot western red cedar 16 wood core 30 is sized to accommodate for the thickness ($T^2$) of the Alaskan Yellow Cedar 22 facing wood veneer 50 having a thickness of about ⅛ inch. The Alaskan Yellow Cedar 22 facing wood veneer 50 can be configured including a thickness ($T^2$) including a range of about 1/16-3/16 inch.

In another embodiment, the facing wood veneer 50, formed from any one of the second wood species WP2, or formed from any one of the third wood species WP3, is configured to the thickness ($T^2$) of about 1/10 inch. Accordingly, in the embodiment of the outdoor wood decking board 10 including the facing wood veneer 50 having a thickness ($T^2$) of about 1/10 inch, the wood core 30 is sized to the thickness ($T^5$) of about 1⅖ inches.

In another embodiment, the facing wood veneer 50, formed from a wood species selected from any one of the second wood species WP 2, or formed from a wood species selected from any one of the third wood species WP3, is configured to the thickness ($T^2$) of about 1/16 inch. Accordingly, in the embodiment of the outdoor wood decking board 10 including the facing wood veneer 50 having a thickness ($T^2$) of about 1/16 inch, the wood core 30 is sized to the thickness ($T^5$) of about 1 7/16 inch.

The facing wood veneer 50, as shown in FIG. 6C is formed from a superior grade, a clear grade, selected from the second wood species WP2 including the Alaskan Yellow Cedar 22. The facing wood veneer 50, more particularly, the Alaskan Yellow Cedar 22 facing wood veneer 50 is configured including the thickness ($T^2$) of about ⅛ inch, the width ($W^1$) of about 5½ inches, and the length ($L^1$) of about 10.0 feet. The Alaskan Yellow Cedar 22 facing wood veneer 50 is seamlessly permanently directly attached to the tight knot western red cedar 16 wood core via the two-part emulsion polymer-isocyanate adhesive through the adhesive spreading machine, and pressed through the automated hydraulic press under heat and pressure such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive to form a facing wood veneered wood core 20, more particularly, an Alaskan Yellow Cedar 22 tight knot western red cedar 16 wood core 30.

In another embodiment, the adhesive can be the two-part polyurethane emulsion polymer.

In the exemplary embodiment, wood core 30 can be formed from a common grade or general purpose grade of reclaimed the tight knot western red cedar 16 of the facing wood veneer 50 can be formed from reclaimed Alaskan Yellow Cedar 22.

Thereby, the facing wood veneered wood core 20, more particularly, the Alaskan Yellow Cedar 22 veneered tight knot western red cedar 16 wood core 30, as shown in FIG. 6D is configured including the thickness ($T^4$) of about 1⅛ inches, the width ($W^1$) of about 5½ inches, and the length ($L^1$) of about 10.00 feet.

Subsequently, as shown in FIG. 6E, the Alaskan Yellow Cedar 22 veneered tight knot western red cedar 16 wood core 30 of the embodiment is sized via the planer or moulder to form the outdoor wood decking board 10 as shown in FIGS. 6E and 6F of the exemplary embodiment, which is sized to a configuration including the thickness ($T^4$) of about 1⅛ inches, the width ($W^2$) of about 5¼ inches, and the length ($L^1$) of about 10.00 feet, but not limited to.

Figure 7A:
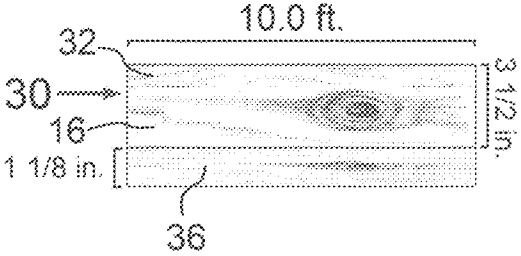
FIG. 7A is a top perspective view of a wood core of an outdoor wood decking board, according to an embodiment of the disclosure.

As shown in FIG. 7A-7F, in another embodiment of the disclosure, the outdoor wood decking board 10 for use in construction of an outdoor deck floor 100 includes a wood core 30 of another configured dimension. The wood core 30, as shown in FIG. 7A, is formed from the first wood species WP1 including a tight knot western red cedar 16. The wood core 30 can be formed of any one of the first wood species WP1 and not include a tight knot or knotty feature. The wood core 30, more particularly, is configured including a thickness ($T^4$) of about 1⅛ inches, the width ($W^3$) of about 3½ inches, and the length ($L^1$) of about 10.00 feet but not limited to.

Figure 7B:
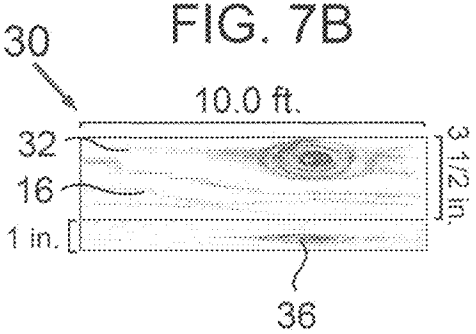
FIG. 7B is a top perspective view of the wood core of FIG. 7A illustrating sizing of the wood core of FIG. 7A, according to an embodiment of the disclosure.

The wood core 30, as shown in FIG. 7B, is sized via the planer or moulder to a configuration including a thickness ($T^6$) of about 1.00 inch, the width ($W^3$) of about 3½ inches, and the length ($L^1$) of about 10.00 feet to accommodate for the thickness ($T^2$) of the facing wood veneer 50 having a thickness ($T^2$) of about ⅛ inch. The wood core 30 is formed from the tight knot western red cedar selected from the first wood species WP1.

Figure 7C:
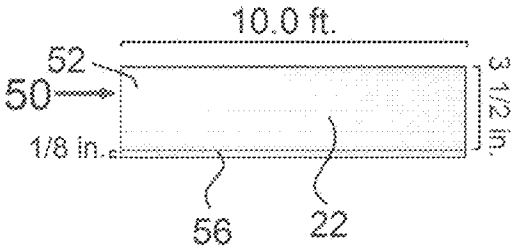
FIG. 7C is a top perspective view of a facing wood veneer of the wood decking board, according to an embodiment of the disclosure.
Figure 7D:
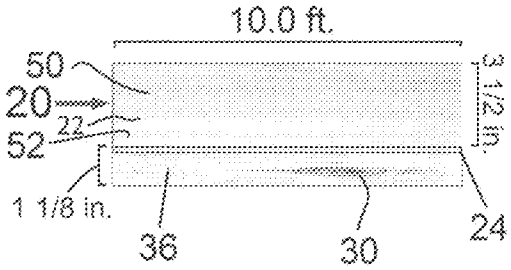
FIG. 7D is a top perspective view of a facing wood veneered wood core, according to an embodiment of the disclosure.

As shown, in FIG. 7C, the facing wood veneer 50 is configured including the thickness ($T^2$) of about ⅛ inch, the width ($W^3$) of about 3½ inches, and the length ($L^1$) of about 10.00 feet, but not limited to. The facing wood veneer 50 of Alaskan Yellow Cedar 22 is seamlessly permanently directly attached to the wood core of tight knot western red cedar 16 via the adhesive, the two-part emulsion polymer-isocyanate to form an Alaskan Yellow Cedar 22 veneered tight knot western red cedar 16 wood core 30, at 20 as shown in FIG. 7D such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive. The Alaskan Yellow Cedar 22 veneered tight knot western red cedar 16 wood core 30 at 20 is configured including a thickness ($T^4$) of about 1⅛ inches, a width ($W^3$) of about 3½ inches, and the length ($L^1$) of about 10.00 feet but not limited to.

In another embodiment, the adhesive is the two-part EPI. In another embodiment, the adhesive is the two-part PEP.

In another embodiment, the facing wood veneer 50, formed from any one of the second wood species WP 2, or formed from any one of the third wood species WP3, is configured to the thickness ($T^2$) of about 1/10 inch. In another embodiment, the facing wood veneer 50, formed from a wood species selected from any one of the second wood species WP 2, or formed from a wood species selected from any one of the third wood species WP3, is configured to the thickness ($T^2$) of about 1/16 inch.

Figure 7E:
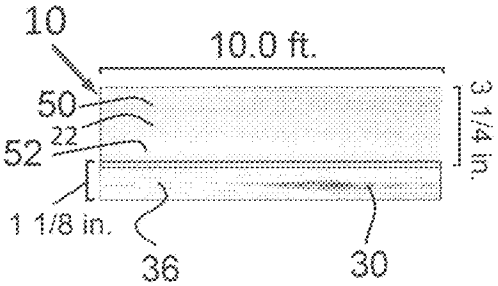
FIG. 7E is a top perspective view of the outdoor wood decking board, according to an embodiment of the disclosure.
Figure 7F:
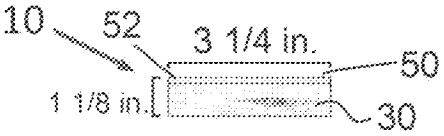
FIG. 7F is a side planar view of the facing wood veneered wood core of FIG. 7E, according to an embodiment of the disclosure.

Subsequently, as shown in FIGS. 7D and 7E, the Alaskan Yellow Cedar 22 veneered tight knot western red cedar 16 wood core 30 is sized via the planer or moulder to form the outdoor wood decking board 10 shown in FIGS. 7E and 7F including the thickness ($T^4$) of about 1⅛ inches, a width ($W^4$) of about 3½ inches, and the length ($L^1$) of about 8.00-20.00 feet inclusive and having an Alaskan Yellow Cedar 22 facing wood veneer 50 at 24.

The wood core 30 and the facing wood veneer 50 in implementation of the embodiment of the disclosure can be formed in a variety of lengths for use in the formation of the outdoor wood decking board 10 for use in the construction of the outdoor deck floor 100. In particular, the length ($L^1$) of the wood core 30 and the length ($L^1$) of the facing wood veneer 50 can be selected from the group comprising of 8.00 feet, 10.00 feet, 12.00 feet, 14.00 feet, 16.00 feet, 18.00 feet, and 20.00 feet.

The outdoor wood decking board 10 in the implementation of the embodiment of the disclosure for use of the outdoor wood decking board 10 for use in construction of an outdoor deck floor 100 can include a wood core 30 and a facing wood veneer 50 formed in a variety of lengths. In particular, the length ($L^1$) of the wood core and the length ($L^1$) of the facing wood veneer can be selected from the group comprising including the length ($L^1$) of 9.00 feet, 11.00 feet, 13.00 feet, 15.00 feet, 17.00 feet, and 19.00 feet.

To exemplify the variety of outdoor wood decking boards 10 embodied within the subject matter of the disclosure, FIGS. 8A-8E shows an outdoor wood decking board 10 including the wood core 30 is manufactured from a tight knot western red cedar 16 species, and the facing wood veneer 50 is manufactured from a wood species selected form the third wood species WP3, namely, an Ipe (*Handroanthus* species) 26.

In another embodiment, the facing wood veneer 50 can be formed from reclaimed Ipe 26.

Figure 8C:
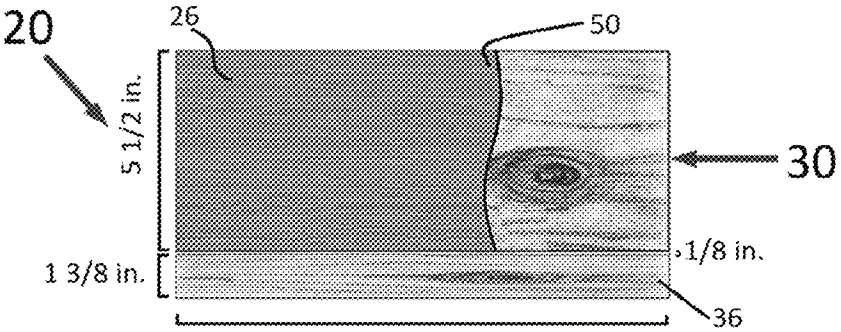
FIG. 8C is a top perspective view of a facing wood veneered wood core of the outdoor wood decking board showing a sized wood core of FIG. 8A layered beneath the facing wood veneer of FIG. 8B, according to an embodiment of the disclosure.
Figure 8D:
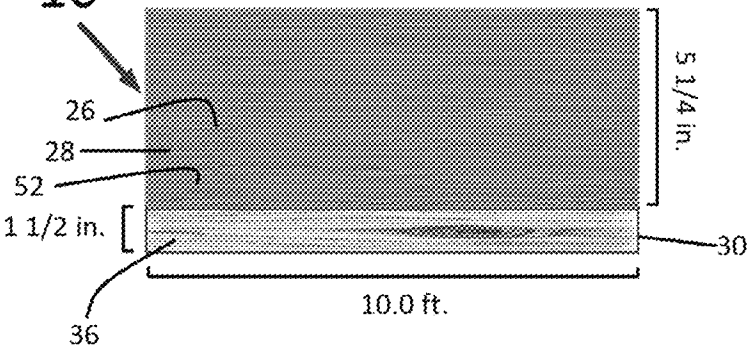
FIG. 8D is a top perspective view of the outdoor wood decking board, according to an embodiment of the disclosure.
Figure 8E:
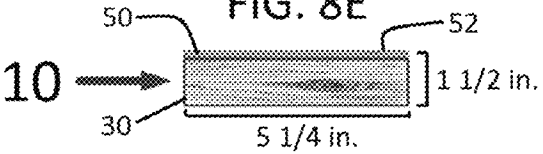
FIG. 8E is a side planar view of the outdoor wood decking board of FIG. 8D, according to an embodiment of the disclosure.
Figure 8A:
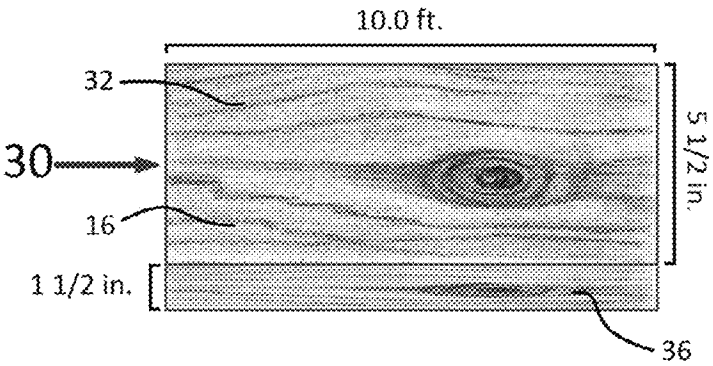
FIG. 8A is a top perspective view of a wood core of an outdoor wood decking board, according to an embodiment of the disclosure.

FIG. 8A shows the wood core 30 manufactured with a tight knot western red cedar 16. The wood core 30 is formed from a first wood species WP1, as a three-dimensional solid rigid wood body including a thickness ($T^1$), a width ($W^1$), and a length ($L^1$). The wood core 30, more particularly, the tight knot western red cedar 16 wood core 30 includes a first wood face 32, a second wood face 34 opposed to the first wood face 32, and dual opposite longitudinal wood side edges 36, the dual opposite longitudinal wood side edges 36 including interior longitudinal side edges $\mathbf{36}^1$ and exterior longitudinal side edges $\mathbf{36}^2$. The wood core 30 includes a longitudinal axis (LA). The wood core 30 is sized via a planar or a moulder to a configuration including a thickness of ($T^5$) which is equal to (($T^1$)−($T^2$)). In the exemplary embodiment ($T^2$) is about ⅛ inch).

As shown in FIG. 8C, the wood core 30 is sized to the thickness of ($T^5$) to account for the thickness of the facing wood veneer 50 upon the permanent attachment of the facing wood veneer 50 to the wood core 30, wherein the facing wood veneer 50 includes a thickness ($T^2$) of about ⅛ inch. As shown in FIG. 8C the wood core 30, more particularly, the clear vertical grain wood core 30 is sized configured including a thickness ($T^5$) of about 1⅜ inches, a width ($W^1$) of about 5½ inches, and the length (L) of about 10.00 feet but not limited to.

In another embodiment, the facing wood veneer 50, formed from any one of the second wood species WP 2, or formed from any one of the third wood species WP3, is configured to the thickness ($T^2$) of about 1/10 inch. Accordingly, in the embodiment of the outdoor wood decking board 10 including the facing wood veneer 50 having a thickness ($T^2$) of about 1/10 inch, the wood core 30 is sized to the thickness ($T^5$) of about 1⅖ inches.

In yet another embodiment, the facing wood veneer 50, formed from a wood species selected from any one of the second wood species WP 2, or formed from a wood species selected from any one of the third wood species WP3, is configured to the thickness ($T^2$) of about 1/16 inch. Accordingly, in the embodiment of the outdoor wood decking board 10 including the facing wood veneer 50 having a thickness ($T^2$) of about 1/16 inch, the wood core 30 is sized to the thickness ($T^5$) of about 1 7/16 inch.

Figure 8B:
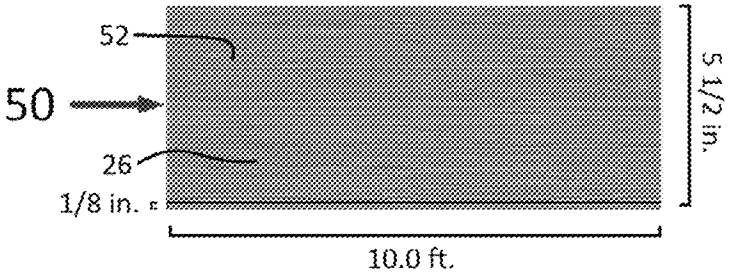
FIG. 8B is a top perspective view of a facing wood veneer, according to an embodiment of the disclosure.

Referring to FIG. 8B, the facing wood veneer 50, is formed from the third wood species WP3, selected from the exotic hardwood species is the Ipe (*Handroanthus* species) 26, characterized as being free of cracks, holes, cavities or knots as a three-dimensional solid rigid finishing layer including a thickness ($T^2$), the thickness ($T^2$) being less than the core thickness ($T^1$), the width ($W^1$), and the length ($L^1$). FIG. 8D, shows the outdoor wood decking board 10 and the effectiveness of a facing wood veneer 50 manufactured from a superior quality grade wood species including the Ipe (*Handroanthus* species) 26, species. More particularly, FIG. 8B shows the Ipe 26 facing wood veneer 50 characterized as being free of cracks, holes, cavities or knots including a thickness ($T^2$) of about ⅛ inch, a width ($W^1$) of about 5½ inches, and a length ($L^1$) of about 10.00 feet but not limited to.

Referring to FIG. 8B, the facing wood veneer 50, more particularly, the Ipe 26 facing wood veneer 50 characterized as being free of cracks, holes, cavities or knots includes a first wood finishing face 52, a second wood finishing face 54 opposed to the first finishing face 52, and dual opposing longitudinal facing wood veneer side edges 56, the dual opposing longitudinal facing wood veneer side edges 56 including interior longitudinal facing wood veneer side edges $\mathbf{56}^1$ and exterior longitudinal facing wood veneer side edges $\mathbf{56}^2$. The facing wood veneer 50 includes a longitudinal axis ($LA^2$).

The facing wood veneer 50 is manufactured from the third wood species WP3, as mentioned, the Ipe (*Handroanthus* species) 26 characterized as being free of cracks, holes, cavities or knots. The wood core 30 formed of the first wood species WP1 including the common quality grade of the first wood species WP1, the tight knot western red cedar 16, the tight knot western red cedar 16 wood core 30, thereby, as shown in FIG. 8C is layered with the Ipe 26 facing wood veneer 50. The Ipe 26 facing wood veneer 50 at 20 is seamlessly permanently directly attached to the wood core 30 via the adhesive, the two-part emulsion polymer-isocyanate adhesive 120 through the adhesive spreading machine, and pressed through the automated hydraulic press under heat and pressure to form a facing wood veneered wood core 20, such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive, more particularly, an Ipe 26 veneered tight knot western red cedar 16 wood core, as shown in FIG. 8C. Thereby, the Ipe 26 veneered tight knot western red cedar 16 wood core 30 is configured including the thickness ($T^1$) of about 1½ inches, a width ($W^1$) of about 5½ inches, and the length ($L^1$) of about 10.00 feet, but not limited to.

In another embodiment, the adhesive is the two-part polyurethane emulsion polymer adhesive.

Subsequently, the Ipe 26 veneered tight knot western red cedar 16 wood core 30 is sized to form an outdoor wood decking board 10, as shown in FIGS. 8D and 8E configured to include a thickness ($T^1$) of about 1½ inches, the width ($W^2$) of about 5¼ inches, and the length ($L^1$) of about 10.00 feet but not limited to.

Figures 9A, 9B, 9C, 9D, 9E:
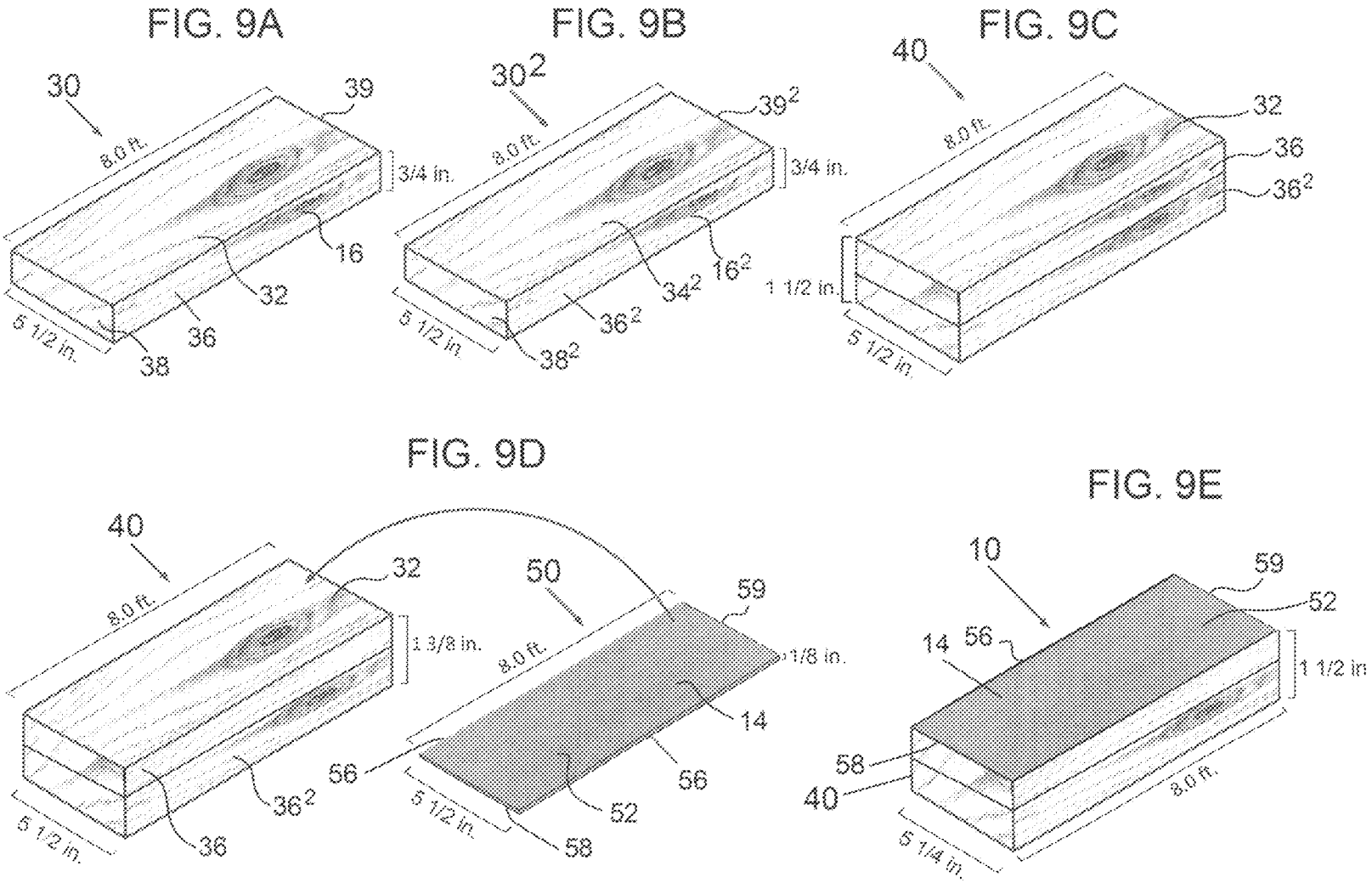
FIG. 9A is a top perspective view of a first wood core of an outdoor wood decking board, according to an embodiment of the disclosure.
FIG. 9B is a top perspective view of a second wood core of the outdoor wood decking board, according to an embodiment of the disclosure.
FIG. 9C is a top perspective view of a face-to-face wood core of the outdoor wood decking board, according to an embodiment of the disclosure.
FIG. 9D is a schematic illustration of a facing wood veneer being overlayed onto the face-to-face wood core of FIG. 9C, according to an embodiment of the disclosure.
FIG. 9E is a top perspective view of the outdoor wood decking board, according to an embodiment of the disclosure.

In another embodiment of the disclosure, FIGS. 9A-9E, depicts an embodiment of an outdoor wood decking board 10 for use in the construction of an outdoor deck floor 100. The outdoor wood decking board 10 embodied for use in construction of the outdoor deck floor 100 comprises a first wood core 30, as shown in FIG. 9A, and a second wood core 30$^2$, as shown in FIG. 9B is seamlessly permanently directly attached to each other by means of an adhesive, the pressure sensitive liquid adhesive 120 to form a face-to-face wood core 40, as shown in FIG. 9C.

In another embodiment, the adhesive can be the two-part EPI adhesive. In another embodiment, the adhesive can be the two-part PEP adhesive.

The first wood core 30 and the second wood core 30$^2$ each are formed from the first wood species WP1. The first wood species WP1 is preselected from any one of a North American Softwood species including, generally, a general purpose or common grade, including a knotty or quality knotty grades, or non-knotty grade, of western red cedar species. The North American Softwood species that are implemented in the exemplary embodiment of the disclosure includes the first wood species WP1 of the first wood core 30 and the second wood core 30$^2$ which is formed from any one of a common grade or general purpose grade of North American Softwood species selected from the group consisting of Western Red-Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow-Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

Referring again to FIGS. 9A-9E, the first wood core 30 and the second wood core 30$^2$ are each formed from a tight knot western red cedar 16, thereby forming a first tight knot western red cedar 16 first wood core 30, and a second tight knot western red cedar 16 second wood core 30$^2$.

In another embodiment of the disclosure, the wood core 30 is formed from any one of the North American Softwood species that are of common grade or general purpose grade that do not include a distinct tight knot. In another embodiment of the disclosure, the wood core 30 is formed from any one of the first wood species WP1 of North American Softwood species that are common grade or general purpose grade of reclaimed wood selected from the North American Softwood species.

The first wood core 30, as shown in FIG. 9A, is formed from a first wood species WP1, more particularly, a tight knot western red cedar 16, as a three-dimensional solid rigid wood body configured including a thickness ($T^3$) of about ¾ inch, a width ($W^1$) of about 5½ inches, and a length ($L^1$) of about 8.00 feet. The first wood core 30 includes a first wood face$^1$ 32, a second wood face$^1$ 34 opposed to the first wood face$^1$ 32, and dual opposite longitudinal wood side edges' 36.

The second wood core 30$^2$, as shown in FIG. 9B is formed from the tight knot western red cedar 16 species as a second three-dimensional solid rigid wood body configured including the thickness ($T^3$) of about ¾ inch, the width ($W^1$) of about 5½ inches, and the length (L) of about 8.00 feet. The second wood core 30$^2$ includes a first wood face$^2$ 32$^2$, a second wood face' 34$^2$ opposed to the first wood face$^2$ 32$^2$, and dual opposite longitudinal wood side edges$^2$ 36$^2$. The adhesive, the pressure sensitive liquid adhesive 120 is applied to the second wood face$^2$ 34$^2$ of the second wood core 30$^2$ and the second wood face$^1$ 34 of the first wood core 30 via an adhesive spreading machine enabling and operable for providing a seamless permanent attachment of the first wood core 30 to the second wood core 30$^2$ forming a face-to-face wood core 40, as shown in FIG. 9C. More particularly, a tight knot western red cedar 16 face-to-face wood core 40 is formed, as shown in FIG. 9C. The face-to-face wood core 40, more particularly, the tight knot western red cedar 16 face-to-face wood core 40, includes a thickness ($T^1$) of about 1½ inches, the width ($W^1$) of about 5½ inches, and the length ($L^1$) of about 8.00 feet, when the first wood core 30 and the second wood core 30$^2$ are pressed against each other in an automated hydraulic press under heat and pressure. The face-to-face wood core 40 includes a longitudinal axis ($LA^3$).

Subsequently, the face-to-face wood core 40, more particularly, the tight knot western red cedar 16 face-to-face wood core 40, as shown in FIG. 9C is sized via a planer or moulder to a thickness of ($T^5$) 1⅜ inches, such that ($T^5$) is (($T^1$)−($T^2$)), (⅛ inch less than ($T^1$), as shown in the face-to-face wood core 40 formed in FIG. 9D. The face-to-face wood core 40 is sized to the thickness ($T^5$) to account for the thickness ($T^2$) of the facing wood veneer 50 prior to the permanent attachment of the facing wood veneer 50 to the face-to-face wood core 40, wherein the facing wood veneer 50 includes the thickness of ($T^1$) of about ⅛ inch. Implementing this feature, provides consistency in providing a facing wood veneered face-to-face wood core 40 configured with a consistent thickness ($T^1$) of about 1½ inches.

In another embodiment, the facing wood veneer 50, formed from any one of the second wood species WP 2, or formed from any one of the third wood species WP3, is configured to the thickness ($T^2$) of about 1/10 inch. Accordingly, in the embodiment of the outdoor wood decking board 10 including the facing wood veneer 50 having a thickness ($T^2$) of about 1/10 inch, the wood core 30 is sized to the thickness ($T^5$) of about 1⅖ inches.

In yet another embodiment, the facing wood veneer 50, formed from a wood species selected from any one of the second wood species WP 2, or formed from a wood species selected from any one of the third wood species WP3, is configured to the thickness ($T^2$) of about 1/16 inch. Accordingly, in the embodiment of the outdoor wood decking board 10 including the facing wood veneer 50 having a thickness ($T^2$) of about 1/16 inch, the wood core 30 is sized to the thickness ($T^5$) of about 1 7/16 inches.

As shown in FIG. 9D, the facing wood veneer 50 is formed from a second wood species WP2 as a three dimensional solid rigid wood finishing layer including a thickness ($T^2$), the thickness ($T^2$) being about ⅛ inch, the width ($W^1$), and the length ($L^1$), the facing wood veneer 50 including a first wood finishing face 52, a second wood finishing face 54 opposed to the first wood finishing face 52, and dual opposing longitudinal facing wood veneer side edges 56, wherein the second wood species WP2 is a superior grade of wood species. The second wood species WP2 is any one of a superior grade North American Softwood species. In the exemplary embodiment, the facing wood veneer 50 is formed from a clear vertical grain western red cedar 14 species.

In any of the many embodiments of the disclosure, the second wood species WP2 of the facing wood veneer 50 is formed from one of a superior grade North American Softwood species selected from the group consisting of clear grain Western Red-Cedar (*Thuja plicata*), (*Thuja occidentalis*), clear grain Douglas Fir (*Pseudotsuga menziesii*), clear grain Western Larch (*Larix occidentalis*), clear grain Alpine Larch (*Larix lyallii*), clear grain Alaskan Yellow Cedar (*Chamaecyparis nootkatensis*), clear grain Hemlock (*Tsuga heterophylla*), clear grain Port of Oxford Cedar (*Chamaecyparis lawsoniana*), clear vertical grain Redwood (*Sequoia sempervirens*), and clear grain Pine/Spruce (*Pinus* species, *Picea* species).

In addition, in any one of the embodiments of the disclosure, the facing wood veneer 50 utilized to seamlessly permanently directly attach to the face-to-face wood core 40 can be selected from the third wood species of exotic hardwoods, wherein the third wood species WP3 the exotic hardwood species is selected from the group consisting of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bullet wood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibaurtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

In another embodiment of the disclosure, the facing wood veneer 50 is formed from any one of the North American Softwood species that are of superior grade or clear grain, or clear vertical grain, of the first wood species WP1 of North American Softwood species. In another embodiment of the disclosure, the facing wood veneer 50 is formed from any one of the first wood species WP1 of North American Softwood species that are superior grade or clear grain, or clear vertical grain, of reclaimed wood selected from the North American Softwood species.

As shown in FIG. 9D, a facing wood veneer 50 formed from a superior quality grade of a second wood species WP2, namely, a clear vertical grain western red cedar 14 is seamlessly permanently directly attached to a first wood face$^1$ 32 of the first wood core 30 of the face-to-face wood core 40 by means of the two-part emulsion polymer-isocyanate adhesive so that a first wood finishing face 52 of the facing wood veneer 50 is displayed to the viewer such that the first finishing face of the facing wood veneer of the facing wood veneered face-to-face wood core is visible to a user wherein the first finishing face of the facing wood veneer is visibly free of adhesive such that the first finishing face of the facing wood veneer of the facing wood veneered face-to-face wood core is visibly unchanged or visibly unaltered by the adhesive.

In another embodiment of the disclosure, the adhesive utilized to seamlessly permanently directly attach the first wood core 30 to the second wood core 30$^2$ to form the face-to-face wood core 40 is the two-part polyurethane emulsion adhesive. The adhesive, the two-part emulsion polymer-isocyanate adhesive is applied to the first wood face$^1$ 32 of the first wood core 30 of the face-to-face wood core 40 via the adhesive spreading machine enabling and operable for providing a seamless permanent attachment of the second wood finishing face 54 of the facing wood veneer 50 against the first wood face$^1$ 32 of the first wood core 30 of the face-to-face wood core 40 forming a facing wood veneered face-to-face wood core 40, more particularly, a clear vertical grain western red cedar superior grade or clear grain, or clear vertical grain 11 veneered tight knot western red cedar 16 face-to-face wood core 40, as shown in FIG. 9D, such that the first finishing face 52 of the facing wood veneer 50 including the clear vertical grain western red cedar 14 is displayed to a viewer such that the first finishing face of the facing wood veneer of the facing wood veneered face-to-face wood core is visible to a user wherein the first finishing face of the facing wood veneer is visibly free of adhesive such that the first finishing face of the facing wood veneer of the facing wood veneered face-to-face wood core is visibly unchanged or visibly unaltered by the adhesive. The clear vertical grain western red cedar 14 veneered tight knot western red cedar 16 face-to-face wood core 40 includes a thickness ($T^1$) 1½ inches, a width ($W^1$) of about 5½ inches, a length ($L^1$) of about 8.00 feet.

Subsequently, as shown in FIG. 9E, the clear vertical grain western red cedar 14 veneered tight knot western red cedar 16 face-to-face wood core 40 is sized via a planer or moulder to form an outdoor wood decking board 10, as shown in FIG. 9E having a thickness ($T^1$) of about 1½ inches, a width ($W^2$) of about 5/14 inches, and the length ($L^1$) of about 8.00 feet, but not limited to.

In this manner, a plurality of outdoor wood decking boards 10 adapted to be arranged along interior longitudinal side edges 56$^1$ of each other form an assembled simulated non-cactile clear vertical grain western red cedar 14 outdoor deck floor 100 characterized as being free of cracks, holes, cavities or knots of pre-configured dimensions.

As mentioned above, the clear vertical grain western red cedar 14 veneered tight knot western red cedar 16 face-to-face wood core 40 is sized via the planer or moulder to a configuration including the thickness ($T^1$) of about 1½ inches, a width ($W^2$) of about 5¼ inches wherein the width ($W^2$) is ¼ inch less than width ($W^1$) of about 5½ inches, and the length ($L^1$) of about 8.00 feet. By means of sizing the clear vertical grain western red cedar 14 veneered tight knot western red cedar 16 face-to-face wood core 40 via the planer or moulder a consistency is established in the dimensions of the outdoor wood decking board 10 that is formed such that the outdoor wood decking board 10, as shown in FIG. 9E is sized to the consistent thickness ($T^1$) of about 1½ inches, a width ($W^2$) of about 5¼ inches, and a length ($L^1$) of about 8.00 feet, but not limited to. The outdoor wood decking boards 10 can be configured including a length at a range of about 8.00-20.00 feet inclusive.

According to the exemplary embodiment of the outdoor wood decking board 10 including the first wood core 30 and the second wood $\mathbf{30}^2$ seamlessly permanently directly attached to each other via the two-part emulsion polymer-isocyanate adhesive forming the face-to-face wood core 40 the first wood core 30 and the second wood core $\mathbf{30}^2$ can be embodied including a variety of configurations.

Referring again to FIG. 9E, in an embodiment of the outdoor wood decking board 10 including the face-to-face wood core 40, as shown in FIG. 9C, the face-to-face wood core 40 is configured forming a face-to-face wood core 40 including the first wood core 30, as shown in FIG. 9A and the second wood core $\mathbf{30}^2$, as shown in FIG. 9B. The first wood core 30 and the second wood core $\mathbf{30}^2$ is formed from the tight knot western red cedar 16. The first wood core 30 is configured including the thickness ($T^3$) of about ¾ inch, the width ($W^1$) of about 5½ inches, and the length ($L^1$) of about 8.0-20.0 feet. Equally, the second wood core $\mathbf{30}^2$ is configured including the thickness ($T^3$) of about ¾ inch, the width ($W^1$) of about 5½ inches, and the length ($L^1$) of about 8.00-20.00 feet. Consequentially, the face-to-face wood core 40 is configured including a thickness ($T^1$) of about 1½ inches, the width ($W^1$) of about 5½ inches, and the length ($L^1$) of about 8.00 feet, but not limited to.

Subsequently, the face-to-face wood core 40 is sized via the planer or moulder to the thickness of ($T^5$) of about 1⅜ inches thereby providing for an allotment of the facing wood veneer 50 which is configured including the thickness ($T^2$) of about ⅛ inch, and, correspondingly, the width ($W^2$) of about 5½ inches, and the length ($L^1$) of about 8.00 feet, but not limited to. The facing wood veneer 50 is formed from the clear vertical grain western red cedar 14. Thereby, the facing wood veneered face-to-face wood core 40, more particularly, the clear vertical grain western red cedar 14 veneered tight knot western red cedar 16 face-to-face wood core 40, a product of FIG. 9D, is configured with the thickness ($T^1$) of about 1½ inches, the width ($W^1$) of about 5½ inches, and the length ($L^1$) of about 8.00 feet, but not limited to.

Subsequently, the clear vertical grain western red cedar 14 veneered tight knot western red cedar 16 face-to-face wood core 40 is sized via the planer or moulder to form the outdoor wood decking board 10, as shown in FIG. 9E, including the thickness ($T^1$) of about 1½ inches, the width ($W^2$) of about 5¼ inches, and the length ($L^1$) of about 8.0 feet, but not limited to.

In the exemplary embodiment, as shown in FIGS. 9A-9E, the first wood core 30 can be configured including the thickness ($T^3$) of about ¾ inch, the width ($W^1$) of about 5½ inches, and the length ($L^1$) of about 8.00 feet, but not limited to. Equally, the second wood core $\mathbf{30}^2$ can be configured including the thickness ($T^3$) of about ¾ inch, the width ($W^1$) of about 5½ inches, and the length ($L^1$) of about 8.00 feet. Subsequently, the face-to-face wood core 40 is sized via a planer or moulder to the thickness of $T^5$ of about 1⅜ inches.

The facing wood veneer 50 is configured including the thickness ($T^2$) of about ⅛ inch, the width ($W^2$) of about 5½ inches, and the length ($L^1$) of about 8.00 feet, but not limited to, and thereby, the facing wood veneered face-to-face wood core 40 is configured with the thickness ($T^1$) of about 1½ inches, the width ($W^1$) of about 5½ inches, and the length ($L^1$) of about 8.00 feet but not limited to.

Subsequently, the facing wood veneered face-to-face wood core 40 is sized via the planer or moulder to the thickness ($T^1$) of about 1½ inches, the width ($W^2$) of about 5¼ inches, and the length ($L^1$) of about 8.00 feet but not limited to.

Figure 10A:
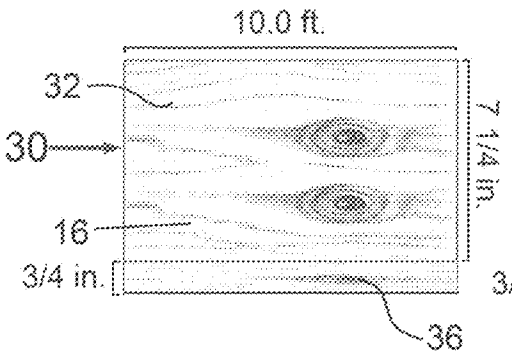
FIG. 10A is a top perspective view of a first wood core of an outdoor wood decking board, according to an embodiment of the disclosure.
Figure 10B:
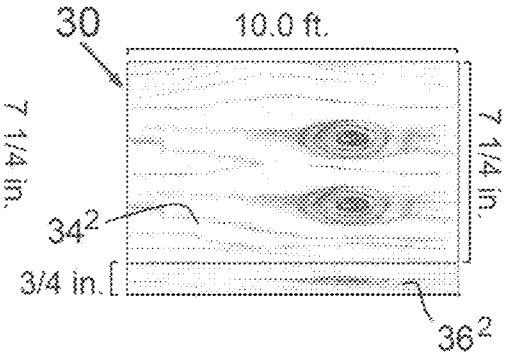
FIG. 10B is a top perspective view of a second wood core of the outdoor wood decking board, according to an embodiment of the disclosure.
Figure 10C:
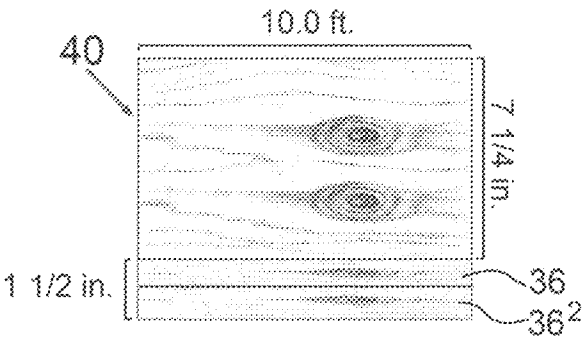
FIG. 10C is a top perspective view of a face-to-face wood core of the outdoor wood decking board, according to an embodiment of the disclosure.

In another embodiment of the outdoor wood decking board 10 including the face-to-face wood core 40. as described in detail above, as shown in FIGS. 10A-10F, the face-to-face wood core 40 is configured forming a face-to-face wood core 40, as shown in FIG. 10C, including the first wood core 30, as shown in FIG. 10A, and the second wood core $\mathbf{30}^2$, as shown in FIG. 10B. The first wood core 30 and the second wood core $\mathbf{30}^2$ are each formed from a tight knot western red cedar 16, selected from the first wood species WP1, as listed above. The first wood core 30 is configured including the thickness ($T^3$) of about ¾ inch, a width ($W^5$) of about 7¼ inches, and the length ($L^1$) of about 10.00 feet but not limited to. Equally, the second wood core $\mathbf{30}^2$, as shown in FIG. 10B, is configured including the thickness ($T^3$) of about ¾ inch, the width ($W^5$) of about 7¼ inches, and the length ($L^1$) of about 10.00 feet but not limited to. Consequentially, the face-to-face wood core 40 is configured including the thickness ($T^1$) of about 1½ inches, the width ($W^5$) of about inches, and the length ($L^1$) of about 10.00 feet.

Figure 10D:
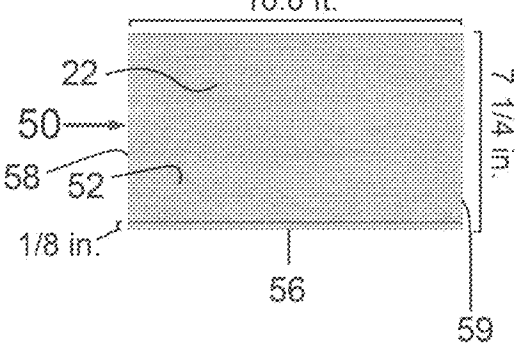
FIG. 10D is a top perspective view of a facing wood veneer of the outdoor wood decking board, according to an embodiment of the disclosure.
Figure 10E:
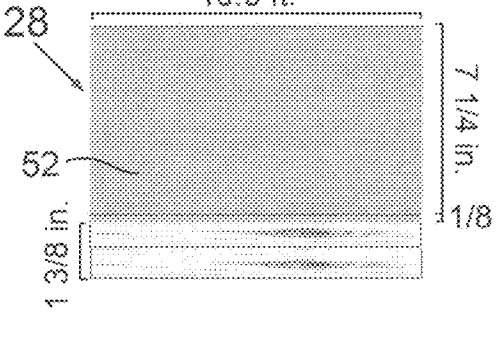
FIG. 10E is a top perspective view of a facing wood veneered face-to-face wood core, according to an embodiment of the disclosure.

Subsequently, the face-to-face wood core 40 is sized via the planer or moulder to the thickness of ($T^5$) of about 1⅜ inches, as shown in FIG. 10E, thereby providing for an allotment of the facing wood veneer 50, as shown in FIG. 10D. The facing wood veneer 50 is formed from an exotic hardwood characterized as being free of cracks, holes, cavities or knots, an IPE (*Handroanthus* species) 26 selected from the third wood species WP3 of exotic hardwood species, as listed above.

In another embodiment, the facing wood veneer 50, formed from any one of the second wood species WP2, or formed from any one of the third wood species WP3, is configured to the thickness ($T^2$) of about 1/10 inch. Accordingly, in the embodiment of the outdoor wood decking board 10 including the facing wood veneer 50 having a thickness ($T^2$) of about 1/10 inch, the wood core 30 is sized to the thickness ($T^5$) of about 1⅖ inches.

In yet another embodiment, the facing wood veneer 50, the exotic hardwood facing wood veneer 50 characterized as being free of cracks, holes, cavities or knots, selected from the third wood species WP3 more particularly, the IPE 26 facing wood veneer 50 formed is configured to the thickness ($T^2$) of about 1/16 inch. Accordingly, in the embodiment of the outdoor wood decking board 10 including the exotic hardwood facing wood veneer 50, more particularly the IPE 26 hardwood facing wood veneer 50 characterized as being free of cracks, holes, cavities or knots having a thickness ($T^2$) of about 1/16 inch, the wood core 30 is sized to the thickness ($T^5$) of about 1 7/16 inches.

The facing wood veneer 50 which is configured including the thickness ($T^2$) of about ⅛ inch, and correspondingly, the width ($W^5$) of about 7¼ inches, and the length ($L^1$) of about 10.00 feet, and thereby, the facing wood veneered face to face wood core 90, more particularly, an IPE 26 veneered tight knot western red cedar 16 face-to-face wood core 40, is configured with the thickness ($T^1$) of about 1½ inches, the width ($W^5$) of about 7¼ inches, and the length ($L^1$) of about 10.00 feet but not limited to.

Figure 10F:
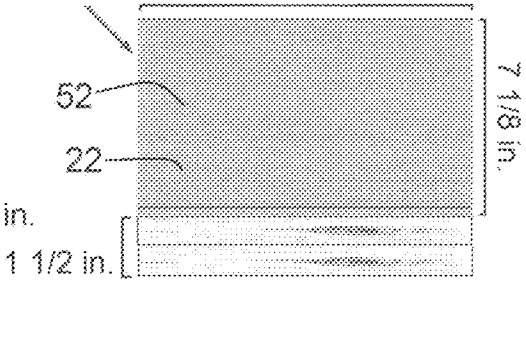
FIG. 10F is a top perspective view of the outdoor wood decking board, according to an embodiment of the disclosure.

Subsequently, the facing wood veneered face-to-face wood core 90, more particularly, the Ipe 26 veneered tight knot western red cedar 16 face-to-face wood core 40, is sized via the planer or moulder to form the outdoor wood decking board 10, as shown in FIG. 10F, including the thickness ($T^1$) of about 1½ inches, a width ($W^6$) of about 7⅛ inches, and the length ($L^1$) of about 10.00 feet but not limited to. In the exemplary embodiment, the outdoor wood decking board 10 is shown with a length ($L^1$) of about 10.00 feet, but not limited to.

In an embodiment of the disclosure, the facing wood veneered face-to-face wood core 90, and in this embodiment, the IPE 26 facing wood veneered tight knot western red cedar 16 face-to-face wood core 40, is treated with one or more aqueous compositions comprising one or more agents, an agent of the one or more agents selected from the group consisting of biocides, wood strength enhancers, fungicides, bactericides, insecticides water repellants, UV blockers, fire retardants, and wood hardeners. In the exemplary embodiment, the Ipe 26 veneered tight knot western red cedar 16 face-to-face wood core 40 is treated with one or more of the aqueous compositions, selected from the group consisting of biocides, wood strength enhancers, fungicides, bactericides, insecticides water repellants, UV blockers, fire retardants, and wood hardeners.

In another embodiment of the outdoor wood decking board 10 including the face-to-face wood core 40, as shown in FIGS. 11A-11G, the face-to-face wood core 40, as shown more particularly in FIG. 11C-11D, is configured forming a face-to-face wood core 40. The face-to-face wood core 40 includes a first wood core 30 as shown in FIG. 11A, and a second wood core $\mathbf{30}^2$, as shown in FIG. 11B, In the exemplary embodiment, the first wood core 30 and the second wood core $\mathbf{30}^2$ are each formed from a wood species selected from first wood species WP1, particularly, the tight knot western red cedar 16 selected from the first wood species WP1.

In another embodiment of the disclosure the tight knot western red cedar 16 is reclaimed tight knot western red cedar.

The first wood core 30, as shown in FIG. 11A, is configured including the thickness ($T^3$) of about ¾ inch, a width ($W^3$) of about 3½ inches, and the length ($L^1$) of about 8.00 feet, but not limited to. Equally, the second wood core $\mathbf{30}^2$, as shown in FIG. 11B, is configured including the thickness ($T^3$) of about ¾ inch, the width ($W^3$) of about 3 inches, and the length ($L^1$) of about 8.00 feet, but not limited to.

FIGS. 11A-11G depicts an embodiment of an outdoor wood decking board 10 for use in the construction of an outdoor deck floor 100. The outdoor wood decking board 10, as shown in FIG. 11G, embodied for use in construction of the outdoor deck floor 100 comprises a first wood core 30, as shown in FIG. 11A, and a second wood core $\mathbf{30}^2$, as shown in FIG. 11B, is seamlessly permanently directly attached to each other by means of the adhesive, the pressure sensitive adhesive to form a face-to-face wood core 40. A facing wood veneer 50 formed from a superior grade of a second wood species WP2 is seamlessly permanently attached to a first wood face 32 of the first wood core 30 of the face-to-face wood core 40 by means of the pressure sensitive liquid adhesive 120 through the adhesive spreading machine, and pressed through the automated hydraulic press under heat and pressure. The first wood finishing face 52 of the facing wood veneer 50 is displayed to the viewer.

In another embodiment, the adhesive utilized to seamlessly permanently directly attach the first wood core 30 to the second wood core $\mathbf{30}^2$ is the two-part EPI adhesive.

In another embodiment, the adhesive utilized to seamlessly permanently directly attach the first wood core 30 to the second wood core $\mathbf{30}^2$ is the two-part PEP adhesive.

The first wood core 30 is formed from a first wood species WP1 as a three-dimensional solid rigid wood body configured including a thickness ($T^3$) of about ¾ inch, a width ($W^1$) of about 5½ inches, and a length ($L^1$) of about 8.00 feet but not limited to. The first wood core 30 includes a first wood face$^1$ 32, a second wood face$^1$ 34 opposed to the first wood face$^1$ 32, and dual opposite longitudinal wood side edges$^1$ 36. The first wood core 30 is formed from the first wood species WP1 which is a tight knot western red cedar 16 species.

The second wood core $\mathbf{30}^2$, as shown in FIG. 11B, is formed from the tight knot western red cedar 16 species as a second three-dimensional solid rigid wood body configured including the thickness ($T^3$) of about ¾ inch, the width ($W^1$) of about 5½ inches, and the length ($L^1$) of about 8.00 feet. The second wood core $\mathbf{30}^2$ includes a first wood face$^2$ $\mathbf{32}^2$, a second wood face$^2$ $\mathbf{34}^2$ opposed to the first wood face$^2$ $\mathbf{32}^2$, and dual opposite longitudinal wood side edges$^2$ $\mathbf{36}^2$. The pressure sensitive liquid adhesive 120 is applied to the second wood face$^2$ $\mathbf{34}^2$ of the second wood core $\mathbf{30}^2$ and the second wood face$^1$ 34 of the first wood core 30 via an adhesive spreading machine enabling and operable for providing a seamless permanent attachment of the first wood core 30 to the second wood core $\mathbf{30}^2$ forming the face-to-face wood core 40, as shown in FIG. 11C. The face-to-face wood core 40 includes a thickness ($T^1$) of about 1½ inches when the first wood core 30 and the second wood core $\mathbf{30}^2$ are pressed against each other in an automated hydraulic press under heat and pressure. The face-to-face wood core 40 includes a longitudinal axis ($LA^3$).

Subsequently, the face-to-face wood core 40, as shown in FIG. 11C is sized via a planer or moulder to a thickness of ($T^5$) 1⅜ inches, such that ($T^5$) is ⅛ inch less than ($T^1$), as shown in the face-to-face wood core 40 formed in FIG. 11C. The face-to-face wood core 40 is sized to the thickness ($T^5$) to account for the thickness ($T^2$) of the facing wood veneer 50 prior to the permanent attachment of the facing wood veneer 50 to the face-to-face wood core 40, wherein the facing wood veneer 50 includes the thickness of ($T^1$) of about ⅛ inch. Implementing this feature, provides consistency in providing a facing wood veneered face-to-face wood core 40 configured with a consistent thickness ($T^1$) of about 1½ inches.

The first wood core 30 and the second wood core $\mathbf{30}^2$ each are formed from the first wood species WP1. The first wood species WP1 is preselected from any one of a North American Softwood species including, generally, a general purpose or common grade, including a tight knot grade, or knotty grades, or non-knot grades of western red cedar species. In the exemplary embodiment of the disclosure, a tight knot grade of the first wood species WP1 is implemented, as listed above. The North American Softwood species that are implemented in the exemplary embodiment of the disclosure includes the first wood species WP1 of the first wood core 30 and the second wood core $\mathbf{30}^2$ which is formed from any one of a common grade or general purpose grade of North American Softwood species selected from the group comprising of Western Red-Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

FIGS. 11A-11D, 11F and 11G, shows the first wood core 30 and the second wood core $\mathbf{30}^2$ are each formed from a tight knot western red cedar 16.

As shown in FIG. 11E, the facing wood veneer 50 is formed from a superior grade second wood species WP2, as listed above, as a three dimensional solid rigid wood finishing layer including a thickness ($T^2$), the thickness ($T^2$) being about ⅛ inch, the width ($W^1$), and the length ($L^1$), the facing wood veneer 50 including a first wood finishing face 52, a second wood finishing face 54 opposed to the first wood finishing face 52, and dual opposing longitudinal facing wood veneer side edges 56, wherein the second wood species WP2 is a superior grade of wood species. The second wood species WP2 is any one of a superior grade North American Softwood species. In the exemplary embodiment, the facing wood veneer 50 is formed from an Alaskan Yellow Cedar 22 species.

In any of the many embodiments of the disclosure, the second wood species WP2 of the facing wood veneer 50 is formed from one of a superior grade North American Softwood species selected from the group comprising of Western Red-Cedar (*Thuja plicata*), (*Thuja occidentalis*), Douglas Fir (*Pseudotsuga menziesii*), Western Larch (*Larix occidentalis*), Alpine Larch (*Lasix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In another embodiment of the outdoor wood decking board 10 for use in construction of an outdoor deck floor 100, the facing wood veneer 50 characterized as being free of cracks, holes, cavities or knots is formed from a third wood species WP3 of an exotic hardwood species, the exotic hardwood species selected from the group comprising of the exotic hardwood species selected from the group consisting of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

The pressure sensitive liquid adhesive 120 is applied to the first wood face 32 of the first wood core 30 of the face-to-face wood core 40 via the adhesive spreading machine enabling and operable for providing a seamless permanent attachment of the second wood finishing face 54 of the facing wood veneer 50 against the first wood face 32 of the first wood core 30 of the face-to-face wood core 40 forming an Alaskan Yellow Cedar 22 veneered tight knot western red cedar 16 face-to-face wood core 40, as shown in FIG. 11F, such that the first finishing face 52 of the facing wood veneer 50 including the Alaskan Yellow Cedar 22 is displayed to a viewer.

In another embodiment, the adhesive utilized to seamlessly permanently directly attach the Alaskan Yellow Cedar facing wood veneer 50 to the tight knot western red cedar 16 wood core is the two-part EPI adhesive.

In another embodiment, the adhesive utilized to seamlessly permanently directly attach the Alaskan Yellow Cedar facing wood veneer 50 to the tight knot western red cedar 16 wood core is the two-part PEP.

The facing wood veneered face-to-face wood core 90, more particularly, the Alaskan Yellow Cedar 26 veneered tight knot western red cedar 16 face-to-face wood core 40, as shown in FIG. 11F having a thickness ($T^1$) 1½ inches, a width ($W^1$) of about 3½ inches, a length ($L^1$) of about 8.0 feet, but not limited to. The Alaskan Yellow Cedar 26 veneered tight knot western red cedar 16 face-to-face wood core 40 is sized via a planer or moulder to form the outdoor wood decking board 10, as shown in FIG. 11G, having a thickness ($T^1$) of about 1½ inches, a width ($W^2$) of about 5/14 inches, and the length ($L^1$) of about 8.0 feet, but not limited to.

In this manner, a plurality of outdoor wood decking boards 10 adapted to be arranged along interior longitudinal side edges $\mathbf{56}^1$ of each other form an assembled simulated non-cactile Alaskan Yellow Cedar 26 species outdoor deck floor 100 characterized as being free of cracks, holes, cavities or knots of pre-configured dimensions.

In another embodiment, the thickness of the facing wood veneer 50 can be 1/16-3/16 inch and thereby the wood core 30 is to be sized accordingly to accommodate the thickness of the facing wood veneer 50 so that the final thickness of the outdoor wood decking board 10 is 1½ inches thick.

In another embodiment of the disclosure, the facing wood veneer 50 is configured with the thickness ($T^2$) of about 1/10 inch. In yet another embodiment, the facing wood veneer is configured with the thickness ($T^2$) of about 1/16 inch. Accordingly, the wood core 30 is sized configured at $(T)=((T^1)-(1/10 \text{ inch}))$ such that the wood core 30 is sized to a thickness ($T^5$) of about 1⅖ inches. And accordingly, the wood core 30 is sized configured at $(T^5)=((T^1)-(1/16 \text{ inch}))$ such that the wood core 30 is sized including a thickness ($T^5$) of about 1 7/16 inches.

In another embodiment of the outdoor wood decking board 10, the outdoor wood decking board 10 includes a first finishing wood veneer 50 and a second finishing wood veneer $\mathbf{50}^2$, as shown in FIGS. 12A-12D and FIGS. 13A-13D. The outdoor wood decking board 10 includes a wood core 30, as shown in FIGS. 12A and 13A, formed from a first wood species WP1 as a three-dimensional solid rigid wood body including a thickness ($T^1$) of about 1½ inch, a width ($W^1$) of about 5½ inches, and a length ($L^1$) of about 8.00-20.00 feet inclusive, but not limited to. The length ($L^1$) of the wood core 30 can be configured including the length ($L^1$) of about 8-20.0 feet inclusive. The wood core 30 includes a first wood face 32, and a second face 34, the second face 34 opposed to the first wood face 32, and dual opposite longitudinal side edges 36. The wood core includes a first end 38 and a second end 39.

In the exemplary embodiment, as shown in FIG. 12A, the wood core 30 is formed from a first wood species WP1 of common grade or general purpose grade of North American Softwood species selected from the group consisting of Western Red-Cedar (*Thuja plicata*), (*Thuja occidentalis*), Douglas Fir (*Pseudotsuga menziesii*), Western Larch (*Larix*

*occidentalis*), Alpine Larch (*Lasix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In the exemplary embodiment, the wood core 30, as shown in FIG. 12A is a tight knot Douglas Fir 80. The wood core 30 is dried to a moisture content suitable for receiving an adhesive 106. In one embodiment, the adhesive 106 is two-part emulsion polymer-isocyanate adhesive. In another embodiment, the adhesive 106 is a two-part polyurethane emulsion polymer. Yet in another embodiment, the adhesive 106 is a pressure sensitive liquid adhesive 120.

The wood core 30 can be formed from a Douglas Fir 80 species, as exemplified in FIG. 12A-12D and more clearly shown in FIG. 12A. In another embodiment, the wood core 30 can be formed from any one of a general purpose or common grade of North American Softwood species selected from the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

Subsequently, the wood core 30 is sized via a planer or a moulder to a thickness ($T^7$) of about 1¼ inches, as shown in FIG. 12B, thereby providing for an allotment of each of the first facing wood veneer 50 as shown in FIGS. 12A and 12B. The first facing wood veneer 50 which is configured including the thickness ($T^2$) of about ⅛ inch, and correspondingly, width ($W^1$) of about 5½ inches, and a length ($L^1$) of about 8.00-20.00 feet, inclusive. The length of the facing wood veneer 50 can be configured including the length of about 8.00-20.00 feet corresponding to the length ($L^1$) of the wood core 30. Equally, the second facing wood veneer 50$^2$ is configured including the thickness ($T^2$) of about ⅛ inch, and correspondingly, width ($W^1$) of about 5½ inches, and a length ($L^1$) of about 8.00-20.00 feet inclusive. The length of the second facing wood veneer 30$^2$ can be configured, equally at the range of 8.00-20.0 feet inclusive.

The first facing wood veneer 50 and the second facing wood veneer 50$^2$ can each be configured having the thickness ($T^2$) of about 1/10 inch. In another embodiment, the first facing wood veneer 50 and the second facing wood veneer 50$^2$ can each be configured including the thickness ($T^2$) of about 1/16 inch.

The first facing wood veneer 50 is formed from a third wood species WP3 as a three-dimensional solid rigid finishing wood layer including a thickness ($T^2$) of about ⅛ inch, the width ($W^1$) of about 5½ inches, and the length ($L^1$) of about 8.00-20.00 feet. The first facing wood veneer 50 includes a first finishing face$^1$ 52, and a second finishing face$^1$ 54, the second finishing face 54 opposed to the first finishing wood face$^1$ 52, and dual opposing longitudinal facing wood veneer side edges 56. The first facing wood veneer has a facing wood veneer first end 58 and a facing wood veneer second end 59.

The third wood species WP3 is an exotic hardwood species selected from the third wood species WP3, as listed above. In the exemplary embodiment, the first facing wood veneer 50 and the second facing wood veneer 50$^2$ are each formed from the same exotic hardwood species characterized as being free of cracks, holes, cavities or knots, Sapele (*Entandrophragma cylindricum*) 42. The first facing wood veneer 50 and the second facing wood veneer 50$^2$ characterized as being free of cracks, holes, cavities or knots are selected from an exotic hardwood species selected from the group comprising of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogany*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

In the exemplary embodiment, as shown in FIGS. 13A-13D, the first facing wood veneer 50 and the second facing wood veneer 50$^2$ characterized as being free of cracks, holes, cavities or knots are each formed of the exotic hardwood species such that the first facing wood veneer 50 is not the same as the second facing wood veneer 50$^2$. In another embodiment, the first facing wood veneer 50 is formed of a first exotic hardwood species and the second facing wood veneer 50$^2$ is formed of a second exotic hardwood species, wherein the first exotic hardwood species is not the same as the second exotic hardwood species.

Referring back to FIGS. 12A-12D, in the exemplary embodiment, the first facing wood veneer 50 is the exotic hardwood characterized as being free of cracks, holes, cavities or knots Sapele (*Entandrophragma cylindricum*) 42, and the second facing wood veneer 50$^2$ is formed from the exotic hardwood characterized as being free of cracks, holes, cavities or knots Sapele (*Entandrophragma cylindricum*) 42. The second facing wood veneer 50$^2$, is formed from the exotic hardwood species, Sapele (*Entandrophragma cylindricum*) 42, characterized as being free of cracks, holes, cavities or knots as a three-dimensional solid rigid wood finishing layer including the thickness ($T^2$) of about ⅛ inch, the width ($W^1$) of about 5½ inches, and the length ($L^1$) of about 8.00-20.00 feet inclusive. The Sapele (*Entandrophragma cylindricum*) 42 second facing wood veneer 50$^2$ includes a first wood finishing face$^2$ 52$^2$, a second wood finishing face$^2$ 54$^2$ opposed to the first wood finishing face$^2$ 52$^2$, and dual opposing longitudinal facing wood veneer side edges$^2$ 56$^2$. The second facing wood veneer 50$^2$ includes a facing wood veneer first end 58$^2$ and a facing wood veneer second end 59$^2$.

In another embodiment of the disclosure, the exotic hardwood characterized as being free of cracks, holes, cavities or knots, Sapele 42 facing wood veneer 50 is configured with the thickness ($T^2$) of about 1/10 inch. In yet another embodiment, the exotic hardwood, Sapele 42 facing wood veneer 50 is configured with the thickness ($T^2$) of about 1/16 inch. Accordingly, the wood core 30 is sized configured at ($T^5$)=(($T^1$)−(1/10 inch)) such that the wood core 30 is sized to a thickness ($T^5$) of about 1⅔ inches. And accordingly, the wood core 30 is sized configured at ($T^5$)=(($T^1$)−(1/16 inch)) such that the wood core 30 is sized including a thickness ($T^5$) of about 1 7/16 inches.

A two-part emulsion polymer-isocyanate adhesive is applied to the first wood face 32 of the wood core 30 via an adhesive spreading machine, and pressed through the automatic hydraulic press under heat and pressure, enabling and operable for providing a seamless permanent attachment of the second wood finishing face[1] 54 of the first facing wood veneer 50 against the first wood face 32 of the wood core 30 forming an upper veneered wood core 50[1], more particularly an upper exotic hardwood veneered wood core, namely, an upper Sapele 42 veneered Douglas Fir 80 wood core 30, such that the first wood finishing face[1] 52 of the first facing wood veneer 50 including the first exotic hardwood species, more particularly, Sapele 42, is displayed to the viewer, such that a plurality of outdoor wood decking boards 10 adapted to be arranged along interior longitudinal wood side edges 36[1] of each other form an upper assembled simulated non-cactile exotic hardwood deck floor 100, more particularly, an upper assembled simulate non-cactile Sapele 42, outdoor deck floor 100, characterized as being free of cracks, holes, cavities or knots formed of pre-configured dimensions. Similarly, the two-part emulsion polymer-isocyanate adhesive is applied via the adhesive spreading machine, and pressed through the hydraulic press under heat and pressure to the second wood face 34 of the wood core 30 enabling and operable for providing a seamless permanent attachment of the second wood finishing face[2] 54[2] of the second facing wood veneer 50[2] against the second wood face 34 of the wood core 30, forming a lower veneered wood core 50[2], or an exotic hardwood veneered wood core, more particularly, a lower Sapele 42 veneered Douglas Fir 80 wood core 30, such that the first wood finishing face[2] 52[2] of the second facing wood veneer 50[2] including the second exotic hardwood species formed of Sapele 42 forms a lower assembled simulated non-cactile exotic hardwood outdoor deck floor 100[2], more particularly a lower assembled simulated non-cactile Sapele 42 outdoor deck floor 100[2] of preconfigured dimensions and being displayed to the viewer from below the upper assembled simulated non-cactile exotic hardwood species outdoor deck floor 100, more particularly, the upper assembled simulated non-cactile Sapele 42, outdoor deck floor 100, formed of pre-configured dimensions.

In another embodiment, the adhesive utilized to seamlessly permanently directly attach the first facing veneer 50 and the second facing veneer 50[2], accordingly, to the wood core 30 is a pressure sensitive liquid adhesive.

In another embodiment, the adhesive utilized to seamlessly permanently directly attach the first facing veneer 50 and the second facing veneer 50[2], accordingly, to the wood core is the two-part PEP adhesive.

The wood core 30 including the dual facing wood veneered wood core 96 having the first facing wood veneer 50, and the second facing wood veneer 50[2] seamlessly permanently attached to the wood core 30, as described above, and shown in FIGS. 12B and 12C, includes the thickness ($T^1$) of about 1½ inches, a width ($W^1$) of about 5½ inches, and the length ($L^1$) of about 8.00-20.00 feet inclusive. Subsequently, the dual facing wood veneered wood core 96 is sized and configured to form an outdoor wood decking board 10, as shown in FIGS. 12C and 12D including the thickness ($T^1$) of about 1½ inches, a width ($W^2$) of about 5½ inches, and the length ($L^1$) of about 8.00-20.00 feet.

Implementing this novel feature, the dual facing wood veneered wood core 96 allows a user to display a first facing wood veneer 50 formed of the exotic hardwood Sapele 42 of the outdoor deck floor 100 showcasing a first aesthetic appearance complimentary to the surrounding natural environment of the outdoor deck floor 100 and consubstantially allows the user to display a second facing wood veneer 50[2] formed of the exotic hardwood Sapele 42 of the outdoor deck floor 100 to a viewer below the outdoor deck floor 100 showcasing a second aesthetic appearance complimentary to the surrounding environment, for example, in an outside room created by the disposition of the outdoor deck floor 100 devised as a ceiling formed of non-cactile Sapele (*Entandrophragma cylindricum*) 42 outdoor deck floor implemented as a ceiling to the outside room.

Represented in the exemplary embodiment, the first facing wood veneer 50 and the second facing wood veneer 50[2] characterized as being free of cracks, holes, cavities or knots can each be formed from any one of a superior grade of North American Softwood species selected from the group comprising of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In another embodiment, the first facing wood veneer 50 and the second facing wood veneer 50[2] can each be formed from the same genus species selected from the North American Softwood wood species. In the alternative, the first facing wood veneer 50 and the second facing wood veneer 50[2] can be formed from a different genus species selected from the North American Softwood wood species of the second wood species WP2, as listed above.

In another embodiment, the first facing wood veneer 50 and the second facing wood veneer 50[2] can each be formed from the same genus species selected from the exotic hardwood species. In the alternative, the first facing wood veneer 50 and the second facing wood veneer 50[2] can each be formed from a different genus species from each other selected from the exotic hardwood species of the third wood species WP3, as listed above.

With reference to FIGS. 13A-13D, a dual facing wood veneered wood core 96 is shown. In the exemplary embodiment, as shown in FIGS. 13A-13D, the first facing wood veneer 50 and the second facing wood veneer 50[2] characterized as being free of cracks, holes, cavities or knots are each formed of an exotic hardwood species of the third wood species WP3 that are not the same but different exotic hardwood species. In another embodiment, the first facing wood 50 veneer characterized as being free of cracks, holes, cavities or knots is formed of a first exotic hardwood species and the second facing wood veneer 50[2] characterized as being free of cracks, holes, cavities or knots is formed of a second exotic hardwood species, wherein the first exotic hardwood species is different from the second exotic hardwood species. In the exemplary embodiment, the first facing wood veneer 50 is Sapele 42, and the second facing wood veneer 50[2] is formed from Santos Mahogany 82.

As shown in FIGS. 13A and 13B, the second facing wood veneer characterized as being free of cracks, holes, cavities or knots 50[2], is formed from the exotic hardwood species, Santos Mahogany 82 as a three-dimensional solid rigid wood finishing layer including the thickness ($T^2$) of about ⅛ inch, the width ($W^1$) of about 5½ inches, and the length ($L^1$) of about 8.00-20.00 feet. The second facing wood veneer $50^2$, the Santos Mahogany 82 facing wood veneer 50 includes a first wood finishing face$^2$ $52^2$, a second wood finishing face$^2$ $54^2$ opposed to the first wood finishing face$^2$ $52^2$, and dual opposing longitudinal facing wood veneer side edges$^2$ $56^2$. The first facing wood veneer 50 has a facing wood veneer first end 58 and a facing wood veneer second end 59. The first wood finishing face $52^1$ includes a non-cactile finish characterized as being free of cracks, holes, cavities or knots. In another embodiment of the disclosure, the facing wood veneer 50 is configured with the thickness ($T^2$) of about 1/10 inch. In yet another embodiment, the facing wood veneer 50 is configured with the thickness ($T^2$) of about 1/16 inch. Accordingly, the wood core 30 is sized configured at ($T^5$)=(($T^1$)−(1/10 inch)) such that the wood core 30 is sized to a thickness ($T^5$) of about 1⅔ inches. And accordingly, the wood core 30 is sized configured at ($T^5$)=(($T^1$)−(1/16 inch)) such that the wood core 30 is sized including a thickness ($T^3$) of about 1 7/16 inches.

A two-part emulsion polymer-isocyanate adhesive is applied to the first wood face 32 of the Douglas Fir 88 wood core 30 via an adhesive spreading machine, and pressed against the second wood finishing facing 54 of the first finishing veneer 50 through an automated hydraulic press under heat and pressure enabling and operable for providing a seamless permanent attachment of the second wood finishing face$^1$ 54 of the first facing wood veneer 50 against the first wood face 32 of the wood core 30 forming an upper veneered $50^1$, wood core 30, more particularly an exotic hardwood veneered wood core 30, namely, an upper Sapele 42 veneered Douglas Fir 80 wood core 30, as shown in FIGS. 13B and 13C, such that the first wood finishing face$^1$ 52 of the first facing wood veneer 50 including the exotic hardwood species, more particularly, Sapele 42, is displayed to the viewer, such that a plurality of outdoor wood decking boards 10 adapted to be arranged along interior longitudinal wood side edges $36^1$ of each other form an upper assembled simulated non-cactile exotic hardwood outdoor deck floor 100, characterized as being free of cracks, holes, cavities or knots more particularly, an upper assembled simulated non-cactile Sapele 42 outdoor deck floor 100, characterized as being free of cracks, holes, cavities or knots formed of pre-configured dimensions.

Similarly, the two-part emulsion polymer-isocyanate adhesive is applied to the second wood face 34 of the wood core 30 via the adhesive spreading machine though the automated hydraulic press under heat and pressure enabling and operable for providing a seamless permanent attachment of the second wood finishing face$^2$ $54^2$ of the second facing wood veneer $50^2$ against the second wood face 34 of the wood core 30, forming a lower veneered $50^2$ wood core 30 exotic hardwood veneered wood core 30, more particularly, a lower Santos Mahogany 82, as shown in FIGS. 13B and 13C veneered $50^2$ Douglas Fir 80 wood core 30, such that the first wood finishing face$^2$ $52^2$ of the second facing wood veneer $50^2$ including the second exotic hardwood species formed of Santos Mahogany 82 forms a lower assembled simulated non-cactile exotic hardwood deck floor, more particularly a lower assembled simulated non-cactile Santos Mahogany 82 deck floor of preconfigured dimensions and being displayed to the viewer from below the upper assembled simulated non-cactile Sapele 42 outdoor deck floor 100.

The wood core 30 including the dual facing wood veneered wood core 96 having the first facing wood veneer 50, and the second facing wood veneer $50^2$ seamlessly permanently directly attached to the wood core 30 as described above, and shown in FIG. 13B, includes the thickness ($T^1$) of about 1½ inches, a width ($W^1$) of about 5½ inches, and the length ($L^1$) of about 8.00-20.00 feet inclusive.

Subsequently, the dual facing wood veneered wood core 96 is sized and configured to form an outdoor wood decking board 10, as shown in FIGS. 13C and 13D including the thickness ($T^1$) of about 1½ inches, a width ($W^2$) of about 5½ inches, and the length ($L^1$) of about 8.00-20.00 feet inclusive.

Implementing this novel feature, the dual facing wood veneered wood core 96 allows a user to display a first facing wood veneer 50 of the outdoor deck floor 100 showcasing a first aesthetic appearance complimentary to the surrounding natural environment of the outdoor deck floor 100 and consubstantially allows the user to display a second facing wood veneer 80 of the outdoor deck floor 100 to a viewer below the outdoor deck floor 100 showcasing a second aesthetic appearance complimentary to the surrounding environment, for example, in an outside room created by the disposition of the outdoor deck floor 100 devised as a Santos Mahogany 82 ceiling to the outside room.

Represented in the exemplary embodiment, the first facing wood veneer 50 and the second facing wood veneer $50^2$ can each be formed from any one of the superior grade of the second wood species WP2 of North American Softwood species selected from the group comprising of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In another embodiment, the first facing wood veneer 50 and the second facing wood veneer $50^2$ can each be formed from the same genus species selected from the second wood species WP2 of superior grade of North American Softwood wood species. In the alternative, the first facing wood veneer 50 and the second facing wood veneer $50^2$ can each be formed from a different genus species from each other selected from the second wood species WP2 of North American Softwood wood species.

In another embodiment, the first facing wood veneer 50 and the second facing wood veneer $50^2$ can each be formed from the same genus species selected from the third wood species WP3 of exotic hardwood species. In the alternative, the first facing wood veneer 50 and the second facing wood veneer $50^2$ can each be formed from a different genus species from each other selected from the third wood species WP3 of exotic hardwood species.

Figures 14A, 14B, 14C, 14D:
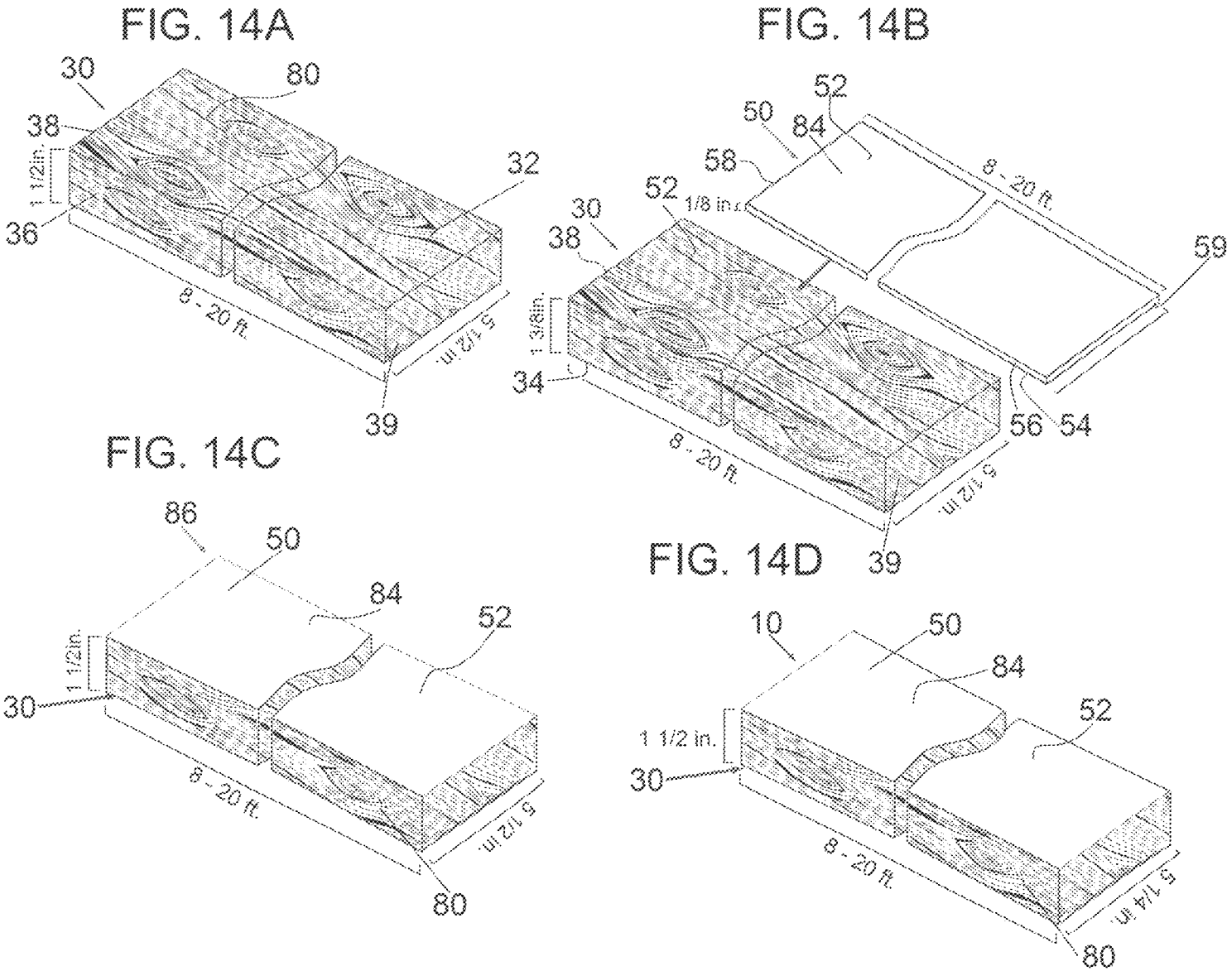
FIG. 14A is a top perspective view of a wood core of the outdoor wood decking board according to an embodiment of the disclosure
FIG. 14B is a schematic illustrating the facing wood veneer and the wood core of FIG. 14A showing the facing wood veneer being attached to a first wood face of the wood core.
FIG. 14C is a top perspective view of a facing wood veneered wood core, according to an embodiment of the disclosure.
FIG. 14D is a top perspective view of an outdoor wood decking board, according to an embodiment of the disclosure.

In another embodiment of the disclosure, as shown in FIG. 14A-14D, the wood core 30, as shown in FIG. 14A, is formed from a first wood species WP1, as a three-dimensional solid rigid wood body including a thickness ($T^1$) of about 1½ inches, a width ($W^1$) of about 5 12 inches, and a length ($L^1$) including a range of about 8.00-20.00 inches inclusive. The wood core 30 includes a first wood face 32, a second wood face 34 opposed to the first wood face 32, and dual opposite longitudinal wood side edges 36, the dual opposite longitudinal wood side edges 36 including interior longitudinal side edges $36^1$ and exterior longitudinal side edges $36^2$. The wood core 30 includes a first end 38 and a second end 39. The wood core 30 includes a longitudinal axis (LA). The wood core 30 is sized via a planar or a moulder to a configuration including a thickness of ($T^5$) which is equal to (($T^1$)−⅛ inch)), as shown in FIG. 2B.

The wood core 30 is sized to the thickness of ($T^5$) of about 1⅜ inches to account for the thickness of the facing wood veneer 50 upon the permanent attachment of the facing wood veneer 50 to the wood core 30, wherein the facing wood veneer includes a thickness ($T^2$) of about ⅛ inch. The facing wood veneer 50 can include a thickness ($T^2$) of the range of 1/16 inch-3/16 inch.

Subsequently, as shown in FIG. 14B, the wood core 30 is sized via a planar or moulder to a configuration including a thickness ($T^5$) of about 1⅜ inches, the width ($W^1$) of about 5½ inches, and the length ($L^1$) of about 8.00 feet-20.00 feet inclusive thereof. The wood core 30 is sized to accommodate for the thickness ($T^2$) of the facing wood veneer 50.

Implementing this feature, provides for consistency in providing a facing wood veneered wood core 20, as shown in FIG. 3D is configured with a consistent thickness ($T^1$) of about 1½ inches, and the outdoor wood decking board 10 post of being sized is configured consistently having a thickness ($T^1$) of about 1½ inches, a width ($W^2$) of about 5¼ inches, and a length ($L^1$) of about 8.00-20.00 feet inclusive.

In the exemplary embodiment, the wood core 30 is formed from any one of a common grade or general purpose grade of North American Softwood species selected from the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species). In the exemplary embodiment, as shown in FIGS. 14A and 14B the wood core 30 is formed from a tight knot Douglas Fir (*Pseudotsuga menziesii*) 80.

As shown in FIG. 14B, the facing wood veneer 50 includes a first finishing face 52, a second wood finishing face 54 opposed to the first finishing face 52, and dual opposing longitudinal facing wood veneer side edges 56, the dual opposing longitudinal facing wood veneer side edges 56 including interior longitudinal facing wood veneer side edges $\mathbf{56}^1$ and exterior longitudinal facing wood veneer side edges $\mathbf{56}^2$. The facing wood veneer 50 includes a facing wood veneer first end 58 and a facing wood veneer second end 59. The facing wood veneer 50 includes a longitudinal axis ($LA^2$).

The facing wood veneer 50 is configured including the thickness ($T^2$) of about ⅛ inch, the width ($W^1$) of about 5½ inches, and the length ($L^1$) of about 8.00-20.00 feet inclusive thereof. The facing wood veneer characterized as being free of cracks, holes, cavities or knots 50 is formed from an exotic hardwood which can be selected from any one of the third wood species WP3 including the exotic hardwood species selected from the group consisting of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

In the exemplary embodiment, the facing wood veneer characterized as being free of cracks, holes, cavities or knots 50 is the Teak (*Tectona grandis*) 84, as shown in FIG. 14B.

In another embodiment, the thickness of the facing wood veneer 50 can be 1/16-3/16 inch and thereby the wood core 30 shall be sized accordingly to accommodate the thickness of the facing wood veneer 50 so that the final thickness of the outdoor wood decking board 10 is 1½ inches thick.

In another embodiment of the disclosure, the exotic hardwood facing wood veneer 50 is configured with the thickness ($T^2$) of about 1/10 inch. Accordingly, the wood core 30 is sized configured at ($T^3$) (($T^1$)−(1/10 inch)) such that the wood core 30 is sized to a thickness ($T^5$) of about 1⅖ inches. In yet another embodiment, the exotic hardwood, Teak 84 facing wood veneer 50 is configured with the thickness ($T^2$) of about 1/16 inch. And accordingly, the wood core 30 is sized configured at ($T^5$)=(($T^1$)−(1/16 inch)) such that the wood core 30 is sized including a thickness ($T^3$) of about 1 7/16 inches.

FIG. 14C shows the facing wood veneer 50, the Teak 84 facing wood veneer characterized as being free of cracks, holes, cavities or knots 50, seamlessly permanently directly attached to the wood core 30 via the pressure sensitive liquid adhesive. With reference to FIGS. 14B and 14C, a pressure sensitive liquid adhesive 120 is applied to the first wood face 32 of the wood core 30 via an adhesive spreading machine enabling and operable for providing a seamless permanent attachment of the second wood finishing $face^1$ 54 of the facing wood veneer 50 against the first wood face 32 of the wood core 30 when the facing wood veneer 50 and the wood core 30 are pressed against each other through a hydraulic press under heat and pressure forming a facing wood veneered wood core 40, namely, a Teak 84 veneered Douglas Fir 80 wood core 30, such that the first wood finishing face 52 of the facing wood veneer 50 including the first exotic hardwood species WP1, such that the first finishing face of the facing wood veneer of the facing wood veneered wood core is visible to a user wherein the first finishing face of the facing wood veneer is visibly free of adhesive such that the first finishing face of the facing wood veneer of the facing wood veneered wood core is visibly unchanged or visibly unaltered by the adhesive more particularly, Teak characterized as being free of cracks, holes, cavities or knots 84, is displayed to the viewer, such that a plurality of outdoor wood decking boards 10 adapted to be arranged along interior longitudinal wood side edges 36 of each other form an upper assembled simulated non-cactile exotic hardwood outdoor deck floor 100, more particularly, an assembled simulated non-cactile Teak 84 outdoor deck floor 100, formed of pre-configured dimensions.

In another embodiment, the adhesive utilized to seamlessly permanently adhere or bond the exotic hardwood facing wood veneer characterized as being free of cracks, holes, cavities or knots 50, Teak 84 facing wood veneer 50, to the first wood face 32 of the wood core 30 can be a two-part emulsion polymer isocyanate adhesive. In another embodiment, the adhesive utilized to seamlessly permanently directly adhere or bond the exotic hardwood facing wood veneer characterized as being free of cracks, holes, cavities or knots 50, Teak 84 facing wood veneer 50, to the first wood face 32 of the wood core 30 can be a two-part polyurethane emulsion polymer.

FIG. 14C, more particularly, shows a Teak 84 veneered Douglas Fir 80 wood core 30, at 40 configured including the thickness ($T^1$) of about 1½ inches, the width ($W^1$) of about 5½ inches, and the length ($L^1$) of about 8.00 feet. Subsequently, the Teak 84 veneered Douglas Fir 80 wood core 30 is sized via the planer or moulder to form the outdoor wood decking board 10, as shown in FIG. 14D, including the thickness ($T^1$) of about 1½ inches, a width ($W^2$) of about 5¼ inches, and the length ($L^1$) of about 8.00-20.00 feet inclusive thereof.

Figures 15A, 15B, 15C, 15D, 15E, 15F:
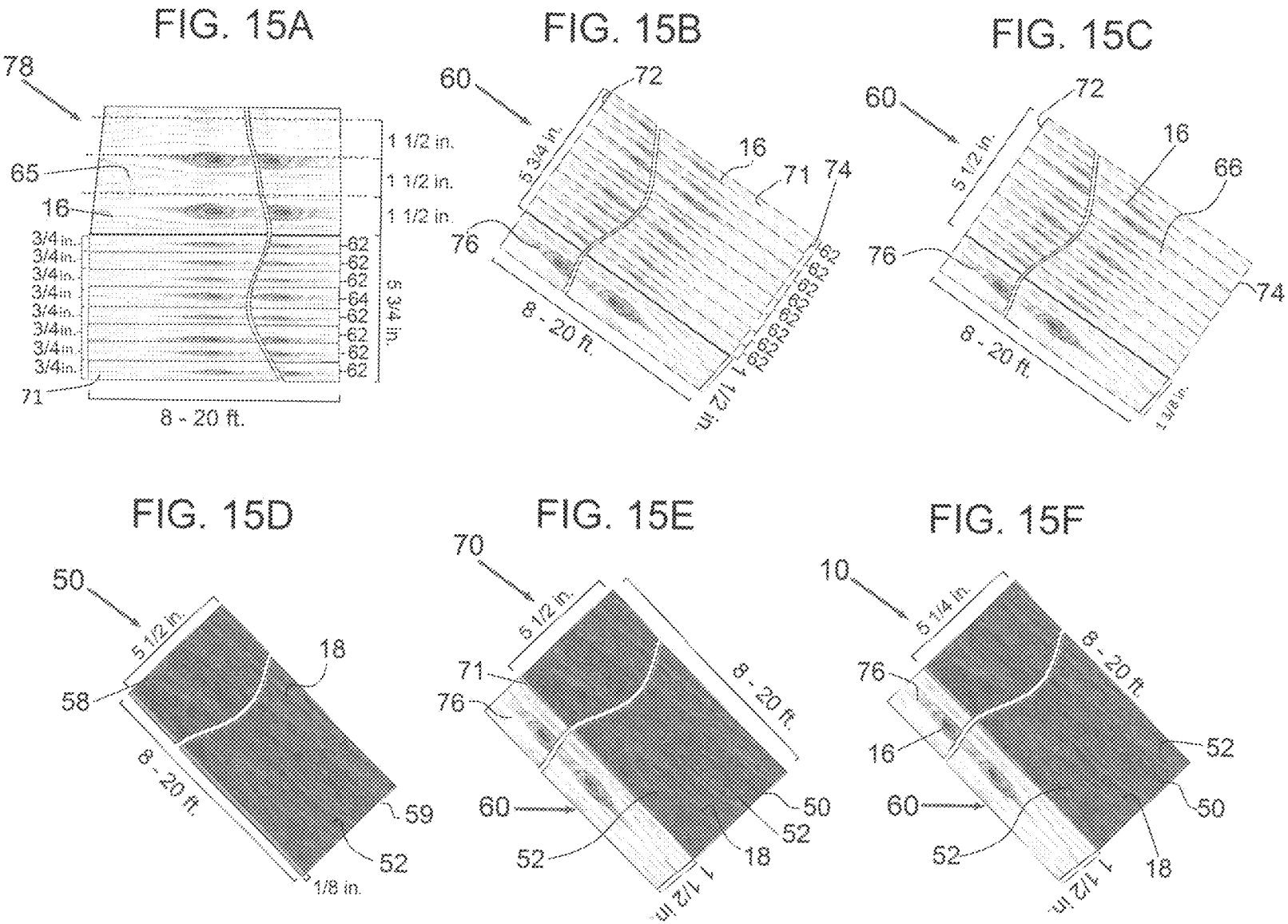
FIG. 15A is a top perspective view of a complex wood core assembly block, according to an embodiment of the disclosure.
FIG. 15B is a top perspective view of a complex wood core assembly of an outdoor wood decking board, according to an embodiment of the disclosure.
FIG. 15C is a top perspective view of the complex wood core assembly of FIG. 15B as sized, according to an embodiment of the disclosure.
FIG. 15D is a top perspective view of a facing wood veneer, according to an embodiment of the disclosure.
FIG. 15E is a top perspective view of a facing wood veneered complex wood core assembly, according to an embodiment of the disclosure.
FIG. 15F is a top perspective view of the outdoor wood decking board, according to an embodiment of the disclosure.

In another embodiment, an outdoor wood decking board 10 for use in the construction of an outdoor deck floor 100 comprises a complex wood core assembly 60, as shown in FIGS. 15A-15F. The complex wood core assembly 60, comprises a series of wood cores 62 and a protract wood core 64. Each of the wood cores 62 including the protract wood core 64 of the series of wood cores 62 is embodied in a separate individual three-dimensional solid rigid wood body formed from a first wood species WP1. The first wood species WP1 can include any one of a wood species selected from the first wood species WP1 is any one of a common grade or general purpose grade of North American Softwood species selected from the group consisting of western red cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species);

As shown in FIG. 15C, each of the complex wood core assemblies 60 includes a thickness ($T^1$) of about 1½ inches, a width ($W^1$) of about 5½ inches, and a length ($L^1$) of about 8.00-20.00 feet inclusive. Each complex wood core assembly 60 includes a first complex wood face 66, a second complex wood face 68 opposed to the first complex wood face 66, and dual opposite longitudinal wood side edges 76, a first end 72 and a second end 74. In the exemplary embodiment, the wood species of each of the wood cores 62 including the protract wood core 64 is a tight knot western red cedar 16 species selected from the first wood species WP1 of the group comprising any one of the North American Softwood species, as listed above, thereby forming a tight knot western red cedar 16 complex wood core assembly 60.

The complex wood core assembly 60 includes a series of wood cores 62 one of which is the protract wood core 64 seamlessly permanently directly attached to each other via the pressure sensitive liquid adhesive forming the complex wood core assembly 60. In preparation in the formation of the complex wood core assembly 60, each of the complex wood core assemblies 60 is cut from a complex wood core assembly block 78 to a thickness ($T^1$) of about 1½ inches, a width ($W^2$) of about 5¼ inches, and a length in the range of 8.00-20.00 feet inclusive, as shown in FIG. 15A.

Within the complex wood core assembly block 78, as shown in FIG. 15A, is the series of the wood cores 62 including the protract wood core 64 to form the complex wood core assembly block 78. Each of the wood cores 62 of the series of wood cores 62 of the complex wood core assembly block 78 including the protractor wood core 64 is manufactured from a wood species selected from the first wood species WP1 of common grade or general purpose grade of North American Softwood species as listed above.

In this exemplary embodiment of the complex wood core assembly block 78 is formed from a tight knot western red cedar wood 16 species. In particular, in the exemplary embodiment, each of the wood cores 62 and the protract wood core 64 is formed from a tight knot western red cedar wood 16 species.

The complex wood core assembly 60, includes each wood core 62 of the series of wood cores 62 of the complex wood core assembly 60 is embodied in a separate individual three-dimensional solid rigid wood body formed from a first wood species WP1, including a thickness ($T^3$) of about ¾ inch, a width ($W^1$) of about 5½ inches, and a length ($L^1$) of about 8.00 feet-20.00 feet inclusive. Each of the wood cores 62 of the complex wood core assembly 60 includes a first wood face$^1$ 65, a second wood face$^1$ 69 opposed to the first wood face$^1$ 65, and dual opposite longitudinal wood side edges$^1$ 71. The protract wood core 64 is centrally positioned within the series of wood cores 62. The protract wood core 64 includes the thickness ($T^8$) of about ½ inch, a width ($W^1$) of about 5½ inches, and the length ($L^1$) of about 8.00-20.00 feet inclusive, as shown in FIG. 15A.

In addition, the protract wood core 64 is embodied in a separate individual three-dimensional solid rigid wood body$^1$ formed from the first wood species WP1, the first wood species WP1 selected from the first wood species WP1 as listed above. In the exemplary embodiment, the protract wood core 64 is the tight knot western red cedar 16, thereby providing a tight knot western red cedar 16 protract wood core 64 configured including the thickness ($T^8$) of about ½ inch, a width ($W^1$) of about 5½ inches, and a length ($L^1$) of about 8.00-20.00 feet. The tight knot western red cedar protract wood core 64 includes a first wood face$^1$ 65$^2$, a second wood face$^1$ 69$^2$ opposed to the first wood face$^1$ 65, and dual opposite longitudinal wood side edges$^1$71.

The protract wood core 64 provides an additional ½ inch to the thickness of the complex wood core assembly block 78 which enables for the provision of additional dimension to the width of the complex wood core assembly 60 to be configured to the width ($W^1$) of about 5½ inches when a newly cut complex wood core assembly is sized via the planer or the moulder, as shown in FIG. 15C. The protract wood core 64 is embodied in a separate individual three dimensional solid rigid wood body formed from the first wood species FW1, the tight knot western red cedar 16, the protract wood core 64 configured including the thickness ($T^8$) of about ½ inch, a width ($W^1$) of about 5½ inches, and a length ($L^1$) of about 8.00-20.00 feet, wherein the protract wood core 64 includes a first wood face$^1$ 65, a second wood face$^1$ 69 opposed to the first wood face$^1$ 65, and dual opposite longitudinal wood side edges$^1$ 71. The protract wood core 64 is centrally positioned within the series of wood cores 62.

To form a complex wood core assembly 60, accordingly, each of the wood cores 62 of the series of wood cores 62 including the protract wood core 64 is permanently directly attached together along interior faces via a pressure sensitive adhesive. The pressure sensitive liquid adhesive 120 is applied to interior faces of the each of the wood cores 60 including the protract wood core 64 via an adhesive spreading machine enabling and operable for providing a seamless permanent attachment of each of the wood cores 60 to each other including the protract wood core 64 forming the complex wood core assembly block 78, as shown in FIG. 15A, when the wood cores 62 and the protract wood core 64 are pressed against each other in a press under heat and pressure. Each of the wood cores 62 including the protract wood core 64 is seamlessly permanently directly attached face-to-face to form the complex wood core assembly block 78.

The complex wood core assembly block 78, as shown in FIG. 15A, simulating a single three-dimensional solid rigid wood body is configured including the thickness ($T^7$) of about 5¾ inches, a width ($W^1$) of about 5½ inches, and the length ($L^1$) of about 8.00-20.00 feet inclusive. In the exemplary embodiment, the complex wood core assembly block 78 is a tight knot western red cedar 16 complex wood core assembly block 78.

In another embodiment, the adhesive utilized to form the complex wood core assembly 60 can be the two-part emulsion polymer-isocyanate adhesive.

In another embodiment, the adhesive utilized to form the complex wood core assembly 60 can be the two-part polyurethane emulsion adhesive.

Each of the complex wood core assemblies 60, as shown in FIG. 15B, is cut via a cutting machine from the complex wood core assembly block 78, as shown in FIG. 15A. In the exemplary embodiment, each of the complex wood core assemblies 60 is cut from the tight knot western red cedar complex wood block 78 into a plurality of complex wood core assemblies 60. Each complex wood core assembly 60 of the plurality of complex wood core assemblies 60, as shown in FIG. 15B is configured with a thickness ($T^1$) of about 1½ inches, a width ($W^9$) of about 5¾ inches, and a length ($L^1$) of about 8.0-20 feet inclusive. Each complex wood core assembly 60, more particularly, each tight knot western red cedar complex wood core assembly 60 includes a first complex wood face 66, and a second complex wood face 68 opposite to the first complex wood face 66, and complex opposite longitudinal wood side edges 76, a first end 72 and a second end 74.

The complex wood core assembly 60 is sized via a planer or moulder to a thickness ($T^5$) of about 1⅜ inches, the width ($W^1$) of about 5½ inches, and the length ($L^1$) of about 8.00-20.00 feet inclusive, as shown in FIG. 15C. Thereby providing a tight knot western red cedar 16 complex wood core assembly 60 including a thickness ($T^5$) of about 1⅜ inches, to accommodate for the thickness of a facing wood veneer 50, the width ($W^1$) of about 5½ inches, and the length ($L^1$) of about 8.00-20.00 feet inclusive.

The outdoor wood decking board 10 including the complex wood core assembly 60 includes the facing wood veneer 50, as shown in FIG. 15D. The facing wood veneer 50, as shown in FIG. 15D includes a first wood finishing face 52, a second wood finishing face 54 opposed to the first finishing face 52, and dual opposing longitudinal facing wood veneer side edges 56, the dual opposing longitudinal facing wood veneer side edges 56 including interior longitudinal facing wood veneer side edges $\mathbf{56}^1$ and exterior longitudinal facing wood veneer side edges $\mathbf{56}^2$. The facing wood veneer 50 includes a facing wood veneer first end 58 and a facing wood veneer second end 59. The facing wood veneer 50 includes a longitudinal axis ($LA^2$).

The facing wood veneer 50 is manufactured from a wood species selected from the second wood species WP2. As shown in FIG. 15D the facing wood veneer is formed from Bulletwood, Massaranduba (*Manilkara bidentata*) 18.

In the exemplary embodiment, the facing wood veneer characterized as being free of cracks, holes, cavities or knots 50, as shown in FIG. 15D can be formed from a third wood species WP3 of exotic hardwood species, selected from anyone of exotic hardwood species the exotic hardwood species selected from the group consisting of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico *Zapote, Zapote*, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

In another embodiment, the facing wood veneer 50 can be formed from a second wood species WP2, as a three dimensional solid rigid finishing layer including a thickness ($T^2$) of about ⅛ inch, the width ($W^1$) of about 5½ inches, and the length ($L^1$) of about 8.00-20.00 feet inclusive; wherein the second wood species WP2 is a superior grade of North American Softwood species selected from the group consisting of western red cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In the exemplary embodiment, as shown in FIG. 15D, the facing wood veneer 50 is formed from the wood species Bulletwood, Massaranduba (*Manilkara bidentata*) ("Massaranduba") 18 facing wood veneer 50.

The facing wood veneer 50 is seamlessly permanently directly attached to the complex wood core assembly 60 via the pressure sensitive liquid adhesive 120 whereby the second finishing face 54 of the facing wood veneer 50 is overlaid against the first complex wood face 66 of the complex wood core assembly 60, as shown in FIG. 15E.

The facing wood veneer 50 is laminated against the first complex wood face 66 of the complex wood core assembly 60 through an automated hydraulic press under heat and pressure enabling and operable for providing a visually seamless permanent attachment of the facing wood veneer 50 against the complex wood core assembly 60 to form a facing wood veneered complex wood core assembly 70, as shown in FIG. 15E, more particularly, a Massaranduba 18 veneered complex wood core assembly 60. The complex wood core assembly 60, more particularly, the Massaranduba 18 veneered tight knot western red cedar 16 complex wood core assembly 60 is configured including the thickness ($T^1$) of about 1½ inches; the width ($W^1$) of about 5½ inches, and a length ($L^1$) of about 8.00-20.00 feet, as shown in FIG. 15E.

The facing wood veneered complex wood core assembly 70, more particularly, the Massaranduba 18 veneered complex wood core assembly 60 is sized to form the outdoor wood decking board 10, as shown in FIG. 15F via the planer or moulder to a configuration including the thickness ($T^1$) of about 1½ inches, a width ($W^2$) of about 5¼ inches, and the length ($L^1$) of about 8.00-20.00 feet inclusive.

The facing wood veneered complex wood core assembly 70, more particularly, the Massaranduba 18 veneered complex wood core assembly 60, includes the first finishing face 52 of the facing wood veneer 20 displayed to the viewer. More particularly, the Massanranduba 18 veneered tight knot western red cedar complex wood core assembly 70 includes the first finishing face 52 of the Massanranduba 18 facing wood veneer 50 displayed to a viewer, thereby, a plurality of outdoor wood decking boards 10 including the Massanranduba 18 veneered tight knot western red cedar complex wood core assembly 60 adapted to be arranged along the interior longitudinal side edges of each other form an assembled simulated non-cactile Massanranduba 18 outdoor deck floor 100 characterized as being free of cracks, holes, cavities or knots of pre-configured dimensions.

In another embodiment of the disclosure, the facing wood veneer 50 can be a clear vertical grain western red cedar 14 species thereby forming a clear vertical grain western red cedar veneered tight knot western red cedar complex wood core assembly 60.

The pressure sensitive adhesive in the exemplary embodiment of the disclosure of the outdoor wood decking board 10 including the complex wood core assembly 60 is a polyvinylacetate. In another embodiment, the pressure sensitive adhesive is a melamine resin adhesive including a liquid hardener. In another embodiment of the outdoor wood decking board 10, wherein the outdoor wood decking board 10 includes a complex wood core assembly 60, the pressure sensitive liquid adhesive is a crosslinking vinyl acetate, wherein the crosslinking vinyl acetate has a solid content of about 52% and a pH of about 5.5-6.0. In yet another embodiment, the crosslinking vinyl acetate has a solid content of about 46% and a pH of about 4.5-5.5.

In another embodiment, the adhesive is a polymerized polyurethane reactive adhesive. The adhesive is a polyurethane reactive adhesive, or polymerized polyurethane reactive adhesives. The polyurethane reactive adhesives have been known to be used in construction. They have been utilized in outdoors, boasting effective weatherproofing qualities and high impact bonding strength.

In another embodiment of the disclosure, the pressure sensitive liquid adhesive can be a polyurethane resin adhesives can even withstand exposure to salt water. Polyurethane resin adhesives boast excellent resistance to high temperatures, UV and weather conditions to provide a tough, hard wearing bond.

In an embodiment of the disclosure, an outdoor wood decking board 10 for use in construction of an outdoor deck floor 100, as shown in FIG. 16A-16E, includes a core 30 including a facing wood veneer 50 permanently directly seamlessly attached to the core 30.

In an embodiment of the disclosure, the core 30 can be formed from a wood plastic composite 130, as shown in FIGS. 16A-16E. A supplier of wood plastic composites are Hardy Smith Wood Plastic Composite at http://hardysmith.org/about-us.html.

Figure 16A:
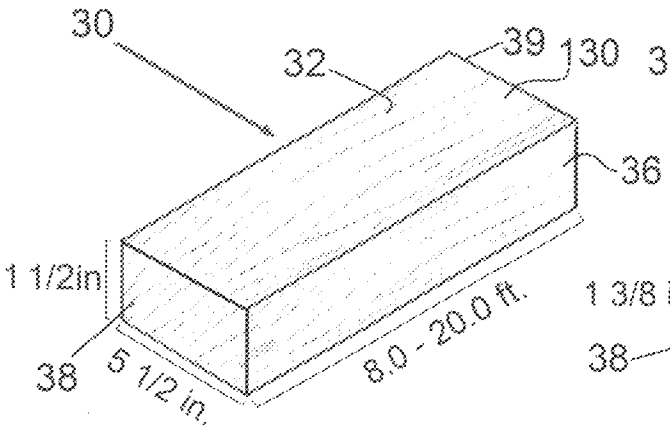
FIG. 16A is a top perspective view of a core including a wood plastic composite of an outdoor wood decking board, according to an embodiment of the disclosure.

The core 30, as shown in FIG. 16A is formed from a wood plastic composite 130, as a three-dimensional solid rigid wood body including a thickness ($T^1$), a width ($W^1$), and a length ($L^1$). The core 30 includes a first wood face 32, and a second face 34 opposed to the first wood face 32, and dual opposite longitudinal wood side edges 36, a first end 38 and a second end 39.

In the exemplary embodiment, the core 30 is formed from a wood plastic composite 130. The wood plastic composite 130 comprises a mixture of raw materials of natural fibers of agricultural waste, wood waste products, and plastic polymers. The raw materials can include natural fibers of wood waste, saw mill waste, wood powder, wood flour, wood chips, bagasse, bamboo, coir fibers, rice husk, cotton stalks. The wood plastic composites are commercially through Hardy Smith company at http://hardysmith.org/about-us.html.

The plastic polymers include polyethylene or polythene (International Union of Pure and Applied Chemistry (IUPAC) name, polyvinyl chloride, and polypropylene. The plastic polymers can, further, include virgin polyethylene, virgin polyvinyl chloride, and virgin polypropylene. The plastic polymers can, further, include recycled polyethylene, recycled polyvinyl chloride, recycled polypropylene.

Polyvinyl chloride, ("PVC"), is a thermoplastic polymer. It is a vinyl polymer constructed of repeating vinyl groups having one hydrogen replaced by chloride. Polyvinyl chloride is the third most widely produced plastic, after polyethylene and polypropylene. PVC is widely used in construction because it is cheap, durable, and easy to assemble. PVC production is expected to exceed 40 million tons by 2016. Polyethylene or polythene is the most widely used plastic, with an annual production of approximately 80 million metric tons. Its primary use is within packaging (plastic bag, plastic films, and the like).

Polyethylene ("PE") is a thermoplastic polymer consisting of long chains produced by combing the ingredient monomer ethylene (IUPAC name ethene), the name comes from the ingredient and not the actual chemical resulting. The ethene molecule (known almost universally by its common name ethylene) C2H4 is CH2=CH2, Two CH2 groups connected by a double bond, thus: Polyethylene contains the chemical elements carbon and hydrogen.

Polyethylene is created through polymerization of ethene. It can be produced through radical polymerization, anionic addition polymerization, ion coordination polymerization or cationic addition polymerization. This is because ethene does not have any substituent groups that influence the stability of the propagation head of the polymer. Each of these methods results in a different type of polyethylene. Polyethylene is classified into several different categories based mostly on its density and branching. The mechanical properties of PE depend significantly on variables such as the extent and type of branching, the crystal structure and the molecular weight. With regard to sold volumes, the most important polyethylene grades are HDPE, LLDPE and LDPE.

Polypropylene ("PP"), also known as polypropene, is a thermoplastic polymer used in a wide variety of applications including packaging, textiles (e.g., ropes, thermal underwear and carpets), stationery, plastic parts and reusable containers of various types; laboratory equipment, loudspeakers, automotive components, and polymer banknotes. An addition polymer made from the monomer propylene, it is rugged and unusually resistant to many chemical solvents, bases and acids.

The melting of polypropylene occurs as a range, so a melting point is determined by finding the highest temperature of a differential scanning calorimetry chart. Perfectly isotactic PP has a melting point of 171° C. (340° F.). Commercial isotactic PP has a melting point that ranges from 160 to 166° C. (320 to 331° F.), depending on atactic material and crystallinity. Syndiotactic PP with a crystallinity of 30% has a melting point of 130° C. (266° F.).

The melt flow rate (MFR) or melt flow index (MFI) is a measure of molecular weight of polypropylene. The measure helps to determine how easily the molten raw material will flow during processing. Polypropylene with higher MFR will fill the plastic mould more easily during the injection or blow-moulding production process. As the melt flow increases, however, some physical properties, like impact strength, will decrease.

There are three general types of polypropylene: homopolymer, random copolymer, and block copolymer. The comonomer is typically used with ethylene. Ethylene-propylene rubber or EPDM added to polypropylene homopolymer increases its low temperature impact strength. Randomly polymerized ethylene monomer added to polypropylene homopolymer decreases the polymer crystallinity and makes the polymer more transparent.

The wood waste includes any natural wood and wood wastes can be used for making wood plastic composites. Wood will be converted into powder form for mixing and final material preparation. Wood waste coming out as a part of plywood mills, saw mills, particle board units, board units, veneer units and other furniture units can be utilized as an effective raw material for producing wood plastic composites. These wastes are converted into fine powder through wood powder milling machine.

The agriculture wastes like bagasse, bamboo or bamboo wastes, cotton stalks, rice straws, wheat straws, coil fiber, coconut shells, etc. can be used as a good quality raw material option for natural fibers. These natural fibers are fitting best to get polymerized with polymers like PVC, PE & PP.

Figure 16B:
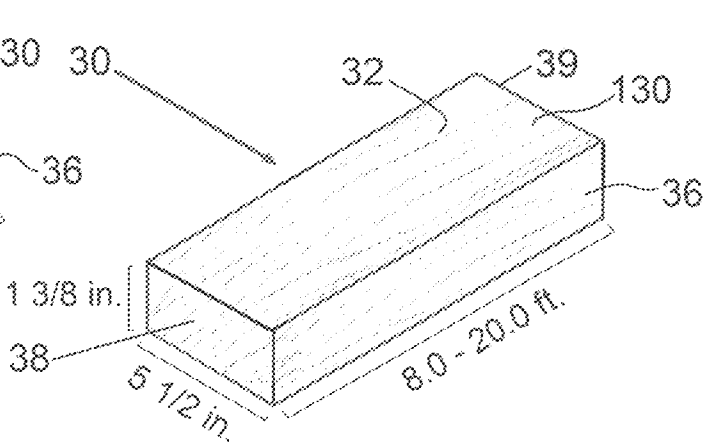
FIG. 16B is a top perspective view of the core of FIG. 16A illustrating sizing of the wood composite core of FIG. 16A, according to an embodiment of the disclosure.
Figure 16C:
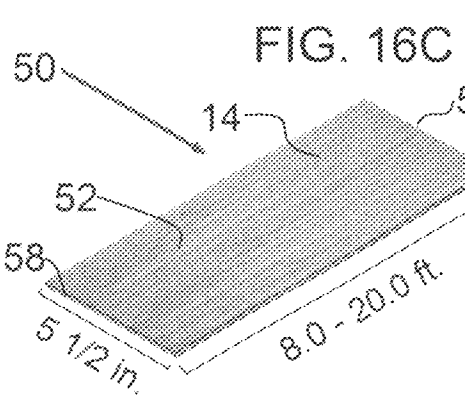
FIG. 16C is a top perspective view of a facing wood veneer of the outdoor wood decking board, according to an embodiment of the disclosure.
Figure 16D:
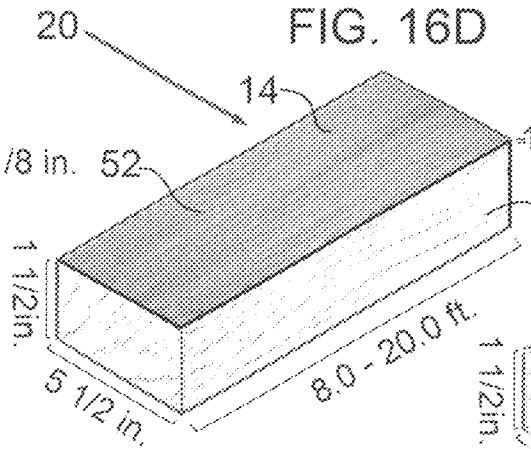
FIG. 16D is a top perspective view of a facing wood veneered wood composite core, according to an embodiment of the disclosure.
Figure 16E:
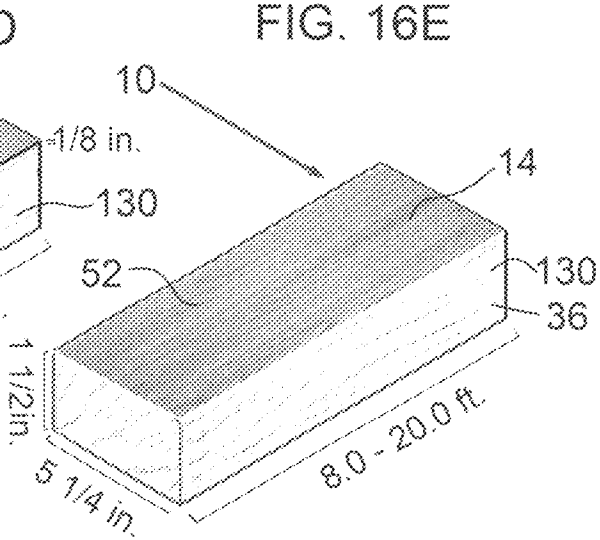
FIG. 16E is a top perspective view of the outdoor wood decking board, according to an embodiment of the disclosure.

As shown in FIG. 16E, the outdoor wood decking board 10 includes a core 10 formed from a wood plastic composite 130 including a facing wood veneer 50 permanently directly seamlessly attached to the core 30.

Referring to FIG. 16A, depicts an embodiment of an outdoor wood decking board 10, according to the embodiment of the disclosure. The outdoor wood decking board 10 embodied for use in construction of an outdoor deck floor 100 comprises a core 30, a facing wood veneer 50, a pressure sensitive liquid adhesive 120. The facing wood veneer 50 is seamlessly permanently directly attached to a first wood face 32 of the core 30 by means of the pressure sensitive liquid adhesive 120.

Referring to FIGS. 16A-16B, the core 30 is formed from a wood plastic composite 130, as a three-dimensional solid rigid body including a thickness ($T^1$), a width ($W^1$), and a length ($L^1$), The core 30 includes a first wood face 32, a second wood face 34 opposed to the first wood face 32, and dual opposite longitudinal side edges 36, the dual opposite longitudinal side edges 36 including interior longitudinal side edges $\mathbf{36}^1$ and exterior longitudinal side edges $\mathbf{36}^2$. The core 30 includes a first end 38 and a second end 39. The core 30 includes a longitudinal axis (LA). The core 30 is sized via a planar or a moulder to a configuration including a thickness of ($T^5$) which is equal to ($T^1$)−⅛ inch), as shown in FIG. 16B.

The core 30 is sized to the thickness of ($T^5$) to account for the thickness of the facing wood veneer 50 upon the permanent attachment of the facing wood veneer 50 to the core 30, wherein the facing wood veneer includes a thickness ($T^2$) of about ⅛ inch. Implementing this feature, provides for consistency in providing a facing wood veneered core 20, as shown in FIG. 16D is configured with a consistent thickness ($T^1$) of about 1½ inches, and the outdoor wood decking board 10 post being sized is configured consistently having a thickness ($T^1$) of about 1½ inches, a width ($W^2$) of about 5¼ inches, and a length ($L^1$) of about 8.00-20.00 feet inclusive.

The facing wood veneer 50, as shown in FIG. 16C, in an embodiment of the disclosure, is formed from a second wood species WP2, as a three-dimensional solid rigid wood finishing layer including a thickness ($T^2$) where ($T^2$) is equal to ⅛ inch, the width ($W^1$), and the length ($L^1$). The facing wood veneer 50 includes a first wood finishing face 52, a second wood finishing face 54 opposed to the first wood finishing face 52, and dual opposing longitudinal facing wood veneer side edges 56. The facing wood veneer 50 is configured including the thickness ($T^2$) of about ⅛ inch, the width ($W^1$) of about 5½ inches, and the length ($L^1$) of about 8.00-20.00 feet inclusive thereof.

The facing wood veneer 50 can be configured to include the thickness ($T^2$), the thickness ($T^2$) selected from the group consisting of about ⅛ inch, 1/10 inch, and 1/16 inch. Accordingly, the thickness of the wood core 30 when sized by the planer or moulder to accommodate for the thickness ($T^2$) of the facing wood veneer 50 so that the wood core 30 is sized to include the thickness ($T^5$) which is equal to (($T^1$)−($T^2$)) such that ($T^5$) is configured to the thickness of 1⅜ inches, 1⅖ inches, and 1 7/16 inches, accordingly.

The second wood species WP2 can be a superior grade of North American Softwood species selected from the group comprising of western red cedar, (*Thuja plicata*), (*Thuja occidentalis*), Douglas Fir (*Pseudotsuga menziesii*), clear grain Western Larch (*Larix occidentalis*), clear grain Alpine Larch (*Larix lyallii*), clear grain Alaskan Yellow Cedar (*Chamaecyparis nootkatensis*), clear grain Hemlock (*Tsuga heterophylla*), clear grain, Port of Oxford Cedar (*Chamaecyparis lawsoniana*), clear grain Redwood (*Sequoia sempervirens*), and clear grain Pine/Spruce (*Pinus* species, *Picea* species).

In another embodiment, the facing wood veneer characterized as being free of cracks, holes, cavities or knots 50 can be formed from a third wood species WP3 selected from exotic hardwood species selected from the group comprising of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*);

African Blackwood (*Dalbergia melanoxylon*); and Bismarck Black *Myzomela* (*Myzomela pammelaena*).

A pressure sensitive liquid adhesive 120 is applied to the first wood face 32 of the core 30 by means of an adhesive spreading machine, and pressed through an automated hydraulic press under heat and pressure enabling and operable for providing a seamless permanent attachment of the second wood finishing face 54 of the facing wood veneer 50 against the first wood face 32 of the core 30 forming a facing wood veneered core 20, as shown in FIG. 16D, wherein the facing wood veneered core 20 includes the first wood finishing face 52 of the facing wood veneer 50 displayed to a viewer.

In the exemplary embodiment, the adhesive 106 can be a two-part emulsion polymer-isocyanate adhesive. In another embodiment, the adhesive 106 can be a two-part polyurethane emulsion polymer adhesive.

In the exemplary embodiment, the facing wood veneer 50, is selected from the second wood species WP2. The facing wood core 50 is a clear vertical grain western red cedar 14 species. Thereby, a plurality of outdoor wood decking boards 10 adapted to be arranged along interior longitudinal side edges 36 of each other form an assembled simulated non-cactile clear vertical grain western red cedar outdoor deck floor 100 of pre-configured dimensions.

Thereby, the facing wood veneered core 20, more particularly, the clear vertical grain western red cedar 14 veneered wood plastic composite 130 core 30, as shown in FIG. 6D is configured including the thickness ($T^4$) of about 1⅛ inches, the width (W of about 5½ inches, and the length ($L^1$) of about 8.00-20.00 feet.

Subsequently, as shown in FIG. 16E, the clear vertical grain western red cedar 14 veneered wood plastic composite 130 core 30, is sized via the planer or moulder to form the outdoor wood decking board 10 as shown in FIG. 16E which is sized to a configuration including the thickness ($T^4$) of about 1⅛ inches, the width ($W^2$) of about 5½ inches, and the length ($L^1$) of about 10.00 feet, but not limited to.

As mentioned above, the core 30, can be formed from a cement board 132. The cement board 132 is a tile underlayment for wet areas. It is resistant to moisture and mold. The cement board 132 is available commercially through Hardie Baker Cement Boards.

With reference to FIGS. 16A-16E, in the exemplary embodiment, of the outdoor wood decking board 10 for use in construction of an outdoor deck floor 100 the core 30 can be configured including the thickness ($T^1$) of about 1½ inches, a width ($W^3$) of about 3½ inches, and the length ($L^1$) of about 8.00-20.00 feet inclusive.

Subsequently, the core 30 is sized via the planer or moulder to a configuration including the thickness ($T^5$) of about 1⅜ inches, a width ($W^3$) of about 3½ inches, and the length ($L^1$) of about 8.00-20.00 feet inclusive.

The facing wood veneer 50, is configured including the thickness ($T^2$) of about ⅛ inch, the width ($W^1$) of about 5½ inches, and the length ($L^1$) of about 8.00-20.00 feet. The facing wood veneered core 20 is sized to form the outdoor wood decking board 10 via the planer or moulder to a configuration including the thickness ($T^1$) of about 1½ inches, a width ($W^4$) of about 3¼ inches, and the length ($L^1$) of about 8.00-20.00 feet inclusive.

In another embodiment, of the outdoor wood decking board 10 for use in construction of an outdoor deck floor 100, the core 30 can be configured including a thickness ($T^4$) of about 1⅛ inches, the width ($W^1$) of about 5½ inches, and the length ($L^1$) of about 8.00-20.00 feet inclusive.

Subsequently, the core 30 is sized via the planer or moulder to a configuration including a thickness ($T^6$) of about 1.00 inch, the width ($W^1$) of about 5½ inches, and a length ($L^1$) of about 8.00-20.00 feet inclusive. The facing wood veneer 50 is configured including the thickness ($T^2$) of about ⅛ inch, the width ($W^1$) of about 5½ inches, and the length ($L^1$) of about 8.00-20.00 feet inclusive.

Subsequently, the facing wood veneered core 20 is sized to form the outdoor wood decking board 10 via the planer or moulder to a configuration including the thickness ($T^4$) of about 1⅛ inches, the width ($W^2$) of about 5¼ inches, and the length ($L^1$) of about 8.00-20.00 feet inclusive.

In the exemplary embodiment, the outdoor wood decking board 10 for use in construction of an outdoor deck floor 100, the core 30 can be configured including a thickness ($T^4$) of about 1⅛ inches, a width ($W^3$) of about 3½ inches, and the length ($L^1$) of about 8.00-20.00 feet inclusive. Subsequently, the core 30 is sized via the planer or moulder to a configuration including a thickness ($T^6$) of about 1.00 inch, the width ($W^3$) of about 3½ inches, and the length ($L^1$) of about 8.00-20.00 feet inclusive.

The facing wood veneer 50 is configured including the thickness ($T^2$) of about ⅛ inch, the width ($W^3$) of about 3½ inches, and the length ($L^1$) of about 8.00-20.00 feet inclusive. Subsequently, and the facing wood veneered core 20 is sized via the planer or moulder to a configuration including the thickness ($T^4$) of about 1⅛ inches, the width ($W^4$) of about 3¼ inches, and the length ($L^1$) of about 8.00-20.00 feet inclusive.

In the exemplary embodiment, the outdoor wood decking board 10 for use in construction of an outdoor deck floor 100, the core 30 can be embodied configured including the thickness ($T^1$) of about 1⅝ inches, a width ($W^5$) of about 7¼ inches, and the length ($L^1$) of about 8.00-20.00 feet inclusive. Subsequently, the core 30 is sized via the planer or moulder to a configuration including the thickness ($T^3$) of about 1⅜ inches, the width ($W^5$) of about 7¼ inches, and the length ($L^1$) of about 8.00-20.00 feet inclusive to accommodate for the thickness ($T^2$) of the facing wood veneer 50.

The facing wood veneer 50 is configured including the thickness ($T^2$) of about ⅛ inch, the width ($W^5$) of about 7¼ inches, and the length ($L^1$) of about 8.00-20.00 feet inclusive. Subsequently, the facing wood veneered core 20 is sized to form the outdoor wood decking board 10 via the planer or moulder to a configuration including the thickness ($T^1$) of about 1½ inches, a width ($W^6$) of about 7⅛ inches, and the length ($L^1$) of about 8.00-20.00 feet inclusive.

In another embodiment, the core 30 can be formed from a wood fiber cement board 132. A cement board supplier is Hardie Backer Cement Boards at http://www.jameshardie.com/Products/HardieBacker-Cement-Board.

The cement board is a tile underlayment made for wet areas. It is resistant to moisture and mold. The cement board is a combination of cement and reinforcing fibers formed into sheets having a thickness, width, and length that are typically used as a tile backing board. Cement board adds impact resistance and strength to surfaces.

Cement boards are mainly cement bonded particle boards and cement fiber. Cement bonded particle boards have treated wood flakes as reinforcement, whereas in cement fiber boards have cellulose fiber, which is a plant extract as reinforcement. Cement acts as binder in both the cases. The fire resistance properties of cement bonded blue particle boards and cement fiber boards are the same. In terms of load-bearing capacity, cement-bonded particle boards have higher capacity than cement fiber boards. Cement particle boards can be manufactured from 6 mm to 40 mm thickness making it ideally suitable for high load bearing applications. These boards are made of a homogeneous mixture and hence are formed as single layer for any thickness. Cement fiber boards are more used in decorative applications and can be manufactured from 3.00 mm to 20.00 mm thickness. Many manufacturers use additives like mica, aluminium stearate and cenospheres in order to achieve certain board qualities. Typical cement fiber board is made of approximately 40-60% of cement, 20-30% of fillers, 8-10% of cellulose, 10-15% of mica. Other additives, like above mentioned, aluminium stearate and PVA are normally used in quantities less than 1%. Cenospheres are used only in low density boards with quantities between 10-15%. A cement board is a combination of cement and reinforcing fibers formed into sheets having a thickness, width, and length that are typically used as a tile backing board.

In another embodiment, with reference to FIGS. 1, 2A-3E, and 8A-8E an outdoor wood decking board 10 for use in construction of an outdoor deck floor 100, the outdoor wood decking board 10, comprises a wood core 30, formed from a first wood species WP1, as a three-dimensional solid rigid wood body including a thickness ($T^1$), a width ($W^1$), and a length ($L^1$). The wood core 30 includes a first wood face 32, a second wood face 34 opposed to the first wood face 32, and dual opposite longitudinal wood side edges, wherein the first wood species WP1 is preselected from any one of a common grade North American Softwood species to form a common grade North American Softwood wood core 30. The common grade North American Softwood wood core 30 is sized via a planer or a moulder to a configuration including a thickness of ($T^5$) which is equal to $((T^1)-T^2))$, as shown in FIG. 3B. The common grade North American Softwood wood core 30 is dried to a moisture content suitable for receiving an adhesive. The adhesive utilized can be a two-part emulsion polymer-isocyanate adhesive.

In another embodiment, the adhesive 106 utilized can be a two-part polyurethane emulsion polymer.

As shown in FIG. 8B-8C the outdoor wood decking board 10 includes a facing wood veneer 50, formed from a third wood species WP3 as a three-dimensional solid rigid wood finishing layer including the thickness ($T^2$), the width ($W^1$), and the length ($L^1$). The facing wood veneer 50 includes a first wood finishing face 52, a second wood finishing face 54 opposed to the first wood finishing face 52, and dual opposing longitudinal facing wood veneer side edges 56. FIG. 8C shows the top surface of the IPE 26 facing wood veneer is non-cactile. It is understood by a person of ordinary skill in the art that the facing wood veneer can be composed of any one of the third wood species WP3 as listed above, including *Angelim pedra; Angelim vermelho*; (Balau) *Shorea* spp.; (Mukulungu) *Autranella congolensis*; (Tigerwood) *Astronium graveolens*; in addition to African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manikara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

In this embodiment, with reference to FIG. 8B, the third wood species WP3 is preselected from any one of an exotic hardwood species free from growth characteristics characterized as being free of cracks, holes, cavities or knots that affect appearance or performance to form an exotic hardwood facing wood veneer 50. As shown in FIGS. 8B-8E the facing wood veneer characterized as being free of cracks, holes, cavities or knots 50 is formed from the exotic hardwood species, Ipe (*Handroanthus* species) 26. In the exemplary embodiment, the adhesive utilized is the two-part emulsion polymer-isocyanate adhesive. The two-part emulsion polymer-isocyanate adhesive is applied to the first wood face 32 of the common grade North American Softwood wood core 30 via an adhesive spreading machine enabling and operable for providing a seamless permanent attachment of the second wood finishing face 52 of the exotic hardwood facing wood veneer characterized as being free of cracks, holes, cavities or knots 50 against the first wood face 32 of the common grade North American Softwood wood core 30 forming an exotic hardwood facing wood veneered common grade North American Softwood wood core 20, wherein the exotic hardwood facing wood veneered North American Softwood wood core 20 includes the first wood finishing face 52 of the exotic hardwood facing wood veneer displayed to a viewer, as shown in FIG. 8C. Thereby, a plurality of outdoor wood decking boards 10 adapted to be arranged along interior longitudinal wood side edges of each other form an assembled simulated non-cactile exotic hardwood outdoor deck floor of pre-configured dimensions.

In the exemplary embodiment of the outdoor wood decking board 10 for use in construction of an outdoor deck floor 100, the wood core 30 can be formed from the first wood species WP1, the first wood species WP1 can be any one of a common grade North American Softwood species, wherein the common grade North American Softwood species is selected from the group consisting of tight knot Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In another embodiment, of the outdoor wood decking board 10 for use in construction of an outdoor deck floor 100, with reference to FIGS. 3A-3E, the facing wood veneer 50 is formed from a second wood species WP2, the second wood species WP2 including any one of a clear grain North American Softwood species of superior grade, as a three-dimensional solid rigid wood finishing layer including a thickness ($T^2$), the width ($W^1$), and the length ($L^1$).

The superior grade of the second wood species WP2 is defined to include a first wood finishing face 52 that is non-cactile and free from growth characteristics characterized as being free of cracks, holes, cavities or knots that affect appearance or performance of the facing wood veneer 50.

The facing wood veneer 50, as shown in FIG. 3C, includes the first wood finishing face 52, the second wood finishing face 54 opposed to the first wood finishing face 52, and dual opposing longitudinal facing wood veneer side edges 56, wherein the second wood species WP2 is preselected from any one of a superior grade clear grain of North American Softwood species free from growth characteristics characterized as being free of cracks, holes, cavities or knots that affect appearance or performance to form a non-cactile superior grade clear grain North American Softwood facing wood veneer 50.

In this embodiment, the two-part emulsion polymer-isocyanate adhesive is applied to the first wood face 32 of the common grade North American Softwood wood core 30 via an adhesive spreading machine enabling and operable for providing a seamless permanent attachment of the second wood finishing face 52 of the superior grade clear grain North American Softwood facing wood veneer 50 against the first wood face 32 of the common grade North American Softwood wood core 30 forming a superior grade clear grain North American Softwood facing wood veneered common grade North American Softwood wood core 20, as shown in FIG. 3D, wherein the superior grade clear grain North American Softwood facing wood veneered common grade North American Softwood wood core 20, includes the first wood finishing face 52 of the superior grade clear grain North American Softwood facing wood veneer 50 displayed to a viewer, thereby, a plurality of outdoor wood decking boards 10 adapted to be arranged along interior longitudinal wood side edges of each other form an assembled simulated non-cactile superior grade clear grain North American Softwood outdoor deck floor 100 of pre-configured dimensions.

For purposes of the embodiments of the disclosure, the superior grade of the North American Softwood species is defined to include wood, or lumber, or facing wood veneers, having clear, defect free wood-selects having a non-cactile finish on at least the first facing wood veneer of the facing wood veneer. The minimum clear yield will be select wood and better with appearance being a major factor.

The second wood species WP2 is selected from a superior grade of the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In another embodiment, of the outdoor wood decking board 10 for use in construction of an outdoor deck floor 100, with reference to FIGS. 1 and 8A-8E, the outdoor wood decking board 10, comprises a wood core 30, as shown in FIGS. 1 and 8A formed from a first wood species WP1, as a three-dimensional solid rigid wood body including a thickness ($T^1$), a width ($W^1$), and a length ($L^1$). The wood core 30 includes a first wood face 32, a second wood face 34 opposed to the first wood face 32, and dual opposite longitudinal wood side edges 36.

The first wood species WP1 is preselected from any one of a North American Softwood species of common grade to form a common grade North American Softwood wood core 30. The common grade is defined to mean an all purpose grade of the North America Softwood species that have less amount or less percentage amount of clear, defect-free wood. The common grade wood includes characteristics that occur in U.S. North American Softwood species including tight knots, a burl, streaks, a glass worm, and the like. The common grade North American Softwood species, according to the embodiment of the disclosure, includes characteristics that occur I these woods which can be inherent within the North American Softwood species, and otherwise generic to all of the North American Softwood species, Some of the characteristics can occur naturally in the wood, or lumber, or as a result of the drying process.

The common grade North America Softwood wood core 30 is sized via a planer or a moulder to a configuration including the thickness of ($T^5$) which is equal to (($T^1$)−($T^2$). The common grade North America Softwood wood core 30 is dried to a moisture content suitable for receiving an adhesive. The adhesive is a two-part emulsion-polymer-isocyanate adhesive.

The outdoor wood decking board 10 includes a facing wood veneer characterized as being free of cracks, holes, cavities or knots 50. The facing wood veneer 50 is formed from a third wood species WP3 wherein the third wood species is an exotic hardwood species.

As shown in FIGS. 8B and 8C, the facing wood veneer characterized as being free of cracks, holes, cavities or knots 50 is formed as a three-dimensional solid rigid wood finishing layer including the thickness ($T^2$), the width ($W^1$), and the length ($L^1$). The facing wood veneer 50 includes a first wood finishing face 52 having a non-cactile finish, a second wood finishing face 54 opposed to the first wood finishing face 52, and dual opposing longitudinal facing wood veneer side edges 56, wherein the second wood species WP2 is preselected from any one of the exotic hardwood species free from growth characteristics characterized as being free of cracks, holes, cavities or knots that affect appearance or performance to form a non-cactile exotic hardwood species facing wood veneer characterized as being free of cracks, holes, cavities or knots 50.

The non-cactile exotic hardwood facing wood veneer characterized as being free of cracks, holes, cavities or knots 50 can be configured to include the thickness ($T^2$), the thickness ($T^2$) selected from the group consisting of about ⅛ inch, 1/10 inch, and 1/16 inch. Accordingly, the thickness of the wood core 30 when sized by the planer or moulder to accommodate for the thickness ($T^2$) of the non-cactile exotic hardwood facing wood veneer 50 so that the wood core 30 is sized to include the thickness ($T^5$) which is equal to (($T^1$)−($T^2$)) such that ($T^5$) is configured to the thickness of 1⅜ inches, 1⅖ inches, and 1 7/16 inches, accordingly.

To bond the non-cactile exotic hardwood species facing wood veneer characterized as being free of cracks, holes, cavities or knots 50 to the wood core 30 in the seamless permanent attachment within the formation of the outdoor wood decking board 10, the two-part emulsion-polymer-isocyanate adhesive is applied to the first wood face 32 of the common grade North America Softwood wood core 30 via an adhesive spreading machine enabling and operable for providing a seamless permanent attachment of the second wood finishing face 54 of the non-cactile exotic hardwood facing wood veneer characterized as being free of cracks, holes, cavities or knots 50 against the first wood face 32 of the common grade North America Softwood wood core 30 forming a non-cactile exotic hardwood facing wood veneered common grade North America Softwood wood core 30 wherein the non-cactile exotic hardwood facing wood veneered common grade North America Softwood wood core 20, as shown in FIG. 8C includes the first wood finishing face 52 of the exotic hardwood facing wood veneer 50 displayed to a viewer, thereby, a plurality of outdoor wood decking boards 10 adapted to be arranged along interior longitudinal wood side edges of each other form an assembled simulated non-cactile exotic hardwood outdoor deck floor 100 of pre-configured dimensions.

The exotic hardwood facing wood veneered common grade North American Softwood wood core 40 is sized to form the outdoor wood decking board 10 via the planer or moulder to a configuration including the thickness ($T^1$), a width ($W^2$) wherein the width ($W^2$) is about ¼ inch less than width ($W^1$), and the length ($L^1$).

In this embodiment, of the outdoor wood decking board 10 for use in construction of an outdoor deck floor 100 wherein the two-part EPI adhesive is utilized, includes the wood core 30 preselected from any one of the common grade North American Softwood species, the North American Softwood species is selected from the group consisting of tight knot Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In addition, in the exemplary embodiment, the facing wood veneer characterized as being free of cracks, holes, cavities or knots 50 is preselected from the third wood species WP3 of exotic hardwood species. The facing wood veneer 50 is preselected from the exotic hardwood species selected from the group consisting of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

In another embodiment, the adhesive 106 to bond the non-cactile exotic hardwood facing wood veneer characterized as being free of cracks, holes, cavities or knots 50 to the common grade North American Softwood wood core is a two-part polyurethane emulsion polymer.

In another embodiment of the outdoor wood decking board 10 for use in the construction of an outdoor deck floor 100, with reference to FIGS. 1-4E, the outdoor wood decking board 10, comprises a wood core 30, formed from a first wood species WP1, as a three-dimensional solid rigid wood body including a thickness ($T^1$), a width ($W^1$), and a length ($L^1$). The wood core 30 includes a first wood face 32, a second wood face 32 opposed to the first wood face 32, and dual opposite longitudinal wood side edges 36, wherein the first wood species WP1 is preselected from North American Softwood species of common grade to form a North American Softwood wood core 30. As shown in FIGS. 4A and 4B the wood core 30 is formed from a tight knot western red cedar 16 forming a tight knot western red cedar 16 wood core 30.

The tight knot western red cedar 16 wood core 30 is sized via a planer or a moulder to a configuration including a thickness of ($T^5$) which is equal to (($T^1$)–($T^2$)).

The tight knot western red cedar 16 wood core 30 is dried to a moisture content suitable for receiving an adhesive 106, wherein the adhesive 106 is a two-part emulsion-polymer-isocyanate adhesive.

The outdoor wood decking board 10 includes a facing wood veneer characterized as being free of cracks, holes, cavities or knots 50, formed from a second wood species WP2, as a three-dimensional solid rigid wood finishing layer including the thickness ($T^2$), the width ($W^1$), and the length ($L^1$). The facing wood veneer 50 is formed from a clear grain North American Softwood species 14 of superior grade. The clear grain North American Softwood 14 facing wood veneer 50 can includes the thickness ($T^2$). The thickness ($T^2$) is selected from the group consisting of about ⅛ inch, 1/10 inch, and 1/16 inch. Consequentially, the sized wood core includes the thickness ($T^5$) where ($T^5$) is equal to (($T^1$)–($T^2$)) selected from the group consisting of 1⅜ inch, 1⅖ inches, and 1 7/16 inches, accordingly.

The clear grain North America Softwood 14 facing wood veneer 50 including the thickness ($T^2$) of about ⅛ inch, accordingly the wood core 30 is sized to a thickness ($T^5$) of about 1⅜ inches. The clear grain North America Softwood 14 facing wood veneer 50 including the thickness ($T^2$) of about 1/10 inch, accordingly, the wood core 30 is sized to a thickness ($T^5$) of about 1⅖ inches. The clear grain North America Softwood 14 facing wood veneer 50 including the thickness ($T^2$) of about 1/16 inch, accordingly, the wood core 30 is sized to a thickness ($T^5$) of about 1 7/16 inches.

The clear grain North America Softwood 14 facing wood veneer 50 includes a first wood finishing face 52 the first wood finishing face 52 having a non-cactile finish, a second wood finishing face 54 opposed to the first wood finishing face 54, and dual opposing longitudinal facing wood veneer side edges 56. The clear grain North America Softwood 14 facing wood veneer 50 is formed from the second wood species WP2 which is preselected from the clear grain North American Softwood species 14 of superior grade free from growth characteristics characterized as being free of cracks, holes, cavities or knots that affect appearance or performance to form a clear grain North American Softwood 14 facing wood veneer 50. The first wood finishing face 52 of the clear grain North American Softwood 14 facing wood veneer 50 is non-cactile.

An adhesive 106, a two-part emulsion-polymer isocyanate adhesive is utilized to form the outdoor wood decking board 10. The two-part emulsion-polymer-isocyanate is applied to the first wood face 32 of the tight knot western red cedar 16 wood core 30 via an adhesive spreading machine enabling and operable for providing a seamless permanent attachment of the second wood finishing face 52 of the clear grain North American Softwood 14 facing wood veneer 50 against the first wood face 32 of the North American Softwood wood core 30 forming a facing wood veneered wood core 20 including a clear grain North American Softwood facing wood veneered North American Softwood wood core 20, as shown in FIGS. 3D and 4D. The clear grain North American Softwood facing wood veneered North American Softwood wood core 20 includes the non-cactile first wood finishing face 52 of the clear grain North American Softwood facing wood veneer 50 is displayed to a viewer.

The adhesive 106 utilized to bond the clear grain North American Softwood facing wood veneer 50 to the North American Softwood wood core 50 can be a two-part polyurethane emulsion polymer.

The clear grain North American Softwood facing wood veneered North American Softwood 14 tight knot western red cedar 16 wood core 40 is sized to form the outdoor wood decking board 10 via the planer or moulder to a configuration including the thickness ($T^1$), a width ($W^2$) wherein the width ($W^2$) is about ¼ inch less than width ($W^1$), and the length ($L^1$).

Thereby, a plurality of outdoor wood decking boards 10 adapted to be arranged along interior longitudinal wood side edges of each other form an assembled simulated non-cactile clear grain North American Softwood outdoor deck floor 100, as shown in FIG. 17, of pre-configured dimensions.

In the exemplary embodiment, the wood core 30 of the outdoor wood decking board 10 is composed of the tight knot western red cedar 16 of common grade North American Softwood species of common grade. The North American Softwood species is selected from the group consisting of tight knot Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In addition, the facing wood veneer 50 of the outdoor wood decking board 10 for is formed from the clear grain North American Softwood species 14 of superior grade, the clear grain North American Softwood species 14 is selected from the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

Now with reference to FIGS. 10A-10E, in an embodiment, of the outdoor wood decking board 10 for use in the construction of an outdoor deck floor 100, the outdoor wood decking board 10 comprises a first wood core $\mathbf{30}^1$ and a second wood core $\mathbf{30}^2$ bonded by means of the two-part emulsion-polymer-isocyanate together to simulate a single unit wood core 30. The first wood core 30 formed from a first wood species as a three-dimensional solid rigid wood body configured including a thickness ($T^3$), a width ($W^1$), and a length ($L^1$). The first wood core $\mathbf{30}^1$ includes a first wood face $\mathbf{32}^1$, a second wood face $\mathbf{34}^1$ opposed to the first wood face $\mathbf{32}^1$, and dual opposite longitudinal wood side edges $\mathbf{36}^1$.

The first wood core $\mathbf{30}^1$ is formed from the first wood species WP1. In the embodiment, the first wood core $\mathbf{30}^1$ is formed from a tight knot western red cedar species 16 to form a first tight knot western red cedar 16 wood core $\mathbf{30}^1$.

The second wood core $\mathbf{30}^2$ is formed as a second three-dimensional solid rigid wood body configured including the thickness ($T^3$), the width ($W^1$), and the length ($L^1$). The second wood core $\mathbf{30}^2$ includes a first wood face $\mathbf{32}^2$, a second wood face $\mathbf{34}^2$ opposed to the first wood face $\mathbf{32}^2$, and dual opposite longitudinal wood side edges $\mathbf{36}^2$. The second wood core $\mathbf{30}^2$ is, also, formed from the first wood species WP1, including the tight knot western red cedar species 16 to form a second tight knot western red cedar 16 wood core $\mathbf{30}^2$. The first tight knot western red cedar wood core $\mathbf{30}^1$ and the second tight knot western red cedar 16 wood core $\mathbf{30}^2$ are each dried to a moisture content suitable for receiving an adhesive 106.

The adhesive 106 is a two-part emulsion-polymer isocyanate adhesive. The two-part emulsion-polymer-isocyanate adhesive is applied to the second wood face $\mathbf{32}^2$ of the second tight knot western red cedar 16 wood core $\mathbf{30}^2$ and the second wood face $\mathbf{32}^1$ of the first tight knot western red cedar 16 wood core $\mathbf{30}^1$ via an adhesive spreading machine enabling and operable for providing a seamless permanent attachment of the first tight knot western red cedar 16 wood core $\mathbf{30}^1$ to the second tight knot western red cedar 16 wood core $\mathbf{30}^2$ forming a tight knot western red cedar 16 face-to-face wood core 40, as shown in FIG. 10C.

The tight knot western red cedar 16 face-to-face wood core 40 is configured including a thickness ($T^1$) when the first tight knot western red cedar 16 wood core $\mathbf{30}^1$ and the second tight knot western red cedar 16 wood core $\mathbf{30}^2$ are pressed against each other in an automated hydraulic press under heat and pressure to form the tight knot western red cedar 16 face-to-face wood core 40.

The tight knot western red cedar 16 face-to-face wood core 40 is sized via a planer or moulder to a thickness of $T^5$, such that $T^5$ is equal to $(T^1)-(T^2))$, as shown in FIG. 100.

The outdoor wood decking board 10, includes a facing wood veneer 50 formed from a third wood species WP3, selected from an exotic hardwood species, an Ipe 26 (*Handroanthus* species), as shown in FIG. 10B. The third wood species WP3 can be an exotic hardwood species formed as a three-dimensional solid rigid exotic hard wood finishing layer characterized as being free of cracks, holes, cavities or knots, to form an exotic hardwood facing wood veneer 50, as shown in FIG. 10D-10F including a thickness ($T^2$), the thickness ($T^2$), the width ($W^1$), and the length ($L^1$). The exotic hardwood facing wood veneer 50 is configured having the thickness ($T^2$). The thickness of the exotic facing wood veneer includes the thickness ($T^2$), the thickness ($T^2$) selected from the group consisting of about ⅛ inch, 1/10 inch, and 1/16 inch. Accordingly, the tight knot western red cedar 16 sized face-to-face wood core 40 includes the thickness ($T^5$) selected from the group consisting of 1⅜ inch, 1⅖ inches, and 1 7/16 inches.

The, Ipe 26 (*Handroanthus* species), exotic hardwood facing wood veneer characterized as being free of cracks, holes, cavities or knots 50 includes a first exotic hardwood finishing face 52, and a second exotic hardwood finishing face 54 opposed to the first exotic hardwood finishing face 52, and dual opposing longitudinal facing exotic hardwood veneer side edges 56, to form an exotic hardwood facing wood veneer 50. The first exotic hardwood finishing face 52 includes a non-cactile finish characterized as being free of cracks, holes, cavities or knots.

To enable and operably bond the exotic hardwood facing wood veneer 50 against the tight knot western red cedar 16 face-to-face wood core 40 the two-part emulsion-polymer-isocyanate adhesive is applied to the first wood face 32 of the first tight knot western red cedar wood core $\mathbf{30}^1$ of the tight knot western red cedar 16 face-to-face wood core 40 via the adhesive spreading machine enabling and operable for providing a seamless permanent attachment of the second exotic hardwood finishing face 54 of the exotic hardwood facing wood veneer 50 against the first wood face $32^1$ of the first tight knot western red cedar wood core $30^1$ of the tight knot western red cedar 16 face-to-face wood core 40 forming an exotic hardwood veneered tight knot western red cedar face-to-face wood core 90, as shown in FIG. 10E. In this manner, the non-cactile first exotic hard wood finishing face 52 of the exotic hardwood facing wood veneer 50 is displayed to a viewer, thereby, a plurality of outdoor wood decking boards 10 adapted to be arranged along interior longitudinal side edges of each other form an assembled simulated non-cactile exotic hardwood outdoor deck floor 100 of pre-configured dimensions.

In another embodiment, the adhesive to bond and seamlessly permanently directly attach the exotic hardwood facing wood veneer 50 to the tight knot western red cedar 16 face-to-face wood core 40 can be a two-part polyurethane emulsion polymer adhesive.

The exotic hardwood veneered tight knot western red cedar face-to-face wood core 90 is sized to form the outdoor wood decking board 10 via the planer or moulder to a configuration including the thickness ($T^1$), a width ($W^2$) wherein the width ($W^2$) is about ¼ inch less than width ($W^1$), and the length ($L^1$).

The first wood core $30^1$ and the second wood core $30^2$ is formed from the first wood species WP1 The first wood species WP1 is selected from the group consisting of a Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

The exotic hardwood facing wood veneer characterized as being free of cracks, holes, cavities or knots 50 is formed from the third wood species WP3, the third wood species WP3 is selected from any one of an exotic hardwood, the exotic hardwood is selected from the group consisting of *Angelim pedra; Angelim vermelho*; (Balau) *Shorea* spp.; (Mukulungu); *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

With reference to FIGS. 9A-9E, in another embodiment of the disclosure, an outdoor wood decking board 10 for use in the construction of an outdoor deck floor 100, comprises a first wood core $30^1$ and a second wood core $30^2$ to form a tight knot western red cedar face-to-face wood core 90 bound using a two-part emulsion-polymer-isocyanate adhesive and having a facing wood veneer 50 formed from a clear vertical grain western red cedar 14, selected from the second wood species WP2.

The first wood core $30^1$ is formed from a first wood species WP1 as a three-dimensional solid rigid wood body configured including a thickness ($T^3$), a width ($W^1$), and a length ($L^1$), The first wood core $30^1$ includes a first wood face $32^1$, a second wood face $34^1$ opposed to the first wood face $32^1$, and dual opposite longitudinal wood side edges $36^1$, wherein the first wood species WP1 is a tight knot western red cedar species to form a first tight knot western red cedar 16 wood core 30.

The second wood core $30^2$ is formed as a second three-dimensional solid rigid wood body configured including the thickness ($T^3$), the width ($W^1$), and the length ($L^1$). The second wood core $30^2$ includes a first wood face $32^2$, a second wood face $34^2$ opposed to the first wood face $32^2$, and dual opposite longitudinal wood side edges $36^2$, The second wood core $30^2$ is formed from one of the first wood species WP1, the tight knot western red cedar 16 to form a second tight knot western red cedar 16 wood core $30^2$.

The first tight knot western red cedar wood core $30^1$ and the second tight knot western red cedar wood core $30^2$ are each dried to a moisture content suitable for receiving an adhesive 106.

The adhesive 106 is a two-part emulsion-polymer-isocyanate adhesive. The two-part emulsion-polymer-isocyanate adhesive applied to the second wood face $32^2$ of the second tight knot western red cedar 16 wood core $30^2$ and the second wood face $32^1$ of the first tight knot western red cedar 16 wood core $30^1$ via an adhesive spreading machine for enabling and operable to provide a seamless permanent attachment of the first tight knot western red cedar 16 wood core $30^1$ to the second tight knot western red cedar 16 wood core 30 forming the tight knot western red cedar face-to-face wood core 90, as shown in FIG. 9D.

The tight knot western red cedar face-to-face wood core 90 is configured including a thickness ($T^1$) where the first tight knot western red cedar 16 wood core $30^1$ and the second tight knot western red cedar 16 wood core $30^2$ are pressed against each other in an automated hydraulic press under heat and pressure. The tight knot western red cedar face-to-face wood core 90 is sized via a planer or moulder to a thickness of $T^5$, such that $T^5$ is equal to $((T^1)-(T^2))$, as shown in FIG. 9E.

A facing wood veneer 50, characterized as being free of cracks, holes, cavities or knots as shown in FIG. 9D, is formed from a second wood species WP2. The second wood species WP2 being a clear vertical grain western red cedar 14, as a three-dimensional solid rigid clear vertical grain western red ceda wood finishing layer to form a clear vertical grain western red cedar 14 facing wood veneer 50. The clear vertical grain western red cedar 14 facing wood veneer 50 includes a thickness ($T^2$), the width ($W^1$), and the length ($L^1$).

The facing wood veneer 50 can include the thickness ($T^2$) preferably of about ⅛ inch. In this exemplary embodiment, the tight knot western red cedar face-to-face wood core 90 is sized to the thickness ($T^5$) of about 1⅜ inches. In another embodiment, the clear vertical grain western red cedar 14 facing wood veneer 50 can include the thickness ($T^2$) of about 1/10 inch, such that the tight knot western red cedar face-to-face wood core 90 is sized via the planer or moulder to the thickness ($T^5$) of about 1 2/5 inches. Yet in another embodiment, the clear vertical grain western red cedar 14 facing wood veneer 50 can include the thickness ($T^2$) of about 1/16 inch, such that the tight knot western red cedar face-to-face wood core 90 is sized via the planer or moulder to the thickness ($T^5$) of about 1 7/16 inches.

The clear vertical grain western red cedar 14 facing wood veneer 50 includes a first clear vertical grain western red cedar wood finishing face 52 having a non-cactile finish, a second clear vertical grain western red cedar wood finishing face 54 opposed to the first clear vertical grain western red cedar wood finishing face 52, and dual opposing longitudinal facing clear vertical grain western red cedar wood veneer side edges 56. The first clear vertical grain western red cedar wood finishing face 54 includes a non-cactile finish.

To enable and operable for the laminating of the clear vertical grain western red cedar 14 facing wood veneer 50 against the tight knot western red cedar wood core of the face-to-face wood core 90 the two-part emulsion-polymer-isocyanate is applied to the first wood face $\mathbf{32}^1$ of the first tight knot western red cedar 16 wood core $\mathbf{30}^1$ of the face-to-face wood core 40 via the adhesive spreading machine enabling and operable for providing a seamless permanent attachment of the second clear vertical grain western red cedar wood finishing face $\mathbf{54}^2$ of the clear vertical grain western red cedar 14 facing wood veneer 50 against the first wood face $\mathbf{32}^1$ of the first tight knot western red cedar 16 wood core $\mathbf{30}^1$ of the tight knot western red cedar 16 face-to wood core 40 forming a clear vertical grain western red cedar veneered tight knot western red cedar face-to-face wood core 90, as shown in FIG. 9E.

In this manner, the non-cactile first clear vertical grain western red cedar 14 wood finishing face 52 of the clear vertical grain western red cedar wood 14 facing wood veneer 50 is displayed to a viewer, thereby, a plurality of outdoor wood decking boards 10, one of which is shown in FIG. 9E, adapted to be arranged along interior longitudinal side edges of each other form an assembled simulated non-cactile clear vertical grain western red cedar wood 14 outdoor deck floor 100 of pre-configured dimensions.

The non-cactile clear vertical grain western red cedar veneered tight knot western red cedar face-to-face wood core 90 is sized to form the outdoor wood decking board 10, as shown in FIG. 9E via the planer or moulder to a configuration including the thickness ($T^1$), a width ($W^2$) wherein the width ($W^2$) is 1/4 inch less than width ($W^1$), and the length ($L^1$).

In another embodiment, the adhesive 106 is a two-part polyurethane emulsion polymer.

In the exemplary embodiment, the facing wood veneer 50, more particularly, the clear vertical grain western red cedar 14 facing wood veneer 50 includes the thickness ($T^2$), the thickness ($T^2$) selected from the group consisting of about 1/8 inch, 1/10 inch, and 1/16 inch. Accordingly, the thickness ($T^5$) of the sized tight knot western red cedar 16 face-to-face wood core 40 is configured to 1 3/8 inches, 1 2/5 inches; and 1 7/16 inches.

In another embodiment, with reference to FIGS. 8A-8E of an outdoor wood decking board 10 for use in construction of an outdoor deck floor 100, the outdoor wood decking board 10, comprises a wood core 30 and a facing wood veneer 50 bonded to the wood core 30 by means of an adhesive 106. The adhesive is a two-part polyurethane emulsion polymer.

The wood core 30, as shown in FIG. 8A is formed from a first wood species WP1, as a three-dimensional solid rigid wood body including a thickness ($T^1$), a width ($W^1$), and a length ($L^1$). The wood core 30 includes a first wood face 32, a second wood face 34 opposed to the first wood face 32, and dual opposite longitudinal wood side edges 36.

The first wood species WP1 is preselected from any one of a common grade North American Softwood species to form a common grade North American Softwood wood core 30. As shown in FIG. 8A, the wood core is formed from a tight knot western red cedar 16 to form a tight know western red cedar 16 wood core 30. The wood core 30, more particularly, the tight knot western red cedar 16 wood core 30 is sized via a planer or a moulder to a configuration including a thickness of ($T^5$) which is equal to (($T^1$)−($T^2$)). The wood core 30, more particularly, the tight know western red cedar 16 wood core 30 is dried to a moisture content suitable for receiving the two-part polyurethane emulsion polymer adhesive.

The outdoor wood decking board 10 includes a facing wood veneer 50, as shown in FIG. 8B. The facing wood veneer 50 is formed from a third wood species WP3, selected from an exotic hardwood species. In the exemplary embodiment, shown in FIGS. 8B-8C the facing wood veneer characterized as being free of cracks, holes, cavities or knots is formed from an exotic hardwood species, namely, an Ipe 26 (*Handroanthus* species), thereby forming an Ipe 26 facing wood veneer 50 characterized as being free of cracks, holes, cavities or knots.

The third wood species WP3 includes an exotic hardwood species, the Ipe 26, forming the Ipe facing wood veneer characterized as being free of cracks, holes, cavities or knots 50 as a three-dimensional solid rigid wood finishing layer including a thickness ($T^2$) where ($T^2$) is equal to 1/8 inch, the width ($W^1$), and the length ($L^1$). The facing wood veneer 50 includes a first wood finishing face 52 having a non-cactile finish, a second wood finishing face 54 opposed to the first wood finishing face 54, and dual opposing longitudinal facing wood veneer side edges 56, wherein the third wood species WP3 is preselected from any one of the exotic hardwood species free from growth characteristics characterized as being free of cracks, holes, cavities or knots that affect appearance or performance to form an exotic hardwood species facing wood veneer 50.

The two-part polyurethane emulsion polymer adhesive applied to the first wood face 32 of the wood core 30 via an adhesive spreading machine enabling and operable for providing a seamless permanent attachment of the second wood finishing face 54 of the facing wood veneer 50 against the first wood face 32 of the wood core 30 forming a facing wood veneered wood core 20 including an exotic hardwood facing wood veneered wood core, as shown in FIG. 8C. Looking more closely at FIG. 8C the Ipe 26 facing wood veneer 50 is showed partially so that the Ipe 26 facing wood veneer 50 can be shown overlaying the wood core 30, more particularly, the tight knot western red cedar wood core 30.

The exotic hardwood facing wood veneered wood core 20, more particularly, the Ipe 26 facing wood veneered wood core 20 is sized to form the outdoor wood decking board 10, as shown in FIG. 8D, via the planer or moulder to a configuration including the thickness ($T^1$), a width ($W^2$) wherein the width ($W^2$) is about 1/4 inch less than width ($W^1$), and the length ($L^1$).

The exotic hardwood facing wood veneered wood core 20, more particularly, the Ipe 26 facing wood veneered tight knot western red cedar 16 wood core 20 includes the non-cactile first exotic hardwood finishing face 52 of the exotic hardwood facing wood veneer 50, more particularly, the non-cactile first finishing face 52 of the Ipe 26 facing wood veneered tight knot western red cedar 16 displayed to a viewer. In this manner, a plurality of outdoor wood decking boards 10, one of which is shown in FIG. 8D, adapted to be arranged along interior longitudinal wood side edges of each other form an assembled simulated non-cactile exotic hardwood species outdoor deck floor of pre-configured dimensions, more particularly, a non-cactile Ipe 26 outdoor deck floor of pre-configured dimensions.

In the exemplary embodiment, the wood core 30 is formed from any one of a common grade North American Softwood species, wherein the common grade North American Softwood species is selected from the group consisting of a Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In the exemplary embodiment, the facing wood veneer 50 characterized as being free of cracks, holes, cavities or knots is formed from the exotic hardwood species, the exotic hardwood species is selected from the group consisting of *Angelim pedra; Angelim vermelho*; (Balau) *Shorea* spp.; (Mukulungu); *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

In another embodiment, the facing wood veneer 50 characterized as being free of cracks, holes, cavities or knots is formed from a second wood species WP2, the second wood species WP2. The second wood species WP2 includes any one of a superior grade clear grain North American Softwood species, the superior grade clear grain North American Softwood species is selected from the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In the exemplary embodiment, the facing wood veneer includes the thickness ($T^2$), the thickness ($T^2$) selected from the group consisting of about ⅛ inch, 1/10 inch, and 1/16 inch.

In another embodiment, of an outdoor wood decking board 10 for use in construction of an outdoor deck floor 100, with reference to FIGS. 16A-16E the outdoor wood decking board 10, comprises a core 30 bound to a facing wood veneer 50 wherein the core 30 is bound to the facing wood veneer 50 via an adhesive 106, the adhesive 106 being a two-part emulsion-polymer isocyanate.

The core 30 is formed from a rigid solid substrate, as a three-dimensional solid rigid body including a thickness ($T^1$), a width ($W^1$), and a length ($L^1$). The core 30 including a first wood face 32, a second wood face 34 opposed to the first wood face 32, a first end 38 and a second end 39, and dual opposite longitudinal side edges 36.

The core 30 is formed from the solid rigid substrate, wherein the solid rigid substrate is a wood plastic composite 130 enabling and operable to form a wood plastic composite 130 core 30. The wood plastic composite 130 core 30 is sized via a planer or a moulder to a configuration including a thickness of ($T^5$) which is equal to $((T^1)-(T^2))$. In the exemplary embodiment, the wood plastic composite 130 core 30 includes a thickness ($T^1$) of about 1½ inches.

With reference to FIG. 16C the outdoor wood decking board 10 includes a facing wood veneer 50. As shown in FIG. 16C, the facing wood veneer 50 is formed from a second wood species WP2, including a clear vertical grain western red cedar 14 characterized as being free of cracks, holes, cavities or knots selected from any one of a superior grade clear grain North American Softwood species, the superior grade clear grain North American Softwood species is selected from the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In another embodiment, the outdoor wood decking board 10 can include a facing wood veneer characterized as being free of cracks, holes, cavities or knots 50, formed from a third wood species WP3, of an exotic hardwood species as an alternative to the superior grade clear grain North American Softwood, as a three-dimensional solid rigid wood finishing layer including a thickness ($T^2$) where ($T^2$) is equal to ⅛ inch, the width ($W^1$), and the length ($L^1$). The facing wood veneer 50 includes a first wood finishing face 52, a second wood finishing face 54 opposed to the first wood finishing face 52, a first finishing end 58, a second finishing end 59, and dual opposing longitudinal facing wood veneer side edges 56.

In this exemplary embodiment, the wood plastic composite 130 core 30 having a thickness ($T^1$) of about 1½ inches is sized via the planer or moulder to the thickness ($T^5$) of about 1⅜ inches.

In another embodiment, the exotic hardwood facing wood veneer 50 is configured having a thickness ($T^2$) of about 1/10 inch, and accordingly, the wood plastic composite 130 core 30 is sized to a thickness ($T^5$) of about 1⅖ inches. In another embodiment, the facing wood veneer 50 is configured having a thickness ($T^2$) of about 1/16 inch, and accordingly, the wood plastic composite 130 core 30 is sized to a thickness ($T^5$) of about 1 7/16 inches.

The third wood species WP3 is an exotic hardwood wood species forming an exotic hardwood facing wood veneer characterized as being free of cracks, holes, cavities or knots 50, The exotic hardwood species is selected from the group consisting of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*), African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico *Zapote, Zapote*, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

An adhesive 106, a two-part emulsion-polymer-isocyanate adhesive is applied to the first wood face 32 of the wood plastic composite core 30, enabling and operable for providing a seamless permanent attachment of the second wood finishing face 54 of the exotic hardwood facing wood veneer 50 against the first wood face 32 of the wood plastic composite core 30 forming an exotic hardwood facing wood veneered wood plastic composite core 20, as shown in FIG. 160, wherein the exotic hardwood facing wood veneered wood plastic composite core 20 includes the first finishing face 52 of the exotic hardwood facing wood veneer 50 displayed to a viewer, thereby, a plurality of outdoor wood decking boards 10 arranged along interior longitudinal side edges of each other form an assembled simulated non-cactile exotic hardwood veneered outdoor deck floor 100 of preconfigured dimensions.

In another embodiment, the adhesive 106 is a two-part polyurethane emulsion polymer adhesive.

The exotic hardwood facing wood veneered wood plastic composite core 20 is sized via a moulder to form the outdoor wood decking board 10 configured including the thickness of ($T^1$), a width of ($W^2$) which is about ¼ inch less than the width ($W^1$), and the length ($L^1$).

In another embodiment of the outdoor wood decking board 10 for use in construction of an outdoor deck floor 100, the outdoor wood decking board 10, comprises a core 30, formed from a rigid solid substrate, the rigid solid substrate is cement board formed from the rigid solid substrate, as a three-dimensional solid rigid body including a thickness ($T^1$), a width ($W^1$), and a length ($L^1$), the core 30 including a first wood face 32, a second wood face 34 opposed to the first wood face, a first end 38 and a second end 39, and dual opposite longitudinal side edges 36 wherein the rigid sold substrate is the cement board enabling and operable to form a cement board core 30.

The cement board core 30 is sized via a planer or a moulder to a configuration including a thickness of ($T^5$) which is equal to (($T^1$)−($T^2$)) where ($T^2$) is about ⅛ inch.

The outdoor wood decking board 10 includes a facing wood veneer 50, formed from a third wood species WP3, as a three-dimensional solid rigid wood finishing layer including a thickness ($T^2$) where ($T^2$) is equal ⅛ inch, the width ($W^1$), and the length ($L^1$).

In another embodiment, the facing wood veneer 50 is configured to include a thickness ($T^2$) of about 1/10 inch. Accordingly, the cement board core 30 is sized to the thickness ($T^5$) of about 1⅖ inches. In another embodiment, the facing wood veneer 50 is configured having a thickness ($T^2$) of about 1/16 inch. Accordingly, the cement board core 30 is sized to the thickness ($T^5$) of about 1 7/16 inches.

The facing wood veneer 50 includes a first wood finishing face 52, a second wood finishing face 54 opposed to the first wood finishing face 52, a first finishing end 58, a second finishing end 59, and dual opposing longitudinal facing wood veneer side edges 56.

The third wood species WP3 is an exotic hardwood wood species, that is non-tactile characterized as being free of cracks, holes, cavities or knots, forming an exotic hardwood facing wood veneer. The exotic hardwood species is selected from the group consisting of *Angelim pedra; Angelim vermelho*; (Balau) *Shorea* spp.; (Mukulungu); *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

An adhesive 106, the adhesive 106 being a two part emulsion polymer-isocyanate adhesive applied to the first wood face 32 of the cement board core 30, enabling and operable for providing a seamless permanent attachment of the second wood finishing face 54 of the exotic hardwood facing wood veneer 50 against the first wood face 32 of the cement board core 30 forming an exotic hardwood facing wood veneered cement board core 20.

In another embodiment, the adhesive 106 is a two-part polyurethane emulsion polymer adhesive.

The exotic hardwood facing wood veneered cement board core 20 includes the first finishing face 52 of the exotic hardwood facing wood veneer 50 displayed to a viewer, thereby, a plurality of outdoor wood decking boards 10 arranged along interior longitudinal side edges of each other form an assembled simulated non-cactile exotic hardwood veneered outdoor deck floor 100 characterized as being free of cracks, holes, cavities or knots of pre-configured dimensions.

The exotic hardwood facing wood veneered cement board core 20 is sized via a moulder to form the outdoor wood decking board 10 configured including the thickness of ($T^1$), a width of ($W^2$) which is about ¼ inch less than the width ($W^1$), and the length ($L^1$).

In another embodiment of the disclosure, a method 1000 of manufacturing an outdoor wood decking board 10 for use in the construction of an outdoor deck floor 100, is disclosed. The embodiment of the method 1000 is disclosed with reference to FIGS. 1-17, with a more particular attention to FIGS. 1, 3A-3E, 8A-8E and 17. The method 1000 of manufacturing the outdoor wood decking board 10 for use in the construction of an outdoor deck floor 100 comprises, a first step 1001 providing a wood core 30 formed from a first wood species WP1. As shown in FIGS. 1, 3A and 8A the wood core 30 is formed from a first wood species WP1.

The first wood species WP1 is any one of a common grade or general purpose grade of the North American Softwood species, formed as a three-dimensional solid rigid wood body. In the exemplary embodiments, as shown in FIGS. 1, 3A and 8A the wood core 30 is formed from a tight knot western red cedar 16 species, thereby providing a tight knot western red cedar 16 wood core 30 formed from the North American Softwood species of common grade.

The North American Softwood species the first wood species WP1 of the wood core 30 is formed from any one of a common grade of North American Softwood species selected from the group consisting of tight knot Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

The second step 1002 of the method 1000 includes configuring the tight knot western red cedar 16 wood core 30 is configured having a thickness ($T^1$) of about 1½ inches, a width ($W^1$) of about 5½ inches, and a length ($L^1$) of about 8.00-20.00 feet inclusive. The tight knot western red cedar 16 wood core 30 includes a first wood face 32, a second wood face 34 opposed to the first wood face 32, and opposite longitudinal wood side edges 36. The wood core 30 can be configured at 8.00-20.00 feet inclusive depending upon the preconfigured dimensions for the outdoor wood decking boards 10 configured for the manufacture of the outdoor deck floor 100.

A third step 1003 includes drying the tight knot western red cedar 16 wood core 30 to a moisture content suitable for receiving an adhesive 120, the adhesive 120 being a two-part emulsion polymer-isocyanate adhesive.

In another embodiment of the method 1000, the adhesive 106 is a two-part polyurethane emulsion polymer.

Next, the method 1000 includes a fourth step 1004 of sizing the wood core 30, more particularly, sizing the tight knot western red cedar 16 wood core 30 through a planer or a moulder to a thickness ($T^5$) of about 1⅜ inches, the width ($W^1$) of 5½ inches, and the length ($L^1$) of 8.00-20.00 feet inclusive, as shown in FIGS. 3B and 8C. The thickness is sized to the thickness ($T^5$) of abut 1⅜ inches to accommodate for the thickness ($T^2$) of a facing wood veneer 50 being about ⅛ inch such that ($T^5$) is equal to (($T^1$)−$T^2$)).

In another embodiment, the thickness ($T^2$) of the facing wood veneer 50 is 1/10 inch, and, accordingly, the wood core 30, more particularly, the tight knot western red cedar 16 wood core 30 is sized to the thickness ($T^5$) of about 1⅖ inches where the ($T^5$) is equal to (($T^1$)−($T^2$)).

In another embodiment, the thickness ($T^2$) of the facing wood veneer 50 is 1/16 inch, and, accordingly, the wood core 30, more particularly, the tight know western red cedar 16 wood core 30 is sized to the thickness ($T^5$) of about 1 7/16 inches where the ($T^5$) is equal to (($T^1$)−($T^2$)).

A fifth step 1005, as shown in FIG. 8B, is providing the facing wood veneer characterized as being free of cracks, holes, cavities or knots 50 Is formed from a third wood species WP3, wherein the third wood species WP3 is selected from any one of an exotic hardwood species. In the exemplary embodiment, the facing wood veneer 50 is formed from a pre-selected exotic hardwood, and formed as a three-dimensional solid rigid layer providing an exotic hardwood facing wood veneer characterized as being free of cracks, holes, cavities or knots 50. As shown in FIG. 3C, in another embodiment of the outdoor wood decking board 10 the facing wood veneer 50 is selected from the second wood species WP2 of superior grade or select grade of North American Softwood species.

The exotic hardwood species of the third wood species WP3 is selected from the group consisting of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia* mahogany; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

In the exemplary embodiment, the facing wood veneer 50 is formed from Ipe characterized as being free of cracks, holes, cavities or knots 26 (*Handroanthus* species), as shown in FIGS. 8B and 8C. The exotic hardwood facing wood veneer 50 formed of the Ipe 26 is non-cactile. Where the surface is not non-cactile characterized as being free of cracks, holes, cavities or knots, the first finishing face 52 of the facing wood veneer 50 including the IPE 26 exotic hardwood can be smoothed by mechanical means of a sanding and polishing the first finishing face 52 of the facing wood veneer 50 to provide the non-cactile finish characterized as being free of cracks, holes, cavities or knots.

A sixth step 1006 includes configuring the exotic hardwood facing wood veneer 50 having a thickness ($T^2$) of about ⅛ inch, the width ($W^1$) of about 5½ inches, and the length ($L^1$) of about 8.00-20.00 feet inclusive. The facing wood veneer 50, more particularly, the exotic hardwood facing wood veneer characterized as being free of cracks, holes, cavities or knots 50 includes a first wood finishing face 52 having a non-cactile finish characterized as being free of cracks, holes, cavities or knots, a second wood finishing face 54 opposed to the first wood finishing face 52, and opposing longitudinal facing wood veneer side edges 56. The facing wood veneer 50 can be configured at about 8.00-20.00 feet inclusive to correspond to the length configuration of the wood core 30. As noted above, the exotic hardwood facing wood veneer can be configured including a thickness ($T^2$) of any one of about ⅛ inch, 1/10 inch, or 1/16 inch, as detailed above.

A seventh step 1007 includes providing a two-part emulsion polymer-isocyanate adhesive.

An eighth step 1008 includes spreading the two-part emulsion polymer-isocyanate adhesive through an adhesive spreading machine such that the two-part emulsion polymer-isocyanate adhesive covers the entire first wood face 32 of the tight knot western red cedar 16 wood core 32.

A ninth step 1009 includes overlaying the second wood finishing face 54 of the exotic hardwood facing wood veneer 50 against the first wood face 32 of the tight knot western red cedar 16 wood core 30, as shown in FIG. 8C. A closer look at FIG. 8C shows a partial view of the exotic hardwood facing wood veneer 50 for illustrative purposes to show the exotic hardwood facing wood veneer 50 overlaying the wood core 30.

A tenth step 1010 includes laminating the second wood finishing face 54 of the facing wood veneer 50 against the first wood face 32 of the wood core 30, ore particularly the second wood finishing face 54 of the exotic hardwood facing wood veneer 50 against the first wood face 32 of the tight knot western red cedar 16 wood core 30 through an automated hydraulic press under heat and pressure for providing a visually seamless permanent attachment of the exotic hardwood facing wood veneer 50 against the tight knot western red cedar 16 wood core 30 forming an exotic hardwood veneered tight knot western red cedar 16 wood core 30, as shown in FIG. 8C.

The exotic hardwood veneered tight knot western red cedar 14 wood core 20 includes a thickness ($T^1$) of about 1½ inches, a width ($W^1$) of about 5½ inches, and a length ($L^1$) of about 8.00-20.00 inches inclusive. Noticeably, the first wood finishing face 52 having a non-cactile finish characterized as being free of cracks, holes, cavities or knots of the exotic hardwood facing wood veneer 50 is displayed to a viewer. Thereby, a plurality of outdoor wood decking boards 10 adapted to be arranged along interior longitudinal side edges 36 of each other form an assembled simulated non-cactile exotic hardwood outdoor deck floor 100.

An eleventh step 1011 includes removing the exotic hardwood veneered tight knot western red cedar 16 wood core 20 from the automated hydraulic press.

The twelfth step 1012 includes cooling the exotic hardwood veneered tight knot western red cedar 14 wood core 20 at ambient temperature.

A thirteenth step 1013 includes sizing the exotic hardwood veneered tight knot western red cedar 16 wood core 20 through the planer or moulder to form the outdoor wood decking board 100 the thickness ($T^1$) of about 1½ inches, a width ($W^2$) of about 5¼ inches, and the length ($L^1$) of about 8.00-20.00 feet, as shown in FIGS. 8D-8E.

In the exemplary method 1000, the first wood species WP1 of the wood core 30, as listed above, is formed from a common grade or general purpose grade of North American Softwood species, including tight knot grade, selected from the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In the exemplary method 1000, the facing wood veneer 50 can be selected from a second wood species WP2 to form the facing wood veneer 50. The second wood species WP2 can be selected from the group consisting of superior grade western red cedar, (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), Pine/Spruce (*Pinus* species, *Picea* species).

The exemplary method 1000, can further comprise a fourteenth step 1014 including sanding the exotic hardwood veneered tight knot western red cedar 16 wood core 20 in preparation of staining the exotic hardwood veneered tight knot western red cedar 16 wood core 40.

In addition, the exemplary method 1000 can further comprise a fifteenth step 1015 including immersing a colorless wood conditioner flood coat via a coating process to the exotic hardwood veneered tight knot western red cedar 16 wood core 20 wherein the colorless wood conditioner comprises one or more agents, wherein an agent of the one or more agents is selected from the group comprising, fungicides, biocides, insecticides, water repellents, UV blockers, fire retardants, wood hardeners, and strength enhances.

In an embodiment of the exemplary method 1000, the length ($L^1$) of the wood core 30 can be configured to a length (L) selected from the group of lengths ($L^1$) comprising, 8.00, 10.00 feet, 12.00 feet, 14.00 feet, 16.00 feet, 18.00 feet, and 20.00 feet. In addition, in an embodiment of the exemplary method 1000, the length ($L^1$) of the facing wood veneer 50 can be configured to a length ($L^1$) selected from the group of lengths ($L^1$) comprising, 8.00 feet, 10.00 feet, 12.00 feet, 14.00 feet, 16.00 feet, 18.00 feet, and 20.00 feet.

In another embodiment of the exemplary method 1000 of manufacturing an outdoor wood decking board 10 for use in the construction of an outdoor deck floor 100, the length ($L^1$) of the wood core 30 can be pre-configured to a length ($L^1$) selected from the group of lengths comprising, 9.00 feet, 11.00 feet, 13.00 feet, 15.00 feet, 17.00 feet, 19.00 feet, and 21.00 feet; and the length ($L^1$) of the facing wood veneer 50 can be pre-configured to a length selected from the group of lengths comprising, 9.00 feet, 11.00 feet, 13.00 feet, 15.00 feet, 17.00 feet, 19.00 feet, and 21.00 feet.

In another embodiment of the exemplary method 1000 of manufacturing an outdoor wood decking board 10 for use in the construction of an outdoor deck floor 100, the wood core 30, is configured including the thickness ($T^1$) of about 1½ inches, a width ($W^3$) of about 3½ inches, and the length ($L^1$) of about 8.0 feet, and can be configured at about 8.00 feet-20.00 feet inclusive. Subsequently, the wood core 30, is sized via the planer or moulder to a configuration including the thickness ($T^5$) of about 1⅜ inches, a width ($W^3$) of about 3½ inches, and the length ($L^1$) of about 8.0 feet, and can be configure at about 8.00-20.00 feet inclusive, for accommodating the thickness ($T^2$) of the facing wood veneer 50.

Further, the facing wood veneer 50, can be configured including the thickness ($T^2$) of about ⅛ inch, the width ($W^1$)

of about 5½ inches, and the length ($L^1$) of about 8.00 feet, and can be configured at 8.00 feet to 20.00 feet inclusive. The exotic facing wood veneer 50 and can include a thickness ($T^1$) of about 1½ inches, a width of about 3½ inches, and a length of about 8.00-20.00 feet. Accordingly, the exotic hardwood veneered tight knot western red cedar 16 wood core 20 can be sized via the planer or moulder to form the outdoor wood decking board 10 which is configured including the thickness ($T^1$) of about 1½ inches, a width ($W^4$) of about 3¼ inches, and the length ($L^1$) of about 8.00-20.00 feet inclusive. The wood core 30 can be configured at 8.00-20.00 feet inclusive depending upon the preconfigured dimensions for the outdoor wood decking boards 10 configured for the manufacture of the outdoor deck floor 100.

In another embodiment of the exemplary method 1000 of manufacturing an outdoor wood decking board 10 for use in the construction of an outdoor deck floor 100, the wood core 30 can be configured including a thickness ($T^4$) of about 1⅛ inches, the width ($W^1$) of about 5½ inches, and the length ($L^1$) of about 8.00-20.00 feet inclusive.

Subsequently, the wood core 30 is sized via the planer or moulder to a configuration including a thickness ($T^6$) of about 1.00 inch, the width ($W^1$) of about 5½ inches, and a length ($L^1$) of about 8.00-20.00 feet inclusive to accommodate for the thickness ($T^2$) of the facing wood veneer 50.

The facing wood veneer 50, can be configured including the thickness ($T^2$) of about ⅛ inch, the width ($W^1$) of about 5½ inches, and the length ($L^1$) of about 8.00-20.00 feet inclusive. Thereby, the exotic hardwood veneered tight knot western red cedar 16 wood core 20 is configured including the thickness ($T^4$) of about 1⅛ inches, the width ($W^1$) of about 5½ inches, and the length ($L^1$) of about 8.00-20.00 feet inclusive.

Subsequently, the exotic hardwood veneered tight knot western red cedar 16 wood core 20, is sized via the planer or moulder to form the outdoor wood decking board 10 so configured including the thickness ($T^4$) of about 1⅛ inches, the width ($W^2$) of about 5¼ inches, and the length ($L^1$) of about 8.00-20.00 feet inclusive.

In yet another embodiment of the exemplary method 1000 of manufacturing an outdoor wood decking board 10 for use in the construction of an outdoor deck floor 100, the wood core 30 is configured including a thickness ($T^4$) of about 1⅛ inches, a width ($W^3$) of about 3½ inches, and the length ($L^1$) of about 8.00-20.00 feet inclusive.

Subsequently, the wood core 30 is sized via the planer or moulder to a configuration including a thickness ($T^6$) of about 1.0 inch, the width ($W^3$) of about 3½ inches, and the length ($L^1$) of about 8.00-20.00 feet inclusive for accommodating the thickness ($T^2$) of the facing wood veneer 50.

The facing wood veneer 50 can be configured including the thickness ($T^2$) of about ⅛ inch, the width (W) of about 3½ inches, and the length ($L^1$) of about 8.00-20.00 feet. Subsequently, the exotic hardwood veneered tight knot western red cedar 16 wood core 30 is sized to form the outdoor wood decking board 10 via the planer or moulder to a configuration including the thickness ($T^4$) of about 1⅛ inches, the width ($W^4$) of about 3¼ inches, and the length ($L^1$) of about 8.00-20.00 feet inclusive.

In yet another embodiment of the exemplary method 1000 of manufacturing an outdoor wood decking board 10 for use in the construction of an outdoor deck floor 100 the wood core 30 can be configured including the thickness ($T^1$) of about 1½ inches, a width ($W^5$) of about 7¼ inches, and the length ($L^1$) of about 8.00-20.00 feet inclusive.

Subsequently, the wood core 30 is sized via the planer or moulder to a configuration including the thickness ($T^3$) of about 1⅜ inches, the width ($W^5$) of about 7¼ inches, and the length ($L^1$) of about 8.00-20.00 feet inclusive to accommodate for the thickness ($T^2$) of the facing wood veneer 50.

The facing wood veneer 50 can be configured including the thickness ($T^2$) of about ⅛ inch, the width ($W^5$) of about 7¼ inches, and the length ($L^1$) of about 8.00-20.00 feet inclusive. Thereby the exotic hardwood veneered tight knot western red cedar 16 wood core 30 is configured including the thickness ($T^1$) of about 1½ inches, a width ($W^5$) of about 7¼ inches, and a length ($L^1$) of about 8.00-20.00 feet inclusive.

Thereafter, the exotic hardwood veneered tight knot western red cedar 16 wood core 20 is sized to form the outdoor wood decking board 10 via the planer or moulder to a configuration including the thickness ($T^1$) of about 1½ inches, a width ($W^6$) of about 7⅛ inches, and the length ($L^1$) of about 8.00-20.00 feet inclusive.

In another embodiment of the disclosure, a method 2000 of manufacturing an outdoor wood decking board 10 for use in the construction of an outdoor deck floor 100, is disclosed. The embodiment of the method 2000 is disclosed with reference to FIGS. 1-17, with a more particular attention to FIGS. 1-3E and 17. The method 2000 of manufacturing the outdoor wood decking board 10 for use in the construction of an outdoor deck floor 100 comprises, a first step 2001 providing a wood core 30 formed from a first wood species WP1. The wood core 30 is shown in FIGS. 1, 2A, 2B, and 3A.

The first wood species WP1 is any one of a common grade or general purpose grade of the North American Softwood species, formed as a three dimensional solid rigid wood body. In the exemplary embodiment, as shown in FIGS. 1, 2A, and 3A, the wood core 30 is formed from a tight knot western red cedar 16 species, thereby providing a tight knot western red cedar 16 wood core 30.

The North American Softwood species the first wood species WP1 of the wood core 30 is formed from any one of a common grade of North American Softwood species selected from the group consisting of tight knot Western Red Cedar (*Thuja* plicate), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

The second step 2002 includes configuring the tight knot western red cedar 16 wood core 30 is configured having a thickness ($T^1$) of about 1½ inches, a width ($W^1$) of about 5½ inches, and a length ($L^1$) of about 8.00-20.00 feet inclusive. The tight knot western red cedar 16 wood core 30 includes a first wood face 32, a second wood face 34 opposed to the first wood face 32, and opposite longitudinal wood side edges 36. The wood core 30 can be configured at 8.00-20.00 feet inclusive depending upon the preconfigured dimensions for the outdoor wood decking boards 10 configured for the manufacture of the outdoor deck floor 100.

A third step 2003 includes drying the tight knot western red cedar 16 wood core 30 to a moisture content suitable for receiving an adhesive 120.

The adhesive is a two-part emulsion polymer-isocyanate adhesive.

Next, the method 2000 includes a fourth step 2004 of sizing the wood core 30, more particularly, the tight knot western red cedar 16 wood core 30 through a planer or a moulder to a thickness ($T^5$) of about 1⅜ inches, the width ($W^1$) of about 5½ inches, and the length ($L^1$) of 8.00-20.00 feet inclusive to accommodate for the thickness of a facing wood veneer 50, as shown in FIG. 3B.

In another embodiment of the method 2000, the thickness ($T^2$) of the facing wood veneer 50 is 1/10 inch, and, accordingly, the wood core 30, more particularly, the tight knot western red cedar 16 wood core 30 is sized to the thickness ($T^5$) of about 1⅖ inches where the ($T^5$) is equal to (($T^1$)–($T^2$)).

In another embodiment of the method 2000, the thickness ($T^2$) of the facing wood veneer 50 is 1/16 inch, and, accordingly, the wood core 30, more particularly, the tight know western red cedar 16 wood core 30 is sized to the thickness ($T^5$) of about 1 7/16 inches where the ($T^5$) is equal to (($T^1$)–($T^2$)).

A fifth step 2005, as shown in FIG. 3C, is providing the facing wood veneer 50 formed from a second wood species WP2, wherein the second wood species WP2 is selected from any one of a superior quality grade of a North American Softwood species. The North American Softwood species selected from the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In the exemplary method 2000, a clear vertical grain western red cedar 14, is selected to form the facing wood veneer 50, as shown in FIG. 3C. The facing wood veneer 50, more particularly, the clear vertical grain western red cedar 14 facing wood veneer 50 is formed as a three-dimensional solid rigid layer providing a clear vertical grain western red cedar 16 facing wood veneer 50.

A sixth step 2006 includes configuring the clear vertical grain western red cedar 14 facing wood veneer 50 having a thickness ($T^2$) of about ⅛ inch, the width ($W^1$) of about 5½ inches, and the length ($L^1$) of about 8.00-20.00 feet inclusive. The facing wood veneer 50, more particularly, the clear vertical grain western red cedar 14 facing wood veneer 50 includes a first wood finishing face 52 having a non-cactile finish characterized as being free of cracks, holes, cavities or knots, a second wood finishing face 54 opposed to the first wood finishing face 52, and opposing longitudinal facing wood veneer side edges 56. The facing wood veneer 50 can be configured at about 8.00-20.00 feet inclusive to correspond to the configuration of the wood core 30.

A seventh step 2007 includes providing the two-part emulsion polymer-isocyanate adhesive.

An eighth step 2008 includes spreading the two-part emulsion polymer-isocyanate adhesive 120 through an adhesive spreading machine such that the two-part emulsion polymer-isocyanate covers the entire first wood face 32 of the tight knot western red cedar 16 wood core 32.

A ninth step 2009 includes overlaying the second wood finishing face 54 of the clear vertical grain western red cedar 14 facing wood veneer 50 against the first wood face 32 of the tight knot western red cedar 16 wood core 30, as shown in FIG. 3D.

A tenth step 2010 includes laminating the facing wood veneer 50 against the wood core 30, more particularly the second wood finishing face 54 of the clear vertical grain western red cedar 14 facing wood veneer 50 against the first wood face 32 of the tight knot western red cedar 16 wood core 30 through an automated hydraulic press under heat and pressure for providing a visually seamless permanent attachment of the clear vertical grain western red cedar 14 wood veneer 50 against the tight knot western red cedar 16 wood core 30 forming a clear vertical grain veneered tight knot western red cedar 16 wood core 30, identified at 20 as shown in FIG. 3D. The clear vertical grain western red cedar 14 veneered tight knot western red cedar 14 wood core 20 includes a thickness ($T^1$) of about 1½ inches, a width ($W^1$) of about 5½ inches, and a length ($L^1$) of about 8.00-20.00 inches inclusive. Noticeably, the first wood finishing face 52 having a non-cactile finish characterized as being free of cracks, holes, cavities or knots of the clear vertical grain western red cedar 14 facing wood veneer 50 is displayed to a viewer. Thereby, a plurality of outdoor wood decking boards 10 adapted to be arranged along interior longitudinal side edges 36 of each other form an assembled simulated non-cactile clear vertical grain western red cedar 14 outdoor deck floor 100 characterized as being free of cracks, holes, cavities or knots, as shown in FIG. 17.

An eleventh step 2011 includes removing the clear vertical grain western red cedar 14 veneered tight knot western red cedar 16 wood core 20 from the automated hydraulic press.

The twelfth step 2012 includes cooling the clear vertical grain western red cedar 14 veneered tight knot western red cedar 14 wood core 20 at ambient temperature.

A thirteenth step 2013 includes sizing the clear vertical grain western red cedar 14 veneered tight knot western red cedar 16 wood core 20 through the planer or moulder to form the outdoor wood decking board 10 the thickness ($T^1$) of about 1½ inches, a width ($W^2$) of about 5¼ inches, and the length ($L^1$) of about 8.00-20.00 feet, as shown in FIG. 3E.

In the exemplary method 2000, the first wood species WP1 of the wood core 30, as listed above, is formed from a common grade or general purpose grade of North American Softwood species, including tight knot grade, selected from the group consisting of Western Red Cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In the exemplary method 2000, the second wood species WP2 of the facing wood veneer 50, can be selected from the group consisting of superior grade: western red cedar, (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), Pine/Spruce (*Pinus* species, *Picea* species).

The exemplary method 2000, can further comprise a fourteenth step 2014 including sanding the clear vertical grain western red cedar 14 veneered tight knot western red cedar 16 wood core 30 to ensure a non-cactile surface characterized as being free of cracks, holes, cavities or knots of the clear vertical grain western red cedar 14 veneered tight knot western red cedar wood core 20.

In addition, the exemplary method 2000 can further comprise a fifteenth step 2015 including immersing a colorless wood conditioner flood coat via a coating process to the clear vertical grain western red cedar 14 veneered tight knot western red cedar 16 wood core 30 wherein the colorless wood conditioner comprises one or more agents, wherein an agent of the one or more agents is selected from the group comprising, fungicides, biocides, insecticides, water repellants, UV blockers, fire retardants, wood hardeners, and strength enhances.

In an embodiment of the exemplary method 2000, the length ($L^1$) of the wood core 30 can be configured to a length (L) selected from the group of lengths ($L^1$) comprising, 8.00, 10.00 feet, 12.00 feet, 14.00 feet, 16.00 feet, 18.00 feet, and 20.00 feet. In addition, in an embodiment of the exemplary method 200, the length ($L^1$) of the facing wood veneer 50 can be configured to a length ($L^1$) selected from the group of lengths ($L^1$) comprising, 8.00 feet, 10.00 feet, 12.00 feet, 14.00 feet, 16.00 feet, 18.00 feet, and 20.00 feet.

In another embodiment of the exemplary method 2000 of manufacturing an outdoor wood decking board 10 for use in the construction of an outdoor deck floor 100, the length ($L^1$) of the wood core 30 can be pre-configured to a length ($L^1$) selected from the group of lengths comprising, 9.00 feet, 11.00 feet; 13.00 feet, 15.00 feet, 17.00 feet, 19.00 feet, and 21.00 feet; and the length ($L^1$) of the facing wood veneer 50 can be pre-configured to a length selected from the group of lengths comprising, 9.00 feet, 11.00 feet, 13.00 feet, 15.00 feet, 17.00 feet, 19.00 feet, and 21.00 feet.

In another embodiment of the exemplary method 2000 of manufacturing an outdoor wood decking board 10 for use in the construction of an outdoor deck floor 100, the wood core 30, is configured, with reference to FIGS. 4A-4E including the thickness (V) of about 1½ inches, a width ($W^3$) of about 3½ inches, and the length ($L^1$) of about 8.0 feet, and can be configured at about 8.00 feet-20.00 feet inclusive. Subsequently, the wood core 30, as shown in FIG. 4B, is sized via the planer or moulder to a configuration including the thickness ($T^5$) of about 1⅜ inches, a width ($W^3$) of about 3½ inches, and the length (L) of about 8.0 feet, and can be configure at about 8.00-20.00 feet inclusive, for accommodating the thickness ($T^2$) of the facing wood veneer 50.

Further, the facing wood veneer 50, as shown in FIG. 4C, is configured including the thickness ($T^2$) of about ⅛ inch, the width ($W^1$) of about 5½ inches, and the length ($L^1$) of about 8.00 feet, and can be configured at 8.00 feet to 20.00 feet inclusive. As shown in FIG. 4D, the clear vertical grain western red cedar 14 veneered tight knot western red cedar 16 wood core 30 includes a thickness ($T^1$) of about 1½ inches, a width of about 3½ inches, and a length of about 8.00-20.00 feet. The clear vertical grain western red cedar 14 veneered tight knot western red cedar 16 wood core 20 is sized via the planer or moulder to form the outdoor wood decking board 10 which is configured including the thickness ($T^1$) of about 1½ inches, a width ($W^4$) of about 3¼ inches, as shown in FIG. 40, and the length ($L^1$) of about 8.00-20.00 feet inclusive. The wood core 30 can be configured at 8.00-20.00 feet inclusive depending upon the pre-configured dimensions for the outdoor wood decking boards 10 configured for the manufacture of the outdoor deck floor 100.

With reference to FIGS. 6A-6F, in another embodiment of the exemplary method 2000 of manufacturing an outdoor wood decking board 10 for use in the construction of an outdoor deck floor 100, the wood core 30 is configured including a thickness ($T^4$) of about 1⅛ inches, the width ($W^1$) of about 5½ inches, and the length ($L^1$) of about 8.00-20.00 feet inclusive.

Subsequently, the wood core 30 is sized via the planer or moulder to a configuration including a thickness ($T^6$) of about 1.00 inch, the width ($W^1$) of about 5½ inches, and a length ($L^1$) of about 8.00-20.00 feet inclusive to accommodate for the thickness ($T^2$) of the facing wood veneer 50.

The facing wood veneer 50, is configured including the thickness ($T^2$) of about ⅛ inch, the width ($W^1$) of about 5½ inches, and the length ($L^1$) of about 8.00-20.00 feet inclusive. Thereby, the clear vertical grain western red cedar 14 veneered tight knot western red cedar 16 wood core 20 is configured including the thickness ($T^4$) of about 1⅛ inches, the width ($W^1$) of about 5½ inches, and the length ($L^1$) of about 8.00-20.00 feet inclusive.

Subsequently, the clear vertical grain western red cedar 14 veneered tight knot western red cedar 16 wood core 20, is sized via the planer or moulder to form the outdoor wood decking board 10 so configured including the thickness ($T^4$) of about 1⅛ inches, the width ($W^2$) of about 5¼ inches, and the length ($L^1$) of about 8.00-20.00 feet inclusive.

In yet another embodiment of the exemplary method 2000 of manufacturing an outdoor wood decking board 10 for use in the construction of an outdoor deck floor 100, the wood core 30 is configured including a thickness ($T^4$) of about 1⅛ inches, as shown in FIGS. 6A-6B a width ($W^3$) of about 3½ inches, and the length ($L^1$) of about 8.00-20.00 feet inclusive.

Subsequently, the wood core 30 is sized via the planer or moulder to a configuration including a thickness ($T^6$) of about 1.0 inch, as shown in FIG. 6B, the width ($W^3$) of about 3½ inches, and the length ($L^1$) of about 8.00-20.00 feet inclusive for accommodating the thickness ($T^2$) of the facing wood veneer 50.

The facing wood veneer 50 is configured including the thickness ($T^2$) of about ⅛ inch, the width ($W^3$) of about 3½ inches, and the length ($L^1$) of about 8.00-20.00 feet. Subsequently, the clear grade vertical grain western red cedar 14 veneered tight knot western red cedar 16 wood core 20 is sized to form the outdoor wood decking board 10 via the planer or moulder to a configuration including the thickness ($T^4$) of about 1⅛ inches, the width ($W^4$) of about 3¼ inches, and the length ($L^1$) of about 8.00-20.00 feet inclusive, as shown in FIG. 6E.

In yet another embodiment of the exemplary method 2000 of manufacturing an outdoor wood decking board 10 for use in the construction of an outdoor deck floor 100 the wood core 30 is configured including the thickness ($T^1$) of about 1½ inches, a width ($W^5$) of about 7¼ inches, and the length ($L^1$) of about 8.00-20.00 feet inclusive, as shown in FIGS. 5A-5F.

Subsequently, the wood core 30 is sized via the planer or moulder to a configuration including the thickness ($T^5$) of about 1⅜ inches, as shown in FIG. 5B, the width ($W^5$) of about 7¼ inches, and the length ($L^1$) of about 8.00-20.00 feet inclusive to accommodate for the thickness ($T^2$) of the facing wood veneer 50.

The facing wood veneer 50 is configured including the thickness ($T^2$) of about ⅛ inch, the width ($W^5$) of about 7¼ inches, and the length ($L^1$) of about 8.00-20.00 feet inclusive. Thereby the clear vertical grain western red cedar 14 veneered tight knot western red cedar 16 wood core 30 is configured including the thickness ($L^1$) of about 1½ inches, a width ($W^5$) of about 7¼ inches, and a length ($L^1$) of about 8.00-20.00 feet inclusive.

The clear vertical grain western red cedar 14 veneered tight knot western red cedar 16 wood core 20 is sized to form the outdoor wood decking board 10 via the planer or moulder to a configuration including the thickness ($L^1$) of about 1½ inches, a width ($W^6$) of about 7⅛ inches, and the length ($L^1$) of about 8.00-20.00 feet inclusive.

In another embodiment of the disclosure a method 3000 of manufacturing an outdoor wood decking board 10 for use in the construction of an outdoor deck floor 100 is disclosed including a first wood core $\mathbf{30}^1$ and a second wood core $\mathbf{30}^2$, and a two-part emulsion polymer-isocyanate adhesive, with reference to FIGS. 9A-9B in the understanding of the third method 3000 embodied in the disclosure.

The method 3000, comprises a first step 3001 including providing a first wood core 30, as shown in FIG. 9A, formed from a first wood species WP1 as a three-dimensional solid rigid wood body[1] including a thickness ($T^3$) of about ¾ inch, a width ($W^1$) of 5½ inches, and a length ($L^1$) of about 8.00, but not limited to. The first wood core 30 includes a first wood face[1] 32, a second wood face[1] 34 opposed to the first wood face[1] 30, and dual opposite longitudinal wood side edges 36, wherein the first wood species WP1 is a tight knot western red cedar 16 species thereby forming a first tight knot western red cedar wood core 30.

The second step 3002 of the method 3000 of manufacturing the outdoor wood decking board 10 for use in the construction of an outdoor deck floor 10 includes providing a second wood core $\mathbf{30}^2$, as shown in FIG. 9B, formed from the tight knot western red cedar 16 species as a three dimensional solid rigid wood body configured as a second tight knot western red cedar wood core $\mathbf{30}^2$ including the thickness ($T^3$) of about ¾ inch, the width ($W^1$) of 5½ inches, and the length ($L^1$) of about 8.00 feet, but not limited to, thereby providing a second tight knot western red cedar 16 wood core $\mathbf{30}^2$ including a first wood face[2] 32, a second wood face[2] 34 opposed to the first wood face[1] 32, and dual opposite longitudinal wood side edges[2] 37.

A third step 3003 of the method 3000 includes drying the first wood core 30, the first tight knot western red cedar wood core 30, and the second wood core, $\mathbf{30}^2$, the second tight knot western red cedar wood core $\mathbf{30}^2$ to a moisture content suitable for receiving an adhesive 106. The adhesive 106 is the two-part emulsion polymer-isocyanate adhesive.

A fourth step 3004 of the second method 3000 of manufacturing the outdoor wood decking board 10 for use in the construction of an outdoor deck floor 100 includes providing the two-part emulsion polymer-isocyanate adhesive.

A fifth step 3005 of the method 3000 includes spreading the two-part emulsion polymer-isocyanate adhesive applied to the second wood face[2] $\mathbf{34}^2$ of the second tight knot western red cedar 16 wood core $\mathbf{30}^2$ and to the second wood face[1] 34 of the first tight knot western red cedar wood core 30 through an adhesive spreading machine such that the two-part emulsion polymer-isocyanate covers the entire second wood face[2] $\mathbf{34}^2$ of the second tight knot western red cedar 16 wood core $\mathbf{30}^2$ and the entire second wood face[1] 34 of the first tight knot western red cedar 16 wood core 30.

A sixth step 3006 of the second method 3000 of manufacturing an outdoor wood decking board 10 for use in the construction of the outdoor deck floor 100 includes overlaying the second wood face[2] $\mathbf{34}^2$ of the second tight knot western red cedar 16 wood core $\mathbf{30}^2$ against the second wood face[1] 34 of the first tight knot western red cedar 16 wood core 30 through an automated hydraulic press under heat and pressure enabling and operable for providing a visually seamless permanent attachment of the second wood face[1] 34 of the first tight knot western red cedar 16 wood core 30 against the second wood face[2] $\mathbf{34}^2$ of the second tight knot western red cedar 16 wood core $\mathbf{30}^2$ forming a face-to-face wood core 40, as shown in FIG. 9C, more particularly, a tight knot western red cedar 16 face-to-face wood core 40, simulating a single three dimensional solid rigid wood body having a thickness ($T^1$) of about 1½ inches, the width ($W^2$) of about 5½ inches, and the length of about 8.00 inches, but not limited to, wherein the first wood face[1] 32 of the first tight knot western red cedar 16 wood core 30 is opposed to the first wood face[2] $\mathbf{34}^2$ of the second tight knot western red cedar wood core $\mathbf{30}^2$.

A seventh step 3007 of the second method 3000 of manufacturing the outdoor wood decking board 10 for use in the construction of an outdoor deck floor 100 includes removing the tight knot western red cedar 16 face-to-face wood core 40 from the automated hydraulic press.

An eighth step 3008 of the second method 3000 includes cooling the tight knot western red cedar 16 face-to-face wood core 40 at ambient temperature.

A ninth step 3009 of the third method 3000 of manufacturing the outdoor wood decking board 10 for use in the construction of an outdoor deck floor 100 includes sizing the tight knot western red cedar 16 face-to-face wood core 40 via a planer or a moulder to a thickness ($T^5$) of about 1⅜ inch, the width ($W^2$) of about 5½ inches, and the length of about 8.00 inches, but not limited to, to accommodate for the thickness ($T^2$) of a facing wood veneer 50.

In another embodiment, the thickness ($T^2$) of the facing wood veneer 50 is 1/10 inch, and, accordingly, the face-to-face wood core 40, more particularly, the tight knot western red cedar 16 face-to-face wood core 40 is sized to the thickness ($T^5$) of about 1⅖ inches where the ($T^5$) is equal to $((T^1)-(T^2))$.

In another embodiment, the thickness ($T^2$) of the facing wood veneer 50 is 1/16 inch, and, accordingly, the face-to-face wood core 40, more particularly, the tight know western red cedar 16 face-to-face wood core 40 is sized to the thickness ($T^5$) of about 1 7/16 inches where the ($T^5$) is equal to $((T^1)-(T^2))$.

A tenth step 3010 of the method 3000 of manufacturing an outdoor wood decking board 10 for use in the construction of an outdoor deck floor 100 includes providing the facing wood veneer 50, as shown in FIG. 9D, formed from a second wood species WP2 as a three-dimensional solid rigid finishing layer including a thickness ($T^2$) of about ⅛ inch, the width ($W^1$) of about 5½ inches, and the length ($L^1$) of about 8.00 feet, but not limited to.

The facing wood veneer 50 includes a first wood finishing face 52 having a non-cactile finish characterized as being free of cracks, holes, cavities or knots, a second wood finishing face 54 opposed to the first wood finishing face 52, and dual opposing longitudinal facing wood veneer side edges 56. The second wood species WP2 is a clear vertical grain western red cedar 14 species, thereby providing a clear vertical grain western red cedar facing wood veneer 50.

An eleventh step 3011 of the method 3000 includes providing the two-part emulsion polymer-isocyanate adhesive.

The twelfth step 3012 of method 3000 manufacturing the outdoor wood decking board 10 for use in the construction of an outdoor deck floor 100 includes spreading the two-part emulsion polymer-isocyanate adhesive through the adhesive spreading machine such that the pressure sensitive liquid adhesive 120 covers the entire first wood face[1] 32 of the first tight knot western red cedar wood core 30 of the tight knot western red cedar 16 face-to-face wood core 40.

A thirteenth step 3013 of the method 3000 of manufacturing the outdoor wood decking board 10 for use in the construction of an outdoor deck floor 100 includes overlaying the second wood finishing face 54 of the clear vertical grain western red cedar 14 facing wood veneer 50, as shown in FIG. 9D, against the first wood face $\mathbf{32}^1$ of the first tight knot western red cedar 16 wood core 30 of the tight knot western red cedar 16 face-to-face wood core 40.

A fourteenth step 3014 of the method 3000 of manufacturing the outdoor wood decking board 10 for use in the construction of an outdoor deck floor 100 includes laminating the clear vertical grain western red cedar 14 facing wood veneer 50 against the tight knot western red cedar 16 face-to-face wood core 40 through the automated hydraulic press under heat and pressure enabling and operable for providing a seamless permanent attachment of the second wood finishing face 54 of the clear vertical grain western red cedar 14 facing wood veneer 50 against the first wood face 32$^1$ of the first tight knot western red cedar 16 wood core 30 of the tight knot western red cedar 16 face-to-face wood core 40 forming a facing wood veneered face-to-face wood core 90, with reference to FIG. 10B, namely, a clear vertical grain western red cedar 14 veneered tight knot western red cedar 16 face-to-face wood core 40. The facing wood veneered face-to-face wood core 90, is configured including the thickness ($T^1$) of about 1½ inches, the width ($W^1$) of about 5½ inches, and the length ($L^1$) of about 8.00 feet, but not limited to.

The first wood finishing face 52, the first wood finishing face 52 being non-cactile, of the clear vertical grain western red cedar 14 facing wood veneer 50 is displayed to a viewer, thereby a plurality of outdoor wood decking boards 10 adapted to be arranged along interior longitudinal side edges 36 of each other thereby form an assembled simulated non-cactile clear vertical grain western red cedar outdoor deck floor 100 characterized as being free of cracks, holes, cavities or knots formed of pre-configured dimensions.

A fifteenth step 3015 of the method 3000 of manufacturing the outdoor wood decking board 10 for use in the construction of an outdoor deck floor 100 includes sizing the facing wood veneered face-to-face wood core 90, namely, the clear vertical grain western red cedar 14 veneered tight knot western red cedar 16 face-to-face wood core 40 to form the outdoor wood decking board 10 via a planer or moulder configured to the thickness ($T^1$) of about 1½ inches, a width ($W^2$) of about 5¼ inches, and the length ($L^1$) of about 8.00 feet, but not limited to, as shown in FIG. 9E.

In another embodiment of the method 3000 of manufacturing the outdoor wood decking board 10 for use in the construction of an outdoor deck floor 100 the adhesive 106 can be a polyurethane emulsion polymer (PEP).

In another embodiment of the method 3000 of manufacturing the outdoor wood decking board 10 for use in the construction of an outdoor deck floor 100, the second method 3000 further comprises providing a colorless wood conditioner coat via a coating process to the facing wood veneered face-to-face wood core 90, more particularly, the clear vertical grain western red cedar 14 veneered tight knot western red cedar 16 face-to-face wood core 40 at 90 wherein the colorless wood conditioner comprises one or more agents, wherein an agent of the one or more agents is selected from the group comprising, fungicides, biocides, insecticides, water repellants, UV blockers, fire retardants, wood hardeners, and strength enhances.

In the exemplary embodiment of the method 3000 of manufacturing the outdoor wood decking board 10 for use in the construction of an outdoor deck floor 100, the method 3000 embodies the first wood core 30 and the second wood core 30$^2$ to each be formed from any one of the first wood species WP1 of common quality grade, or general purpose grade of the first wood species WP1, where the first wood species WP1 is any one of North American Softwood species selected from the group consisting of western red cedar (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In the exemplary embodiment of the method 3000 of manufacturing the outdoor wood decking board 10 for use in the construction of the outdoor deck floor 100, the facing wood veneer 50 is formed from any one of the second wood species WP2. The second wood species WP2 is selected from a superior quality grade of North American Softwood species, selected from the group consisting of clear vertical grain western red cedar, (*Thuja plicata*), (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), and Pine/Spruce (*Pinus* species, *Picea* species).

In the exemplary embodiment of the method 3000 of manufacturing the outdoor wood decking board 10 for use in the construction of an outdoor deck floor 100, the facing wood veneer characterized as being free of cracks, holes, cavities or knots 50 can be formed from any one of the third wood species WP3 selected from a group of exotic hardwood species. The exotic hardwood wood species, is selected from the group consisting of *Angelim pedra; Angelim vermelho*; (Balau) *Shorea* spp.;

(Mukulungu) *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia* mahogany; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

Another embodiment of the method 3000 is shown in FIG. 10A 10F which shows an outdoor wood decking board 10 including the face-to-face wood core 40. In the exemplary embodiment, the first wood core 30 and the second wood core 30$^2$ are each formed form a tight knot western red cedar 16 and the facing wood veneer 50 is formed from Ipe 26.

In the exemplary embodiment of the method 3000 of manufacturing the outdoor wood decking board 10 for use in the construction of an outdoor deck floor 100, the first wood core 30, as shown in FIG. 10A can be configured including the thickness ($T^3$) of about ¾ inch, a width ($W^5$) of about 7¼ inches, and the length ($L^1$) of about 8.00-20.0 feet inclusive. Similarly, the second wood core 30$^2$, as shown in FIG. 10B is configured including the thickness ($T^3$) of about ¾ inch, the width ($W^5$) of about 7¼ inches, and the length ($L^1$) of about 8.00-20.00 feet inclusive.

Further, in the exemplary embodiment, the face-to-face wood core 40, as shown in FIG. 10C, is sized via the planer or moulder to the thickness of $T^5$ of about 1⅜ inches, as shown in FIG. 10E. The facing wood veneer 50, as shown in FIG. 10D, is formed from the third wood species WP3, particularly, Ipe 26.

The facing wood veneer 50 is configured including the thickness ($T^2$) of about ⅛ inch, the width ($W^5$) of about 7¼ inches, and the length ($L^1$) of about 8.00-20.00 feet, and thereby, the facing wood veneered face-to-face wood core 90, particularly, the Ipe 26 veneered tight knot western red cedar 16 face-to-face wood core 40 at 90 is configured with the thickness ($T^1$) of about 1½ inches, the width ($W^5$) of about 7¼ inches, and the length ($L^1$) of about 8.00-20.00 feet inclusive.

Subsequently, the Ipe 26 veneered tight knot western red cedar 16 face-to-face wood core 40 is sized to form the outdoor wood decking board 10, as shown in FIG. 10F, via the planer or moulder to the thickness ($T^1$) of about 1½ inches, a width ($W^6$) of about 7⅛ inches, and the length ($L^1$) of about 8.00 feet-20.00 feet inclusive.

In another embodiment of the second method 3000 of manufacturing an outdoor wood decking board 10 for use in the construction of an outdoor deck floor 100, the first wood core 30, as shown in FIG. 11A, is formed from a tight knot western red cedar 16 selected from the second wood species WP2 of common grade or all purpose grade North American Softwood species and is configured including the thickness ($T^3$) of about ¾ inch, a width ($W^3$) of about 3½ inches, and the length ($L^1$) of about 8.00 feet-20.00 feet inclusive. Similarly, the second wood core 30$^2$, as shown in FIG. 11B, is formed from the tight knot western red cedar and is configured including the thickness ($T^3$) of about ¾ inch, the width ($W^3$) of about 3½ inches, and the length ($L^1$) of about 8.0 feet-20 feet inclusive.

The face-to-face wood core 40 is configured including the thickness ($T^1$) of about 1½ inches, the width ($W^3$) of about 3½ inches, and the length ($L^1$) of about 8.0 feet, but not limited to. The face-to-face wood core 40 is sized via the planer or moulder to the thickness of $T^5$ of about 1⅜ inches to accommodate for the thickness ($T^3$) of the facing wood veneer 50.

The facing wood veneer 50, as shown in FIG. 11E is formed from the Alaskan Yellow Cedar 22 configured including the thickness ($T^2$) of about ⅛ inch, the width ($W^3$) of about 3½ inches, and the length ($L^1$) of about 8.00 feet but not limited to, and thereby, the facing wood veneered face-to-face wood core 40, Alaskan Yellow Cedar, particularly, the 22 veneered tight knot western red cedar 16 wood core 40 at 90 is configured with the thickness ($T^1$) of about 1½ inches, the width ($W^3$) of about 3½ inches, and the length ($L^1$) of about 8.00 feet but not limited to.

Accordingly, the Alaskan Yellow Cedar 22 veneered tight knot western red cedar 16 face-to-face wood core 40 at 90 is sized via the planer or moulder to form the outdoor wood decking board 10 shown at FIG. 11G including the thickness ($L^1$) of about 1½ inches, a width ($W^4$) of about 3¼ inches, and the length ($L^1$) of about 8.00 feet but not limited to.

In yet another embodiment, of the disclosure, a method 4000 of manufacturing an outdoor wood decking board 10 for use in the construction of an outdoor deck floor 100, is embodied. Reference is made to FIGS. 16A-16E. The method 4000 includes a first step 4001 including providing a core 30 formed from a rigid solid substrate as a three-dimensional solid rigid body, wherein the rigid solid substrate is a wood plastic composite 130 enabling and operable to form a wood plastic composite core 30, as shown in FIG. 16A.

The second step 4002 includes configuring the wood plastic composite 130 core 30 having a thickness ($T^1$) of about 1½ inches, a width ($W^1$) of about 5½ inches, and a length ($L^1$) of about 8.00-20.00 feet inclusive, the wood plastic composite 130 core 30 including a first wood face 32, a second face 34 opposed to the first wood face$^1$ 32, a first end 38, a second end 39, and opposite longitudinal side edges 36.

The third step 4003 includes sizing the wood plastic composite 130 core 30 through a planer or a moulder to a thickness ($T^5$) of about 1⅜ inches, the width ($W^1$) of 5½ inches, and the length ($L^1$) of 8.00-20.00 feet inclusive, as shown in FIG. 16B. The wood plastic composite 130 core 30 is sized to the thickness ($T^5$) to accommodate for the thickness ($T^2$) of the facing wood veneer 50.

In another embodiment, the thickness ($T^2$) of the facing wood veneer 50 is 1/10 inch, and, accordingly, the wood plastic composite 130 core 30, is sized to the thickness ($T^5$) of about 1⅖ inches where the ($T^5$) is equal to (($T^1$)−($T^2$)).

In another embodiment, the thickness ($T^2$) of the facing wood veneer 50 is 1/16 inch, and, accordingly, the wood plastic composite 130 core 30 is sized to the thickness ($T^5$) of about 1 7/16 inches where the ($T^5$) is equal to (($T^1$)−($T^2$)).

The fourth step 4004 includes providing a facing wood veneer 50, as shown in FIG. 16C, formed from a second wood species WP2 of superior grade clear grain North American Softwood species as a three-dimensional solid rigid finishing layer, wherein the superior grade clear grain North American Softwood species is a clear grain western red cedar 14 enabling and operable to provide a clear grain western red cedar 14 facing wood veneer 50.

The fifth step 4005 of the method 4000 includes configuring the clear grain western red cedar facing wood veneer having a thickness ($T^2$) of about ⅛ inch, the width ($W^1$) of about 5½ inches, and the length ($L^1$) of about 8.00-20.00 feet inclusive. The clear grain western red cedar 14 facing wood veneer 50 includes a first wood finishing face 52, a second wood finishing face 54 opposed to the first wood finishing face 52, a first finishing end 58, a second finishing end 59, and opposing longitudinal facing wood veneer side edges 56.

The sixth step 4006 of the fourth method 4000 includes providing an adhesive 106. The adhesive is a two-part emulsion polymer-isocyanate adhesive.

The seventh step 4007 of the method 4000 includes spreading the two-part emulsion polymer-isocyanate adhesive through an adhesive spreading machine such that the two-part emulsion polymer-isocyanate adhesive covers the entire first wood face$^1$ 32 of the wood plastic composite core 30.

The eighth step 4008 of the fourth method 4000 includes overlaying the second finishing face 54 of the clear grain western red cedar 14 facing wood veneer 50 against the first wood face 32 of the wood plastic composite core 30.

The ninth step 4009 includes laminating the clear grain western red cedar 14 facing wood veneer 50 against the wood plastic composite 30, as shown in FIG. 16D, through an automated hydraulic press under heat and pressure for providing a visually seamless permanent attachment of the clear grain western red cedar wood 14 facing wood veneer 50 against the wood plastic composite core 30 forming a clear grain western red cedar 14 veneered wood plastic composite core 30 such that the first wood finishing face 52 of the clear grain western red cedar 14 facing wood veneer 50 is displayed to a viewer, thereby, a plurality of outdoor wood decking boards 10 adapted to be arranged along interior longitudinal side edges 36 of each other form an assembled simulated non-cactile clear grain western red cedar 14 outdoor deck floor 100 of pre-configured dimensions wherein the clear grain western red cedar 14 veneered wood plastic composite core 30 is configured including the thickness ($T^1$) of about 1½ inches, the width ($W^1$) of about 5½ inches; and the length ($L^1$) of about 8.00 feet-20.00 feet inclusive.

The tenth step 4010 of the fourth method 4000 includes removing the clear grain western red cedar 14 veneered wood plastic composite core 30 from the automated hydraulic press.

The eleventh step 4011 includes cooling the clear grain western red cedar 14 veneered wood plastic composite core 30 at ambient temperature.

The twelfth step 4012 includes sizing the clear grain western red cedar 14 veneered plastic wood core 30 through the planer or moulder to form the outdoor wood decking board 30, as shown in FIG. 16E configured including the thickness ($T^1$) of about 1½ inches, a width ($W^2$) of about 5¼ inches, and the length ($L^1$) of about 8.00-20.00 feet.

In another embodiment of method 4000, the core 30, can be formed from a cement board 132 to form a cement board core 30. The cement board 132 is a tile underlayment for wet areas. It is resistant to moisture and mold. The cement board 132 is available commercially through Hardie Baker Cement Boards.

In an embodiment of the method 4000, the second wood species of which the facing wood veneer 50 is formed is any one of a superior grade North American Softwood species, wherein the North American Softwood species is selected from the group consisting of (*Thuja plicata*), (*Thuja occidentalis*), Douglas Fir (*Pseudotsuga menziesii*), Western Larch (Larry *occidentalis*), Alpine Larch (*Larix lyallii*), Alaskan Yellow Cedar (*Chamaecyparis nootkatensis*), Hemlock (*Tsuga heterophylla*), Port of Oxford Cedar (*Chamaecyparis lawsoniana*), Redwood (*Sequoia sempervirens*), Pine/Spruce (*Pinus* species, *Picea* species).

In another embodiment, of the method 4000 of manufacturing an outdoor wood decking board 10 for use in the construction of the outdoor wood deck floor, the facing wood veneer characterized as being free of cracks, holes, cavities or knots 50 is formed from a third wood species WP3, the third wood species WP3 including an exotic hardwood wood species, wherein the exotic hardwood species is selected from the group consisting of *Angelim pedra; Angelim vermelho*; (Balau) *Shorea* spp.; (Mukulungu) *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp, *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*).

All patent applications, and publications (when applicable), and patents (when applicable) mentioned in this specification are indicative of the levels of those skilled in the art to which the subject matter of the disclosure of the invention pertains. All patent applications, and publications (when applicable), and patents (when applicable) are herein incorporated by reference to the same extent as if each individual patent application, publication, patent was specifically and individually indicated to be incorporated by reference.

While various embodiments have been described above, it should be understood that they have been presented by way of example only, and not limitation. Where schematics and/or embodiments described above indicate certain components arranged in certain orientation or positions, the arrangement of components may be modified. While the embodiments have been particularly shown and described, it will be understood that various changes in form and details may be made. Although various embodiments have been described as having particular features and/or combinations of components, other embodiments are possible having a combination of any features and/or components from any of embodiments as discussed above. Furthermore, any portion of the apparatus and/or methods described herein may be combined in any combination, except mutually exclusive combinations. While certain embodiments have been described in detail above, it should be understood that various embodiments can share common features and such description applies equally to such features between embodiments. The embodiments, described herein can include various combination and/or sub-combinations or the functions, components, and/or features of the different embodiments described. The Drawings disclosed herein are not drawn to scale.

Where methods and/or events described above indicate certain events and/or procedures occurring in certain order, the ordering of certain events and/or procedures may be modified. Additionally, certain events and/or procedures may be performed concurrently in a parallel process when possible, as well as performed sequentially, as described above.

What is claimed is:

1. An outdoor wood decking board for use in construction of an outdoor deck floor, the outdoor wood decking board, comprising:

a core, formed from a solid substrate, configured as a single solid core;

wherein the solid substrate is a wood plastic composite;

the single solid core formed from the wood plastic composite configured as a single solid wood plastic composite core, the single solid wood plastic composite core including a thickness ($T^5$), a width ($W^1$), a length ($L^1$), a first wood plastic composite face, a second wood plastic composite face, a first wood plastic composite end and a second wood plastic composite end, and dual opposing longitudinal wood plastic composite side edges;

a single solid facing wood veneer, characterized as being free of cracks, holes, cavities or knots, formed from a hardwood species;

wherein the hardwood species is selected from the group consisting of *Angelim pedra; Angelim vermelho*; (Balau) *Shorea* spp.; (Mukulungu); *Autranella congolensis*; (Tigerwood) *Astronium graveolens*; African Padauk (*Pterocarpus soyauxii*); African Walnut (*Lovoa trichilioides*); African Mahogany *Khaya anthotheca; Khaya grandifoliola; Khaya ivorensis; Khaya senegalensis*; Hondoran Mahogany-*Swietenia macrophylla*; and Cuba Mahogany *Swietenia mahogany*; and Mexican Mahogany (*Swietnia bumilis*), *Swietenia mahogani*; Bamboo (*Phyllostachys* and *Bambusa* genera); Bosse, *Guarea* (*Guarea* spp., *G. cedrata* and *G. thompsonii*); Bulletwood, Massaranduba (*Manilkara bidentata*); Burma Padauk (*Pterocarpus macrocarpus*); Cancharana (*Cabralea cangerana*); Cebil (*Anadenanthera colubrina*); Chico Zapote, Zapote, Sapodilla (*Manilkara zapota*); Cumaru (*Dipteryx odorata*); Ipe (*Handroanthus* species); Iroko (*Milicia excelsa, M. regia* (syn. *Chlorophora excelsa, C. regia*)); Jatoba (*Hymenaea courbaril*); *Koa* (*Acacia Koa*); Santos Mahogany (*Myroxylon balsamum*), (*Meliaceae* species); Makore (*Tieghemella* species); African Padauk (*Pterocarpus soyauxii*); Purple Heart (*Peltogyne* spp.); River Red Gum (*Eucalyptus camaldulensis*); Sapele (*Entandrophragma cylindricum*); Shedua (Ovangkol) (*Guibourtia ehia*); Sirari (*Guibourtia hymenaeifolia*); Spanish Cedar (*Cedrela odorata*); Tamarind (*Tamarindus indica*); Teak (*Tectona grandis*); Ebony Blackbead (*Ebenopsis ebano*); African Blackwood (*Dalbergia melanoxylon*); and Bismarck Black *Myzomela* (*Myzomela pammelaena*);

wherein the single solid facing wood veneer formed from any one of the hardwood species is configured as a single solid hardwood facing wood veneer, the single solid hardwood facing wood veneer including a thickness ($T^2$), the width ($W^1$) which is equal to the ($W^1$) of the single solid wood plastic composite core, and the length ($L^1$) which is equal to the ($L^1$) of the single solid wood plastic composite core, a first hardwood finishing face, a second hardwood finishing face opposed to the first hardwood finishing face, a first hardwood finishing end, a second hardwood finishing end, and dual opposing longitudinal facing hardwood veneer side edges;

an adhesive;

wherein the adhesive is a two-part emulsion polymer-isocyanate, the two-part emulsion polymer-isocyanate consisting of 10-15 parts of a hardener to 100 parts of an emulsion polymer-isocyanate; and wherein the single solid wood plastic composite core is permanently directly attached to the single solid hardwood facing wood veneer such that the first wood plastic composite face of the single solid wood plastic composite core and the second hardwood finishing face of the single solid hardwood facing wood veneer are permanently directly attached via the two-part emulsion polymer-isocyanate adhesive to form a single solid hardwood facing wood veneered wood plastic composite core of the outdoor wood decking board which conforms to the standards of AC280, ASTM D-2559, and ANSI A190.1.

2. The outdoor wood decking board for use in the construction of the outdoor deck floor, according to claim 1, wherein:

the thickness ($T^2$) of the single solid hardwood facing wood veneer is selected from the group comprising, 1/16 inch, 1/8 inch, 3/16 inch; and the single solid hardwood facing wood veneered wood plastic composite core is configured including a thickness ($T^1$) of about 1 inches, a width ($W^2$) of about 5¼ inches, and the length ($L^1$) of about 8.00-20.00 feet inclusive.

3. The outdoor wood decking board for use in the construction of the outdoor deck floor, according to claim 1, wherein:

the thickness ($T^2$) of the single solid hardwood facing wood veneer is selected from the group comprising, 1/16 inch, 1/8 inch, 3/16 inch; and the single solid hardwood facing wood veneered wood plastic composite core is configured including a thickness ($T^1$) of about 1½ inches, a width ($W^4$) of about 3¼ inches, and the length ($L^1$) of about 8.00-20.00 feet inclusive.

4. The outdoor wood decking board for use in the construction of the outdoor deck floor, according to claim 1, wherein:

the thickness ($T^2$) of the single solid hardwood facing wood veneer is selected from the group comprising, 1/16 inch, 1/8 inch, 3/16 inch; and the single solid hardwood facing wood veneered wood plastic composite core is configured including a thickness ($T^4$) of about 1⅛ inches, a width ($W^2$) of about 5¼ inches, and the length ($L^1$) of about 8.00-20.00 feet inclusive thereof.

5. The outdoor wood decking board for use in the construction of the outdoor deck floor, according to claim 1, wherein:

the thickness ($T^2$) of the single solid hardwood facing wood veneer is selected from the group comprising, 1/16 inch, 1/8 inch, 3/16 inch; and the single solid hardwood facing wood veneered wood plastic composite core is configured including a thickness ($T^4$) of about 1⅛ inches, a width ($W^4$) of about 3¼ inches, and the length ($L^1$) of about 8.00-20.0 feet inclusive.

6. The outdoor wood decking board for use in the construction of the outdoor deck floor, according to claim 1, wherein:

the thickness ($T^2$) of the single solid hardwood facing wood veneer is selected from the group comprising, 1/16 inch, 1/8 inch, 3/16 inch; and the single solid hardwood facing wood veneered wood plastic composite core is configured including a thickness ($T^1$) of about 1½ inches, a width ($W^6$) of about 7⅛ inches, and the length ($L^1$) of about 8.00-20.00 feet inclusive.

7. The outdoor wood decking board for use in the construction of the outdoor deck floor, according to claim 1, wherein:

the thickness ($T^2$) of the single solid hardwood facing wood veneer is selected from the group comprising, 1/16 inch, 1/8 inch, 3/16 inch; and the single solid hardwood facing wood veneered wood plastic composite core is configured including a thickness ($T^4$) of about 1⅛ inches, a width ($W^5$) of about 7¼ inches, and the length ($L^1$) of about 8.00-20.00 feet inclusive.

8. An outdoor wood decking board for use in construction of an outdoor deck floor, the outdoor wood decking board, comprising:

a single solid wood plastic composite core;

the single solid wood plastic composite core including a thickness ($T^5$), a width ($W^1$), a length ($L^1$), a first wood plastic composite face, a second wood plastic composite face, a first wood plastic composite end, a second wood plastic composite end, and dual opposing longitudinal wood plastic composite side edges;

a single solid facing wood veneer, characterized as being free of cracks, holes, cavities or knots, formed from a North American softwood species;

wherein the North American softwood species is selected from the group consisting of Western Red Cedar (*Thuja plicata*); (*Thuja occidentalis*), Douglas Fir (*Pseudotsuga menziesii*), Western Larch (*Larix occidentalis*), Alpine Larch (*Larix lyallii*), Alaskan Yellow Cedar (*Chamaecyparis nootkatensis*), Hemlock (*Tsuga heterophylla*); Port of Oxford Cedar (*Chamaecyparis lawsoniana*), Redwood (*Sequoia sempervirens*), and Pine (*Pinus* species, *Picea* species);

wherein the single solid facing wood veneer formed from any one of the North American softwood species is configured as a single solid North American softwood facing wood veneer including a thickness ($T^2$), the width ($W^1$) which is equal to the ($W^1$) of the single solid wood plastic composite core, and the length ($L^1$) which is equal to the ($L^1$) of the single solid wood plastic composite core, a first North American softwood finishing face, a second North American softwood finishing face opposed to the first North American softwood finishing face, a first North American softwood finishing end, a second North American softwood finishing end, and dual opposing longitudinal facing North American softwood veneer side edges;

wherein the North American softwood species is characterized as having a vertical grain being free from knots embedded therein such that the single solid North American softwood facing wood veneer includes a vertical grain free of knots embedded therein;

an adhesive;

wherein the adhesive is a two-part emulsion polymer-isocyanate, the two-part emulsion polymer-isocyanate consisting of 10-15 parts of a hardener to 100 parts of an emulsion polymer-isocyanate; and wherein the single solid wood plastic composite core is permanently directly attached to the single solid North American softwood facing wood veneer such that the first wood plastic composite face of the single solid wood plastic composite core and the second North American softwood finishing face of the single solid North American softwood facing wood veneer are permanently directly attached via the two-part emulsion polymer-isocyanate adhesive to form a single solid North American softwood facing wood veneered wood plastic composite core of the outdoor wood decking board which conforms to the standards of AC280, ASTM D-2559, and ANSI A190.1.

9. The outdoor wood decking board for use in the construction of the outdoor deck floor, according to claim 8, wherein:

the thickness ($T^2$) of the single solid North American softwood facing wood veneer is selected from the group comprising, 1/16 inch, 1/8 inch, 3/16 inch; and the single solid North American softwood facing wood veneered wood plastic composite core is configured including a thickness ($T^1$) of about 1½ inches, a width ($W^2$) of about 5¼ inches, and the length ($L^1$) of about 8.00-20.00 feet inclusive.

10. The outdoor wood decking board for use in the construction of the outdoor deck floor, according to claim 8, wherein:

the thickness ($T^2$) of the single solid North American softwood facing wood veneer is selected from the group comprising, 1/16 inch, 1/8 inch, 3/16 inch; and the single solid North American softwood facing wood veneered wood plastic composite core is configured including a thickness ($T^1$) of about 1½ inches, a width ($W^4$) of about 3¼ inches, and the length ($L^1$) of about 8.00-20.00 feet inclusive.

11. The outdoor wood decking board for use in the construction of the outdoor deck floor, according to claim 8, wherein:

the thickness ($T^2$) of the single solid North American softwood facing wood veneer is selected from the group comprising, 1/16 inch, 1/8 inch, 3/16 inch; and the single solid North American softwood facing wood veneered wood plastic composite core is configured including a thickness ($T^4$) of about 1⅛ inches, a width ($W^2$) of about 5¼ inches, and the length ($L^1$) of about 8.00-20.00 feet inclusive thereof.

12. The outdoor wood decking board for use in the construction of the outdoor deck floor, according to claim 8, wherein:

the thickness ($T^2$) of single solid North American softwood facing wood veneer is selected from the group comprising, 1/16 inch, 1/8 inch, 3/16 inch; and the single solid North American softwood facing wood veneered wood plastic composite core is configured including a thickness ($T^4$) of about 1⅛ inches, a width ($W^4$) of about 3¼ inches, and the length ($L^1$) of about 8.00-20.0 feet inclusive.

13. The outdoor wood decking board for use in the construction of the outdoor deck floor, according to claim 8, wherein:

the thickness ($T^2$) of the single solid North American softwood facing wood veneer is selected from the group comprising, 1/16 inch, 1/8 inch, 3/16 inch; and the single solid North American softwood facing wood veneered wood plastic composite core is configured including the thickness ($T^1$) of about 1½ inches, a width ($W^6$) of about 7⅛ inches, and the length ($L^1$) of about 8.00-20.00 feet inclusive.

14. The outdoor wood decking board for use in the construction of the outdoor deck floor, according to claim 8, wherein:

the thickness ($T^2$) of single solid North American softwood facing wood veneer is selected from the group comprising, 1/16 inch, 1/8 inch, 3/16 inch; and the single solid North American softwood facing wood veneered wood plastic composite core is configured including the thickness ($T^4$) of about 1⅛ inches, a width ($W^5$) of about 7¼ inches, and the length ($L^1$) of about 8.00-20.00 feet inclusive.

* * * * *